US009189914B2

(12) United States Patent
Dinkla

(10) Patent No.: US 9,189,914 B2
(45) Date of Patent: Nov. 17, 2015

(54) METHOD FOR MULTI-PLAYER POKER-TYPE CARD GAME

(76) Inventor: K. Gerrit Dinkla, San Antonio, TX (US)

( * ) Notice: Subject to any disclaimer, the term of this patent is extended or adjusted under 35 U.S.C. 154(b) by 1392 days.

(21) Appl. No.: 12/264,908

(22) Filed: Nov. 4, 2008

(65) Prior Publication Data

US 2009/0124317 A1 May 14, 2009

Related U.S. Application Data

(60) Provisional application No. 60/988,098, filed on Nov. 14, 2007.

(51) Int. Cl.
*G07F 17/32* (2006.01)
*A63F 3/00* (2006.01)
*A63F 1/00* (2006.01)

(52) U.S. Cl.
CPC ..... *G07F 17/32* (2013.01); *A63F 3/00157* (2013.01); *G07F 17/3293* (2013.01); *A63F 2001/005* (2013.01)

(58) Field of Classification Search
CPC ..... G07F 17/3293
USPC ..... 273/292, 303; 463/13
See application file for complete search history.

(56) References Cited

U.S. PATENT DOCUMENTS 5,732,950 A * 3/1998 Moody ..... 273/292
5,823,873 A 10/1998 Moody
6,007,066 A * 12/1999 Moody ..... 273/292
6,206,780 B1 3/2001 Awada
6,270,405 B1 * 8/2001 Ferguson ..... 463/13
6,533,279 B2 3/2003 Moody et al.
6,585,587 B2 * 7/2003 Falciglia, Sr. ..... 463/13
6,733,390 B2 5/2004 Walker et al.

(Continued)

OTHER PUBLICATIONS

Legato, Frank; Slot Sensation; Strictly Slots (www.casinocenter.com); p. 65-68; May 2008.

(Continued)

*Primary Examiner* — Jay Liddle
(74) *Attorney, Agent, or Firm* — Kammer Browning PLLC

(57) ABSTRACT

The invention provides for methods of playing video poker type games in multi-player environments. Some embodiments adapt conventional video poker for use as a live table based community game. Alternate embodiments of the present invention are suitable for implementation through linked video poker machines. The common feature is that the initial hand of cards in play are shared by a plurality of players, giving each player the same starting hand and yet the means to individually select cards to hold according to their personal preference. In the preferred embodiment an initial community stud hand is dealt face up to a bottom row. All players make hold selections of the community cards in accordance with draw poker. A second community stud hand is dealt face up to a top row. A dealer moves each player's hold selections from the bottom community hand row into a provided blank center row. Unless a player elects to hold all cards from the initial community hand, the dealer will use cards from the second community stud hand in the top row to complete each player's final draw poker hand in the center row. The step is repeated for each player until all wagers are settled according to a draw pay table. Additionally a stud wager may be placed betting that either of the two community stud poker hands created during play of the draw game will qualify according to a multi-chance stud pay table.

12 Claims, 40 Drawing Sheets

(56) References Cited

U.S. PATENT DOCUMENTS

| | | | | |
|---|---|---|---|---|
| 6,877,747 | B2 | 4/2005 | Moody | |
| 6,955,599 | B2 | 10/2005 | Bourbour et al. | |
| 7,017,909 | B1 | 3/2006 | Awada | |
| 2003/0153376 | A1* | 8/2003 | Duhamel | 463/13 |
| 2003/0162577 | A1 | 8/2003 | Hamud | |
| 2003/0207705 | A1* | 11/2003 | Falciglia, Sr. | 463/13 |
| 2004/0119236 | A1 | 6/2004 | Moody | |
| 2004/0157657 | A1* | 8/2004 | Loewenstein et al. | 463/13 |
| 2004/0214625 | A1* | 10/2004 | Millerschone | 463/13 |
| 2005/0151319 | A1 | 7/2005 | Berman et al. | |
| 2006/0119044 | A1 | 6/2006 | Kekempanos et al. | |
| 2006/0128455 | A1 | 6/2006 | Bourbour et al. | |
| 2006/0287043 | A1 | 12/2006 | Englman et al. | |
| 2008/0020842 | A1 | 1/2008 | Kaminkow et al. | |
| 2008/0234025 | A1 | 9/2008 | Yoshizawa | |
| 2008/0268958 | A1 | 10/2008 | Walker et al. | |
| 2008/0300034 | A1 | 12/2008 | Savage et al. | |

OTHER PUBLICATIONS

Shuffle Master, Inc.; Let it Ride Bonus (www.shufflemaster.com); 2004.

Shuffle Master, Inc.; Three Card Poker (www.shufflemaster.com); 2004.

Shuffle Master, Inc.; Four Card Poker (www.shufflemaster.com); 2004.

* cited by examiner

METHOD FOR MULTI-PLAYER POKER-TYPE CARD GAME

CROSS-REFERENCE TO RELATED APPLICATIONS

This Application claims the benefit of U.S. Provisional Application No. 60/988,098 filed Nov. 14, 2007.

BACKGROUND OF THE INVENTION

1. Field of the Invention

This invention generally relates to card games and other games of chance and skill as well as methods for carrying out the play of such games. The present invention relates more specifically to methods of playing video poker type games on live casino tables and other multi-player environments such as linked video poker machines.

2. Description of the Related Art

Any discussion of the prior art throughout the specification should in no way be considered as an admission that such prior art is widely known or forms part of common general knowledge in the field.

The growth of the gaming industry, in particular, gambling casinos has been very significant in recent years. The industry has come to recognize the need for new games and new gambling concepts. It also recognizes that the new technologies and methods available need to be integrated in order to improve their gaming environments.

The state gaming control boards of Nevada and New Jersey (which have traditionally been slow to approve any new games or gambling concepts) have changed their philosophy so dramatically that today they actively encourage the trial and acceptance of new games and gambling concepts. The problem with introducing new games has always been the basic criteria for mass-market gambling:

Easy-to-learn game rules.

Strategies must be easy to master and not favor an expert disproportionately.

Games must have a short duration between the start (the bet) and the finish (the payoff).

The payoff structure must be enticing to players.

The game must be sufficiently fair so that a player has an opportunity to win sometimes, and the casino should not have an unreasonable advantage.

The game must be susceptible to security and surveillance so that it is protected from cheating and tampering.

The casino's hold or advantage must be demonstrated to be sufficiently worthwhile that a casino can afford to operate and maintain the game with a profit.

Optionally, to aid in marketing, the game should contain familiar elements that peak interest and draw the attention of potential customers.

With the ongoing need to attract and entertain casino patrons, new alluring gaming activities are essential. Over the years, there have been many different types of games that have attempted to satisfy the demands of the gaming industry. These games have ranged the gamut from those involving great mental prowess to games involving merely chance. Nevertheless, there is still a strong interest in game concepts that create real excitement.

Casino games can generally be categorized as either Communal (Multi-Player) or Non-Communal (Single Player). Table games are considered to be communal, since multiple players participate in a common event. The common event could be a shared deck of cards and resulting dealt hands, the spin of a wheel, the drawing of numbered balls, or the outcome of thrown dice, etcetera. Conversely, until recently, virtually all slot machine type games were considered non-communal. These games were designed to accept a wager from one player and provide a result to that one player. While these slot-type games have enjoyed much success they fail to provide the social aspects of communal games that many players enjoy.

The gaming industry has come to recognize this problem, as evidenced in recent years with new slot machine systems that address the issue. For example in the May 2008 issue of the periodical Strictly Slots an article written by Frank Legato on pages 64-68 discloses a new community slot product from International Game Technology (IGT) with a popular auction website theme. The system provides two base games on a plurality of linked gaming machines. A community bonus round occurs randomly and provides free community spins, resulting awards are shared by the players.

U.S. Patent Application Publication No. 2006/0287043 (Englman et al.) discloses a gaming system for conducting a community game at linked gaming machines including a best selection feature that allows players to make selections from a plurality of selectable objects. Each selected object is associated with an award and the highest award is awarded to each of the players at the linked gaming machines. All players at the linked gaming machines win at the same time thereby providing a communal experience to an otherwise non-communal slot machine.

U.S. Patent Application Publication No. 2008/0020842 (Kaminkow et al.) provides a gaming system having a plurality of gaming devices linked by a common gaming event, wherein the event generates a separate or individual outcome for each linked or associated gaming device. Upon triggering a bonus event, each player playing one of the linked gaming devices takes part in a community wheel spin to achieve an award outcome.

These wagering games involve engaging multiple players to enter a shared, or community, wagering game wherein multiple gaming machines are linked together to play a shared basic or bonus game. The problem with current communal slot-type games is that they lack community features that would attract video poker players. The popularity of video poker has increased significantly over the past years. Further enhancing the attractiveness of video poker machines could result in substantially increased profitability for casinos. Creating a sense of social interaction and community could provide such a result. The prior art fails to provide a community game or bonus round that addresses the special interests and needs of video poker players.

Even those skilled in the art may fail to understand the special interests and needs of video poker players it is therefore necessary to review the important elements of the game inherent to the conventional form of play. Video poker is a single player game based on the communal game, draw poker, in which players attempt to best other players. However video poker is a single player, non-communal variation of this game. Conventional video poker pits a player against a pay table and not other players or a dealer. The player attempts to achieve a winning poker hand ranking by discarding from an initial five card hand and drawing new cards in order to try and improve their poker hand ranking. A pay table is provided to show the player what they can win based on the poker hand ranking achieved after "the draw" and the amount wagered by the player.

Many players appreciate that video poker games offer comparatively good odds, and will go to the trouble of studying strategies which increase their chances of winning. Strategy for play is determined by the rules, such as wild cards or no wild cards, and the odds pay table. Those skilled in the art understand that pay tables determine—statistically—the best hold decision to make given a particular initial hand dealt. Video poker rules and respective strategies are easy for a novice to learn and widely available in casino gift shops, bookstores and freely on internet websites. Easy to learn rules and strategies are part of the criteria for mass-market gambling disclosed above. It is therefore desirable for new video poker game concepts to offer these same familiar strategies.

One very successful video poker variation is disclosed in U.S. Pat. No. 5,823,873 (Moody). The invention involves a video poker game in which multiple hands are played congruently, the method of which has come to be known as Multi-Play. One reason for the success of Multi-Play and related products is that the game succeeds at not altering the familiar rules and strategies of conventional video poker. However community features of the game as disclosed are very limited. The specification reveals the use of multiple hands but fails to disclose implementation of these multiple hands on a multi-player platform such as a live table or linked video poker machines.

A common innovation in video poker is the attempt to enhance the game by incorporating a stud poker feature. In U.S. Pat. No. 5,732,950 (Moody), there is disclosed a method of playing poker that combines a stud poker hand with a draw poker hand. The player is dealt two starting hands, one is a stud poker hand and the other is a draw poker hand. The player makes a first wager on the draw poker hand and the player makes a second wager on the stud poker hand. The draw poker hand is then played out by the player, but replacement cards for those cards discarded by the player from the draw poker hand come only from the associated cards in the stud poker hand.

In the preferred embodiment of Moody '950, the stud poker hand is aligned adjacent to the draw poker hand and any card discarded from the draw poker hand is replaced by a duplicate of the adjacent stud poker card. The final draw poker hand is revealed and analyzed to determine if it is a winning poker hand combination with the winning poker hands being shown in a first pay table associated with draw poker. The stud poker hand is revealed and analyzed to determine if it is a winning poker hand combination with the winning poker hands being shown in a second pay table associated with stud poker. One of the drawbacks to the method of play described in '950 is that the player can only play a single stud poker hand. Moody addresses this issue later with his U.S. Pat. No. 6,877,747 (Moody).

In Moody '747 patent, draw poker and stud poker are combined into the same round of play. According to the specification: In order to increase the playability and enjoyment of a video poker game, it is desirable to offer the player the opportunity to play one or more stud poker hands while at the same time playing a draw poker hand. It is a feature of '747 to allow the player to make a first wager to play a draw poker hand. The player also makes a second wager that is allocated among one or more stud poker hands. The player is then dealt both the draw poker hand and the plurality of stud poker hands that the player has determined to play. For each stud poker hand that is a winning hand combination, the player receives a payout for whatever winning hand combination he achieved based on a pay table and the amount of the player's wager on the winning stud poker hand(s). The draw poker game is then played out by the player according to the conventional manner of play of draw poker.

According to Moody '747 separate decks are used, one for playing the draw game and another for the stud portion of the game. These separate decks create a discontinuity between the two parts of the game that may be undesirable by players. There is no relationship between the cards used in the draw game and those used in the stud game. Additionally to play the stud game with more than one chance to win the player is required to make multiple bets for each chance at a winning stud hand, or divide the wager equally to the number of stud hands played. This method will be problematic in multi-player environments such as a live table where a dealer would have to manage and settle many separate stud wagers. It would be an advantage if a single wager could be placed that would still give the player more than one chance to win and yet not unduly complicate the placing and settling of multiple wagers. Additional communal features are missing relegating this game to a single player environment.

In U.S. Patent Application Publication 2005/0151319 (Berman et al.) a method for playing poker-style games involving a draw is disclosed. A starting hand of cards is presented, and the player is allowed to select a number (including zero) of cards to hold from the starting hand. Multiple replacement hands (i.e., multiple sets of one or more replacement cards) are presented to the player, where the player is allowed to select a replacement hand(s). A resulting hand(s) is created using the held cards and the replacement hand(s) selected by the player.

One embodiment of '319 describes how the method might be deployed on a table as a multi-player game. The table play method pits players against other players when the cards are dealt face down. This method strays from the underlying concept of video poker, which is to have a player play against a pay table and not other players. If, however the cards are dealt face up on to a table, congruent with the primary methods disclosed in the publication, we expose a security risk for the casinos which could result in cheating. '319's specification does not address this very important security problem which we will discuss now in more detail.

Those skilled in the art understand, that pay tables used in any given video poker game provide a minimum house edge based on optimal play. Casinos use pay tables that assume a player has no knowledge of which cards he or she is likely to draw other than they will not be able to draw the cards they discard. If an astute player is aware that certain cards are unavailable as replacement cards for completion of their hand that player will possess an advantage. This advantage will change the optimal hold strategy for a given hand. A skilled player, using this knowledge, can alter the minimum house edge in favor of the player such that the casino might lose money. This problem prevents most house banked draw poker type games from being a viable option for a casino operator.

U.S. Pat. No. 6,533,279 (Moody et al.) discloses a method of playing a three card draw poker game. An initial hand of three cards is dealt to the player and three community cards are dealt face down. The player decides which cards to hold and which cards to discard. For each card that is discarded, the player uses one of the community cards as the replacement card. If the player discards one card, Card 1 is used as the replacement card. If the player discards two cards, Card 1 and Card 2 are used as the replacement cards. If the player discards all three cards, Card 1, Card 2 and Card 3 are used as the replacement cards. After the player has made his decision, all of the community cards are turned face up and the outcome of the player's final three card hand is determined. Awards are determined based on a pay table and the amount of the player's wager.

Regarding Moody's '279 patent, the method could obviously be expanded to include five cards. Using the method in a five card embodiment would result in a communal table game that plays like conventional video poker. However, the method would still suffer from the security issue inherent to any game that reveals cards no longer available for draw. Since players at the table all receive cards it will be difficult for the casino operator to prevent players from disclosing to other players cards in their possession. Therefore low house edge pay tables like those offered on video poker machines and the respective strategies could not be viably implemented.

It is because of the security issue discussed above that a house banked draw poker-style of video poker cannot be readily implemented on a real table in a casino. In a game where players compete against the house and not other players there is no practical method to guarantee a player would not disclose to another player the cards in their respective hands. A solution would be to deal to each player cards from a separate deck, i.e. five players, five decks, however this would remove the communal element of shared cards while presenting implementation difficulties that make it an undesirable option.

Regarding efforts to add community elements to video poker; U.S. Pat. No. 6,733,390 (Walker et al.) discloses a method and apparatus for team play of slot machines, including video poker. The patent discloses a method and system for introducing the concepts of team play and social interaction into video poker machines. This is accomplished through the incorporation of bonus payouts available to a group, or team of players, if specified bonus conditions are met. In one embodiment, the specified bonus conditions require the team to obtain a requisite number of bonus outcomes within a predefined time period. Bonus outcomes may include, for example ranked hands in video poker such as a four-of-a-kind or a straight. The invention thus encourages concerted action by all of the linked players to achieve the bonus outcome.

Those skilled in the art will recognize that Walker '390 team play bonus rounds create conditions which alter conventional video poker playing strategy. Specifically, during the bonus event team players temporarily benefit more from certain hand rankings than they might when no bonus is offered. This means that the strategy of play is constantly changing based on the particular bonus combinations. Mastering of this complex optimal play strategy will be difficult or impossible for players to learn and practice in mass. Additionally this system will not viably adapt to a live table environment. Offering a communal or team play video poker-type experience on a live table would enable a casino to attract players to their establishments by offering a new game that many players already know how to play.

In so far as the prior-art is concerned; it is particularly void of any disclosures or showings of a method that would adapt conventional video poker into a multi-player game without altering pay tables and strategies. However, a known method that achieves several objectives of the present invention should be considered along with its disadvantages.

Since the introduction of the slot machine, pooling of wagers amongst players has always been an option. Indeed it was the use of this method that inspired the present invention. Two or more players can put an equal amount of funds into a machine and play together, sharing winnings or losses in shared rounds of play. While there is a great communal benefit to the method, many problems become apparent that diminish the gaming experience. A disclosure of these problems will help the reader better appreciate the utility of the present invention.

(a) Pooling of funds—Pooling often requires exact change which any of the pool members may or may not have in order to deposit an equal share into the machine. Unequal shares of a pool often require cumbersome math. Additionally when the group play is terminated any remaining funds will have to be divided, this often requires particular denominations of currency and additional cumbersome math.

(b) Bet Amount—The pooled players will have to agree on an amount to bet for each round. It will be difficult or impossible for one player to bet more or less than another if desired. It also is difficult for a group to decide when a wager should be changed; this practice is known as varying your bet.

(c) Sitting Out—If a player wishes not to participate in a given number of rounds the mathematics involved for keeping the pool equaled is problematic. This also applies to a member trying to terminate the group play prior to the agreed stopping limit.

(d) Holding Consensus—All players must agree as to which cards from the initial hand should be held. One player cannot hold differently from the other. The potential exist for arguments to arise within the group over a play.

(e) Settling Arguments—In the event a disagreement arose as to what the best play would have been. It is difficult or not possible to know what outcome would have occurred had the cards been held differently.

BACKGROUND OF THE INVENTION

Objects and Advantages

Accordingly, several objects and advantages of the present invention are:

(a) to provide a multi-player video poker-type game that does not require pooling of funds;

(b) to provide a multi-player video poker-type game that allows each player to place wagers of their individual choosing;

(c) to provide a multi-player video poker-type game that allows for players to join and depart from the group with minimal disruption of the game's pace;

(d) to provide a multi-player video poker-type game that allows each player to select cards from the same initial starting hand in a manner of their choosing; and (e) to provide a multi-player video poker-type game that reveals to the players all replacement cards such that each player can easily determine their own outcome and all potential outcomes associated with a different selection decision.

Further objects and advantages are to provide a video poker-type game that will comply with the basic criteria for mass market gambling.

To provide a video poker based community bonus game that can be implemented over a plurality of linked video poker machines.

To provide a secure multi-player video poker-type card game which will require little or no change of pay tables or draw strategies from that of conventional video poker, such that play of the game will be familiar to existing video poker players.

To provide a multi-player video poker-type card game that can be implemented on many multi-player platforms—including but not limited to—a plurality of linked gaming devices, live casino tables, electronic tables or hybrid electronic/non-electronic tables. With regards to table embodiments it is a further advantage to provide a game that is easy for a professional dealer to manage.

To provide a multi-player video poker-type card game with an integrated stud wager that provides more than one chance to win with only a single wager using cards already in play from the base draw game.

Another object and advantage of the present invention is to provide a more entertaining, video poker or video poker-type experience to casino patrons with emphasis on building camaraderie.

Further objects and advantages will become apparent from a consideration of the ensuing description and drawings.

SUMMARY OF THE INVENTION

The invention provides for methods of playing video poker type games in multi-player environments. Some embodiments adapt conventional video poker for use as a live table based community game. Alternate embodiments of the present invention are suitable for implementation through linked video poker machines. The common feature is that the initial hand of cards in play are community cards, shared by a plurality of players, giving each player the same starting hand and the means to individually select cards to hold according to their personal preference.

DRAWINGS

Figures

The accompanying drawings incorporated in and forming a part of this specification illustrate several aspects of the present invention and together with the description serve to explain the principles of the invention. Note that closely related figures have the same number but different alphabetic suffixes. In the drawings:

FIG. 1A-1B together comprise a flow chart illustrating a multi-player video poker-type game process of play in accordance with the preferred embodiment titled Version 1A.

Figure 1A:
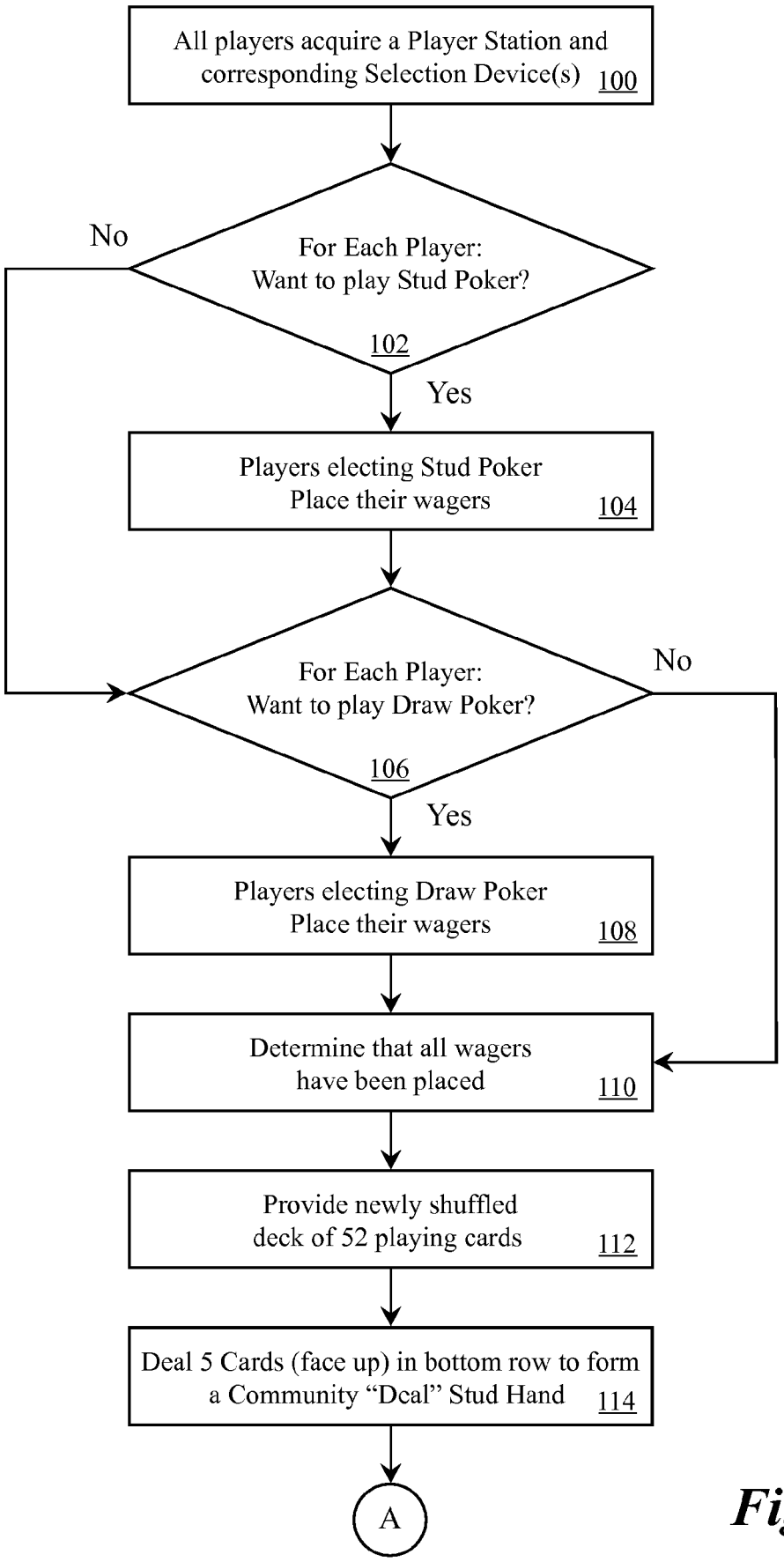

Efforts have been made to assist the reader in following the specification as it relates to the drawings and numerous reference numerals. The first prime number of a three prime reference numeral represents the figure that first showed an illustration of that part. In the case of a four prime reference numeral the first two primes represent the figure that first illustrated that particular part.

DETAILED DESCRIPTION

Preferred Embodiment—FIGS. 1A, 1B, 2, 3

The present invention provides a method for introducing community or group play to video poker type card games that involve a draw feature. The preferred embodiment (Version 1A) is implemented on a gaming table with a live dealer who shuffles and deals cards and it is free of electronics. Alternatively use of electronic devices to facilitate faster and more secure game play are anticipated. Fully electronic poker tables are already known and may also be a useful multi-player platform for the present invention.

Version 1A—Live Table, 2 Community Hands, Selection Cards

Figure 1B:
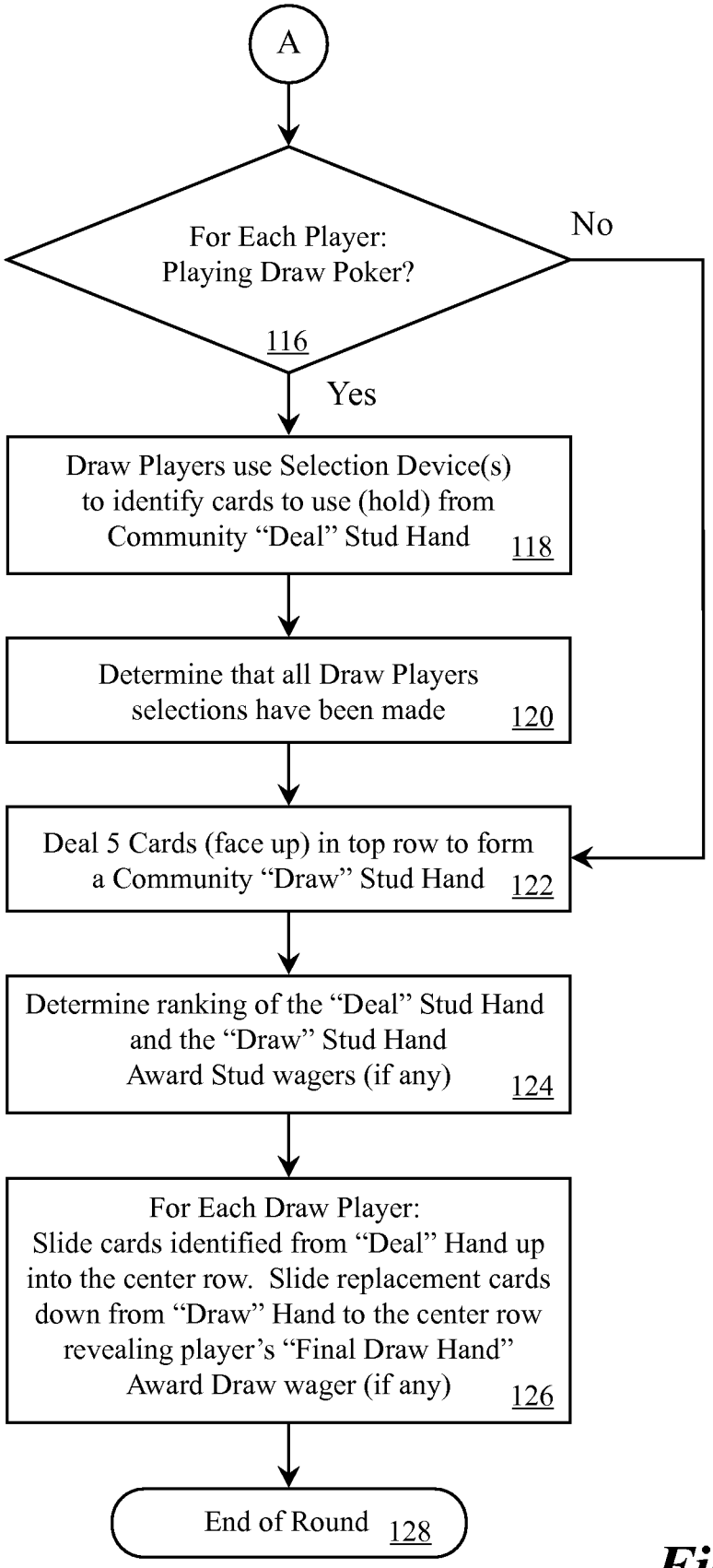
Figure 2:
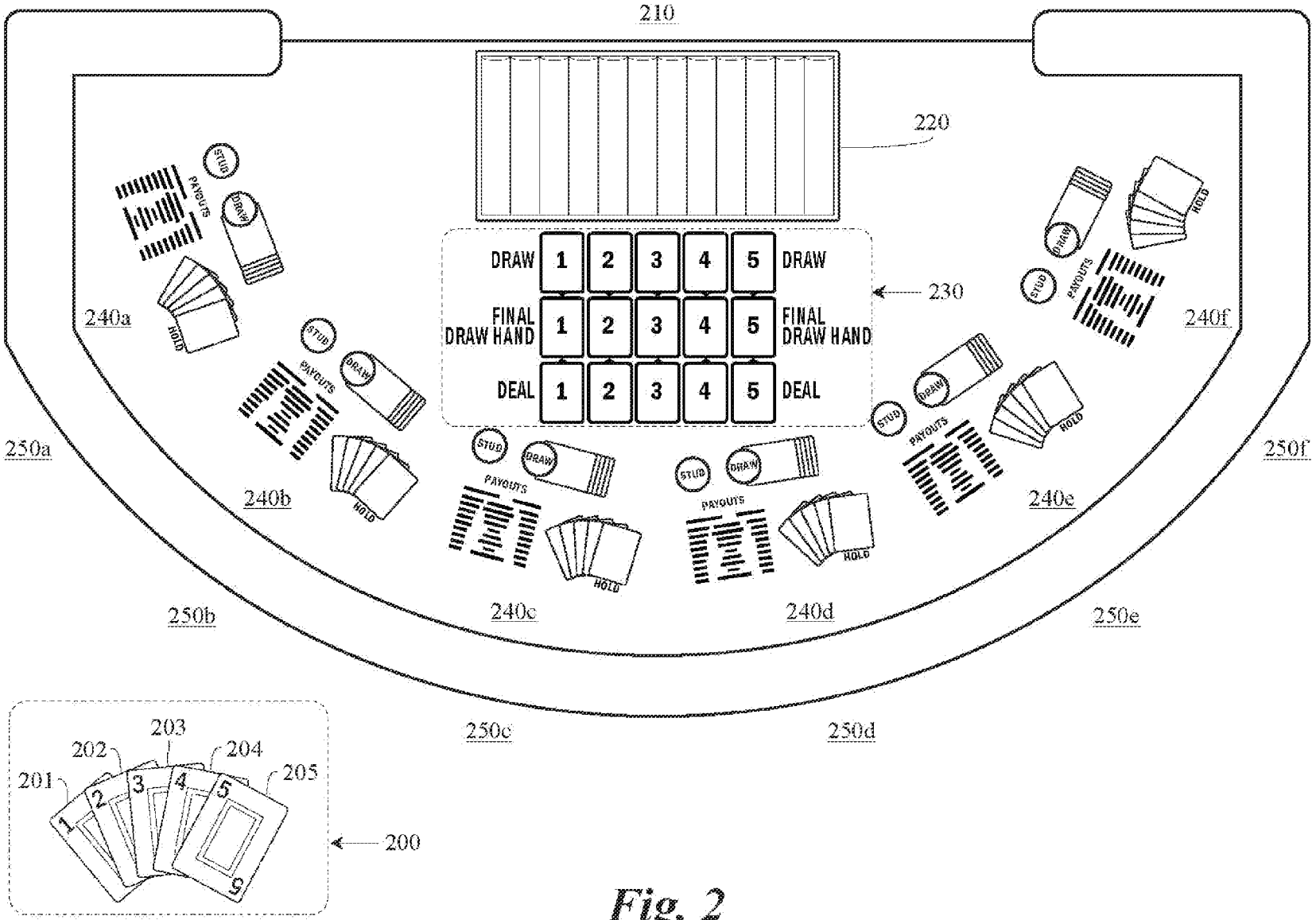
FIG. 2 shows a non-electronic table, player stations/positions and selection cards suitable for implementing Version 1A.

FIG. 1A and FIG. 1B together show a flow chart 100-128 illustrating a manner of playing a card game in accordance with Version 1A of the present invention. FIG. 2 shows a semicircular gaming table and a set of selection cards 200-205. Above the table an area for a dealer 210 and his or her chip tray 220 is shown. Near the tables center a common display area 230 is shown. Surrounding the common display area 230 are six player stations 240*a*-240*f*, corresponding player positions 250*a*-250*f* are also indicated.

Figure 3:
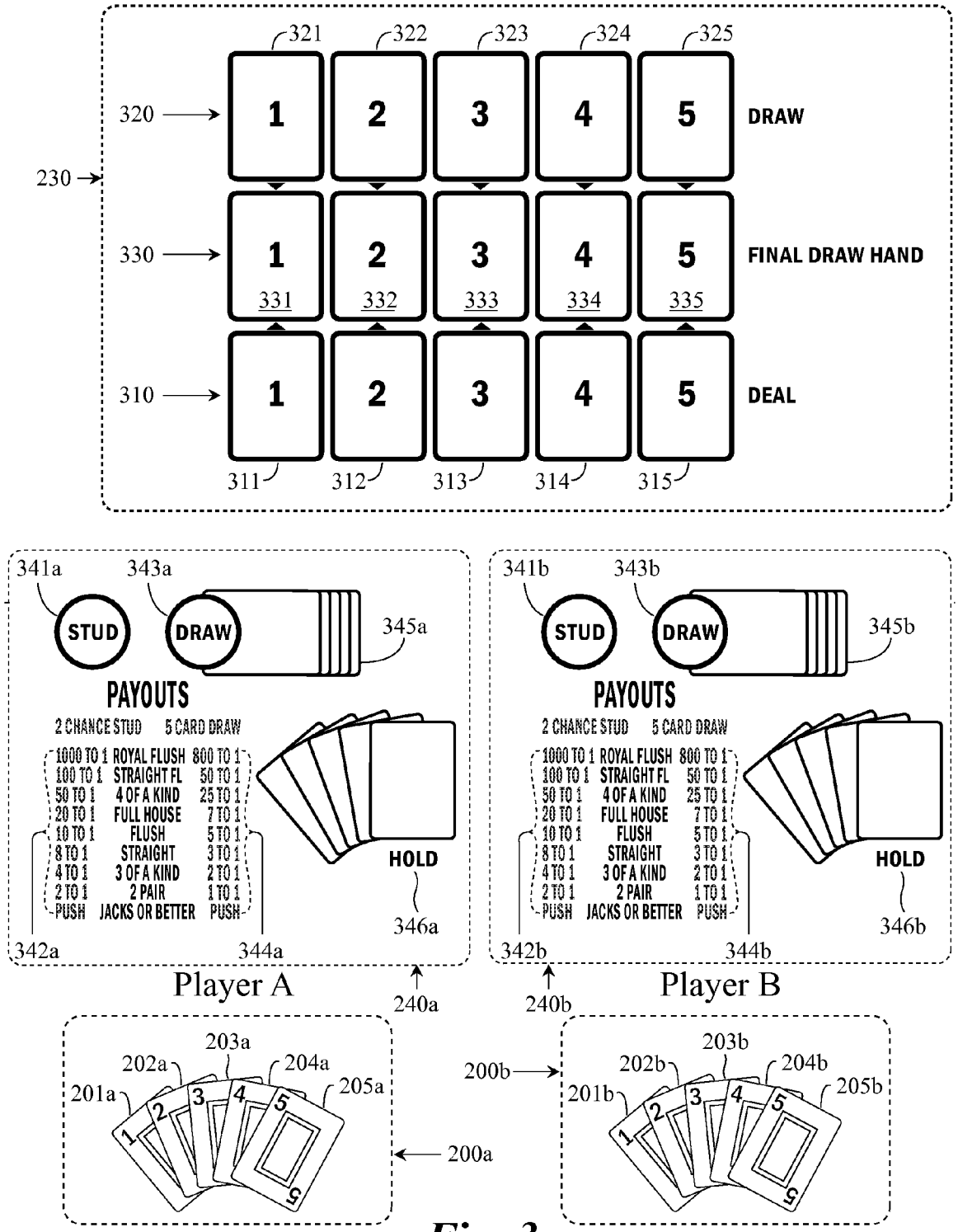
FIG. 3 shows a common (shared) display, player stations (two) and selection cards (five) for Version 1A as they appear before any wagers are made.

FIG. 3 shows an enlargement of the common display area 230 with three rows 310-330, each row contains five labeled rectangular shaped card positions 311-335 with each card position representing one of five numbered columns, each position has the number 1 thru 5 printed on the table layout within the rectangular shape. Also shown in FIG. 3 are two player stations 240*a* & 240*b*. Each contains an area to place stud wagers 341*a* & 341*b* and corresponding stud pay tables 342*a* & 342*b*. Each also contains an area to place draw wagers 343*a* & 343*b* and corresponding draw pay tables 344*a* & 344*b*. The player stations 240*a* & 240*b* provide a discard area 345*a* & 345*b* for selection cards 200*a* & 200*b* (respectively) to be placed face down and a hold area 346*a* & 346*b* for selection cards 200*a* & 200*b* (respectively) to be placed face up. Player A will use selection cards 201*a*-205*a* as an additional component of the player station 240*a* to indicate selection decisions. Player B will use selection cards 201*b*-205*b* as an additional component of the player station 240*b* to indicate selection decisions.

Operation

Preferred Embodiment—FIGS. 1A, 1B, 2, 3, 4, 5, 6, 7

Figure 4:
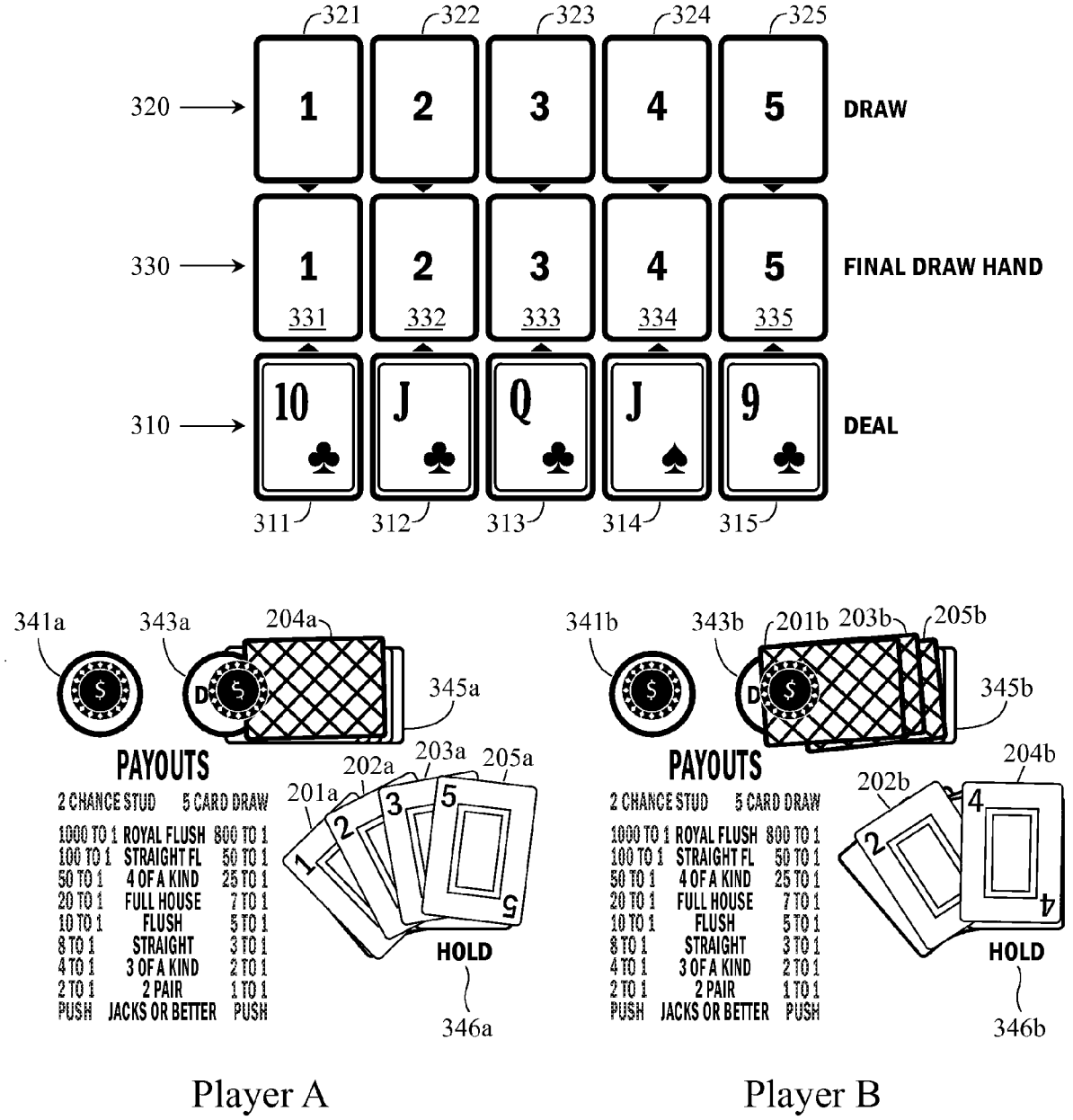
FIG. 4 shows a common display, player stations and selection cards for Version 1A as they appear after all wagers, the deal and holding selections are set.

With reference now to FIG. 4 we see that Player A and Player B have placed stud wagers 341*a* & 341*b* and draw wagers 343*a* & 343*b*. In the preferred embodiment of the present invention, the players are able to make two types of wagers—one for a draw game and one for a two chances stud game. A player can play either the draw game or the stud game or both. The dealer (210 of FIG. 2, not shown) has dealt five community cards into the deal row 310 forming a community deal stud hand containing the ten of clubs 311, jack of clubs 312, queen of clubs 313, jack of spades 314 and the nine of clubs 315. This paragraph concludes steps 100-114 of FIG. 1A.

Player A has placed selection cards numbered 1 201*a*, 2 202*a*, 3 203*a* and 5 205*a* in the hold area 346*a* and one card numbered 4 204*a* face down in the discard area 345*a* indicating to the dealer that they want to hold the card in column 1 311, the card in column 2 312, the card in column 3 313 and the card in column 5 315. Note that the selection cards 201*a*-205*a* contain numbers 1 thru 5 that correspond to the column numbers 1 thru 5 respectively.

Player B has placed selection cards 2 202*b* and 4 204*b* in the hold area 346*b* and card 1 201*b*, 3 203*b* and 5 205*b* face down in the discard area 345*b* indicating to the dealer that they want to hold the card in column 2 312 and column 4 314. At this point the dealer locks each player's decision by placing any face down discard selections under the draw bet 343*a* & 343*b* respectively. The previous two paragraphs conclude steps 116-120 of FIGS. 1A & 1B.

Figure 5:
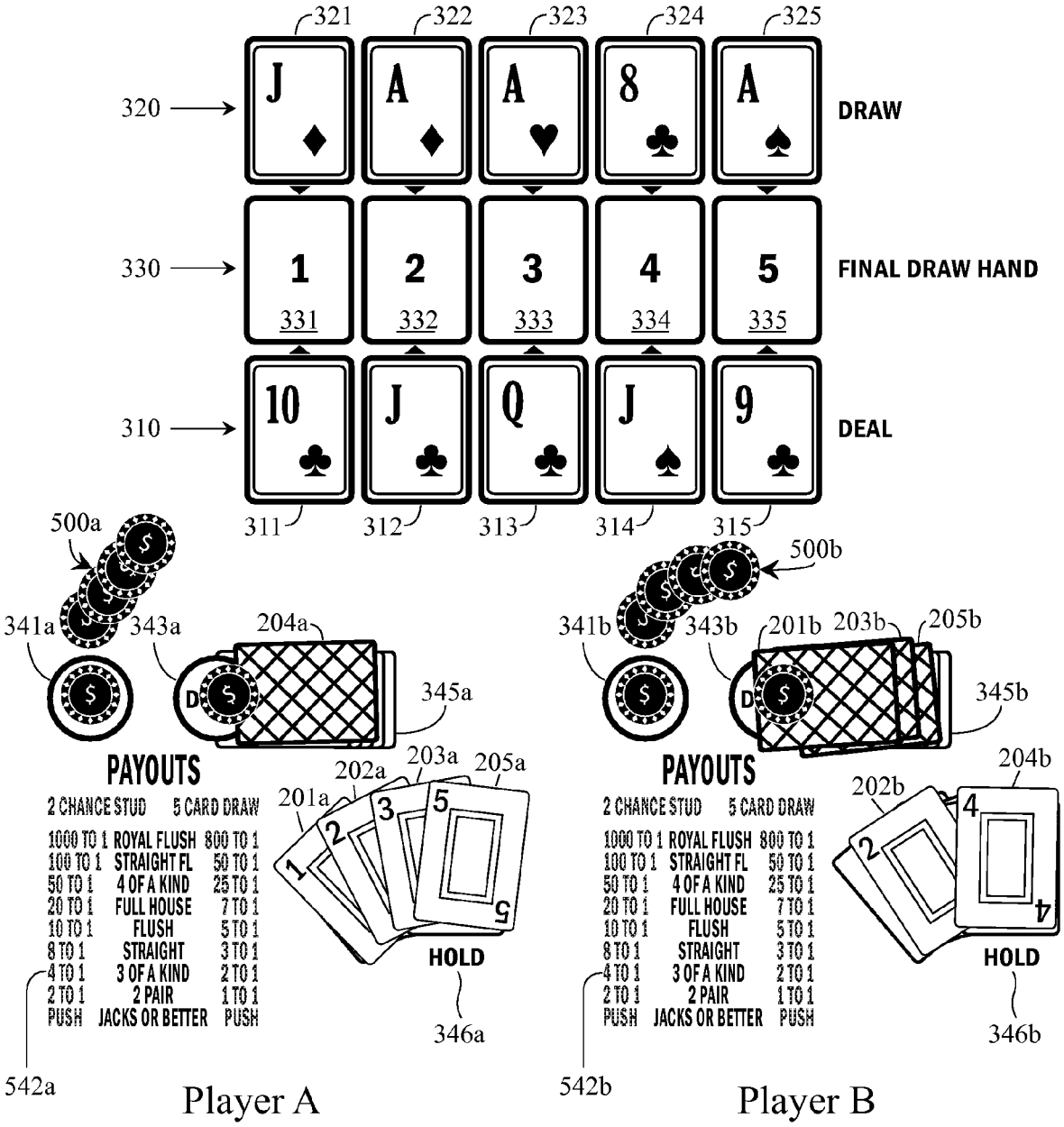
FIG. 5 shows a common display, player stations and selection cards for Version 1A as they appear after the draw and settlement of all two chance stud wagers.

FIG. 5 shows the layout after the dealer has dealt community replacement cards 321-325 into the draw row 320 creating a community draw stud hand. The hand contains a jack of diamonds 321, ace of diamonds 322, ace of hearts 323, eight of clubs 324 and an ace of spades 325. The dealer has determined the rank of both the deal stud hand 310 and the draw stud hand 320. Note: The two chances stud wager only awards the highest ranking of the two hands. The draw stud hand contains a three of a kind (aces) ranking which is higher than the pair (jacks) in the deal stud hand 310. All two chances stud wagers are paid 500*a* & 500*b* according to a two chances stud pay table for three of a kind 542*a* & 542*b*. This paragraph concludes steps 122-124 of FIG. 1B.

Figure 6:
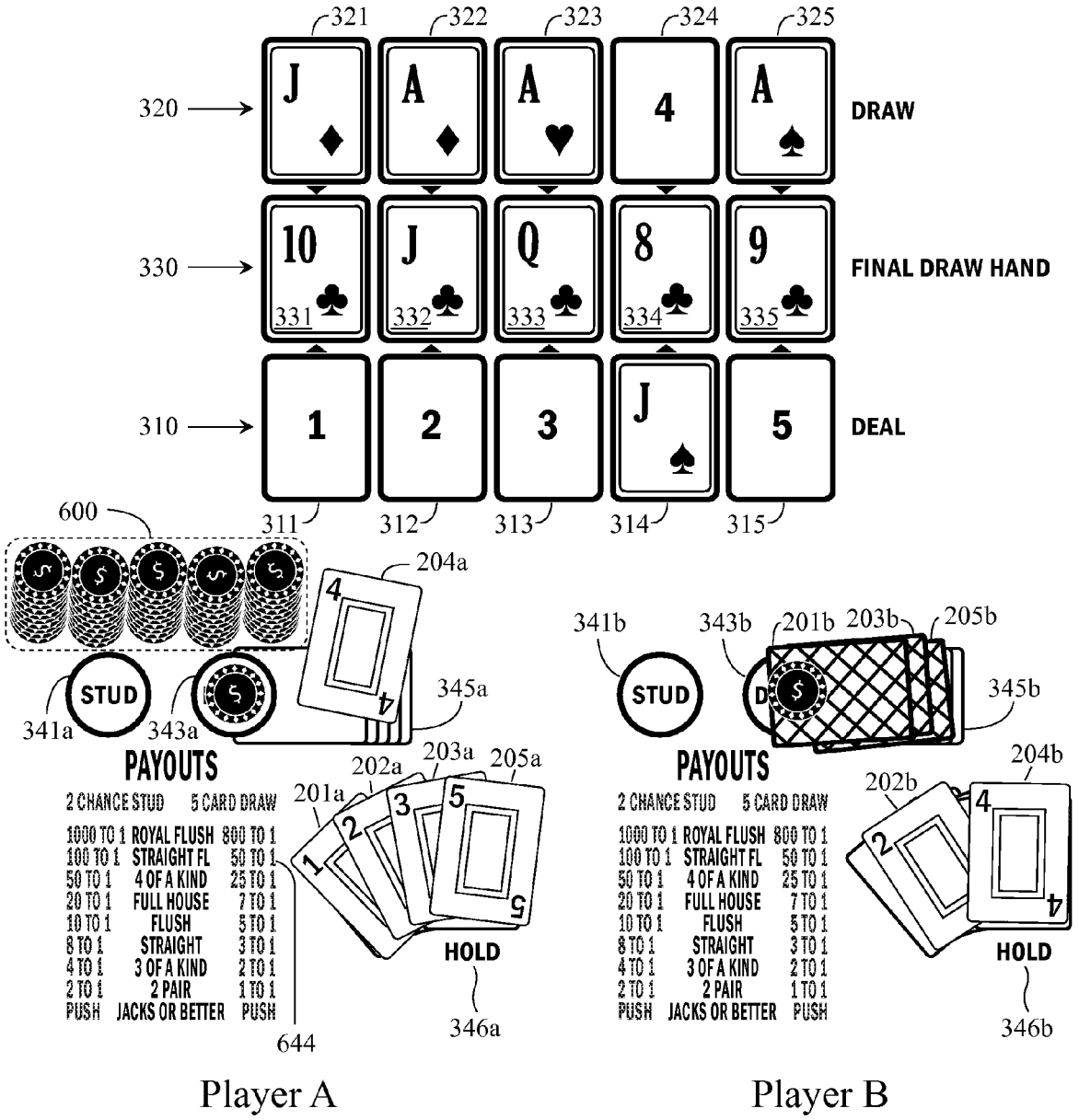
FIG. 6 shows a common display, player stations and selection cards for Version 1A as they appear after Player A's final draw hand is settled.

FIG. 6 shows the layout after the dealer has moved the cards selected to be held by Player A 331, 332, 333, 335 into the final draw hand row 330. Note: the column numbers 1 311, 2 312, 3 313 and 5 315 shown in the deal hand row 310 are revealed and that they match Player A's selection cards numbered 1 201*a*, 2 202*a*, 3 203*a* and 5 205*a* shown in the hold area 346*a*. The dealer also has flipped over Player A's face down selection card 204*a* and moved the corresponding replacement card eight of clubs 334 into the final draw hand row to complete a final draw hand. Player A held four cards to a straight flush and successfully drew the needed eight of clubs 334 into position 4 324 to complete his or hers final draw hand. Player A has been paid odds 600 in accordance with the straight flush award displayed in the draw pay table 644.

Figure 7:
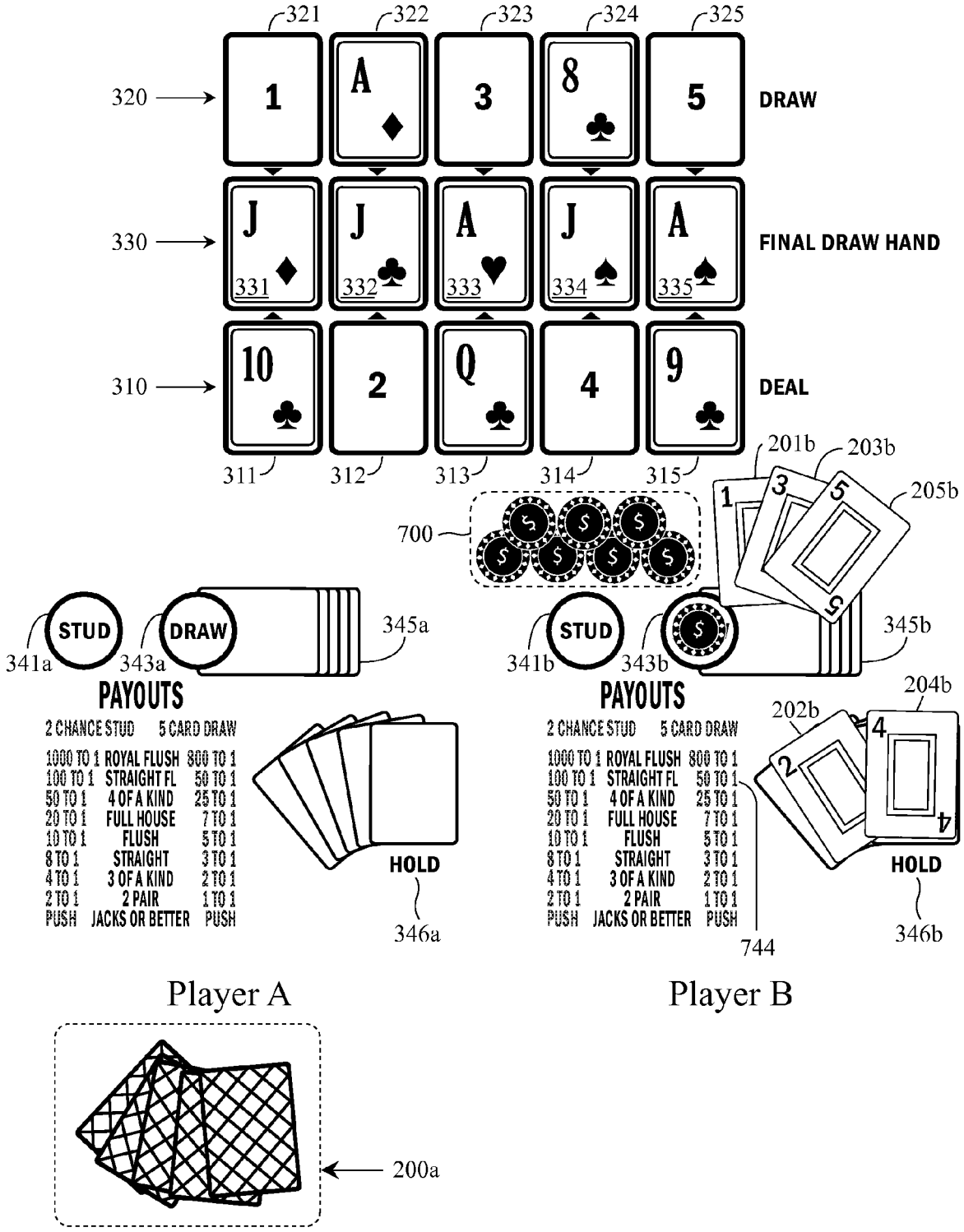
FIG. 7 shows a common display, player stations and selection cards for Version 1A as they appear after Player B's final draw hand is settled.

FIG. 7 shows the layout after the dealer has moved the cards selected to be held by Player B 332, 334 into the final draw hand row 330. Note: the column numbers 2 312, and 4 314 shown in the deal hand row 310 are revealed and that they match Player B's selection cards numbered 2 202*b*, and 4 204*b* shown in the hold area 346*b*. The dealer also has flipped over Player B's face down selection cards 201*b*, 203*b*, 205*b* and moved the corresponding replacement cards jack of diamonds 331, ace of hearts 333 and ace of spades 335 into the final draw hand row to complete a final draw hand. Player B held a pair of jacks and successfully drew a full house with an additional jack 331 and two aces 333, 335 into respective positions 1 321, 3 323 and 5 325 to complete his or hers final draw hand. Player B has been paid odds 700 in accordance with the full house award displayed in the draw pay table 744. To conclude a round of play the dealer returns selection cards to Player A 200*a* and Player B (not shown). The previous two paragraphs conclude the remaining steps 126 and 128 of FIG. 1B.

A review of Version 1A will show that no player received playing cards directly. Instead all players shared the initial deal hand dealt into the first bottom row 310. As seen in FIG. 4, using the numbered selection cards 201*a*-205*a* & 201*b*-205*b* each of which represent a card in the labeled row positions 311-315 all players are able to make hold selections of the five initial cards in a manner similar to draw poker. As FIG. 5 shows a second hand 321-325 is dealt face up to a top row 320. And as FIG. 6 shows each player's hold selections are moved from the bottom community hand row 310 into the provided center row 330, all the while keeping cards in the same relative column positions. Unless a player elects to hold all cards from the initial community deal stud hand, the dealer will use cards from the community draw stud hand in the top row to complete each player's final draw hand in the center row 330. The steps are repeated for each player until all wagers are settled according to a draw pay table and the amount of each player's wager.

Because everyone has shared the initial deal of cards it is not possible for players to have knowledge of cards removed from the deck. This eliminates the ability to cheat that would exist if each player received cards on the initial deal. In addition, the sharing of cards throughout the embodiment enables like minded players to play the same way and receive the same hands thus creating a great sense of camaraderie as they win and lose together. Like wise players having differing opinions of how to play the same starting hand are enabled to carryout play in a manner of their choosing with healthy boasting of the better final results.

With reference to FIG. 2 and all subsequent drawings that show the three row by five column grid 230 together with selection devices, such as but not limited to those shown 200; henceforth referred to as the Sandwich Drawing Method (SDM) so referred because two stud hands surround the final draw hand. The SDM enables players to easily comprehend not only their final draw hand but alternate outcomes of play as well. This adds additional drama and entertainment to the game experience because the players can see what would have happened if they had held differently in a manner that is easy to deduce.

The SDM 230 enables the dealer to create and reset hands in a relatively easy fashion that those skilled in the art would appreciate. An example of an alternative way to construct Player A's final draw hand would be to use the card in the first card position 321 (FIG. 6) to complete the hand. This would have resulted in a final hand containing a ten of clubs 331, jack of clubs 312, queen of clubs 313, jack of spades 314, nine of clubs 315 and a jack of diamonds 321. Since the jack of diamonds 321 was the first hand to come off the deck and Player A required only one replacement card this first card would be used. Like wise shown in FIG. 7 Player B required 3 replacement cards as indicated by selection cards 201*b*, 203*b*, 205*b*. The alternate way to construct the hand would result in the first three cards dealt from the deck as being the replacement cards resulting in Player B's final draw hand of jack of clubs 332, jack of spades 334, jack of diamonds 331, ace of diamonds 322 and the ace of hearts 333. However this alternate method, as well as many others, are more difficult for a dealer to manage. Player difficulty in hand comprehension prior to actual hand construction becomes apparent due to extraneous mechanical motion and lack of alignment. Those skilled in the art will therefore recognize the utility of the SDM 230 and obvious adaptations such as adding an additional column(s) for a six or seven card draw game or fewer columns enable a three or four card draw game.

In FIG. 3 the draw pay tables 344*a*, 344*b* are displayed in a "to 1" basis (common for table games). This versus a "for 1" basis (common in video poker games) is more familiar to dealers, and thus easier, for them to settle wagers. The "to 1" pay table modification rounds payouts for four of a kinds and higher ranking hands by one unit. Those skilled in the art understand this pay table modification alters the play strategy only slightly and for only the most expert of play strategies. Alternatively a "for 1" pay table may be utilized so that pay tables exactly match those displayed on video poker machines and there respective variations. The 'for 1" pay tables together with the SDM enable players to use the exact same hold strategies already familiar since game odds are unchanged from those of video poker.

Other modifications of the game table layout shown in FIG. 2 and subsequent Figs. may be made to accommodate game play other than the combined game of draw poker and stud poker as described herein. For example the stud wager can be removed where only draw poker would be played. Another example is a seven card stud game that could be added after the dealer constructs a player's final draw hand 330 (FIG. 6). The dealer could place two more playing cards from the deck, to the left or to the right, in the same row 330 whereby the best five cards of the seven would constitute a seven card stud hand. Corresponding wagers would be settled according to a seven card stud pay table and the amount wagered. Seven, more or less cards could be used in this manner on either the final draw hands or the two stud hands 310, 320 (FIG. 5). Other modifications will become apparent in the alternate embodiments disclosed herein.

Description

Figure 8:
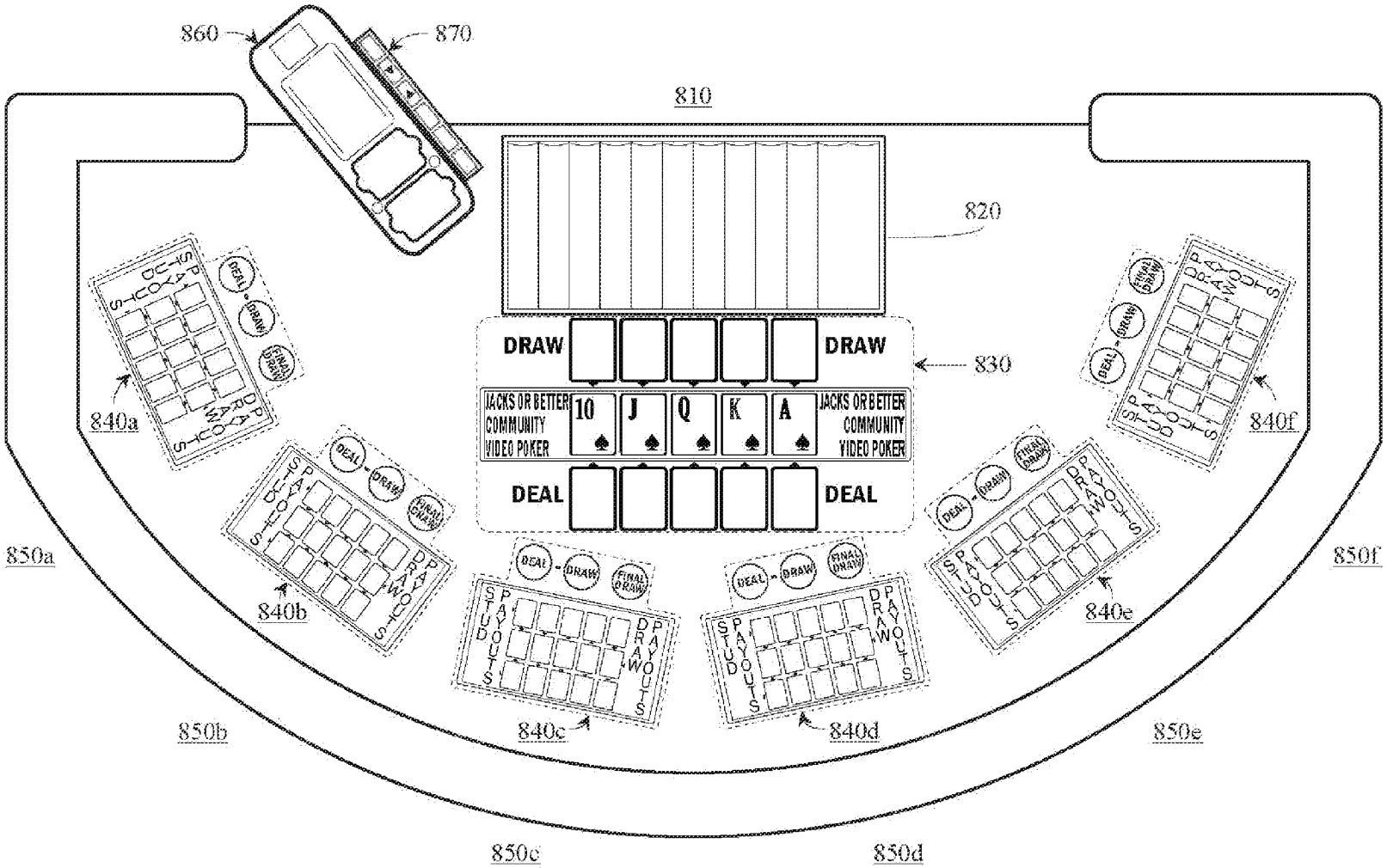
FIG. 8 shows a partially electronic table, auto shuffler/card reader, dealer control panel, common LCD display, player stations and positions suitable for implementing Version 1B.
Figure 9:
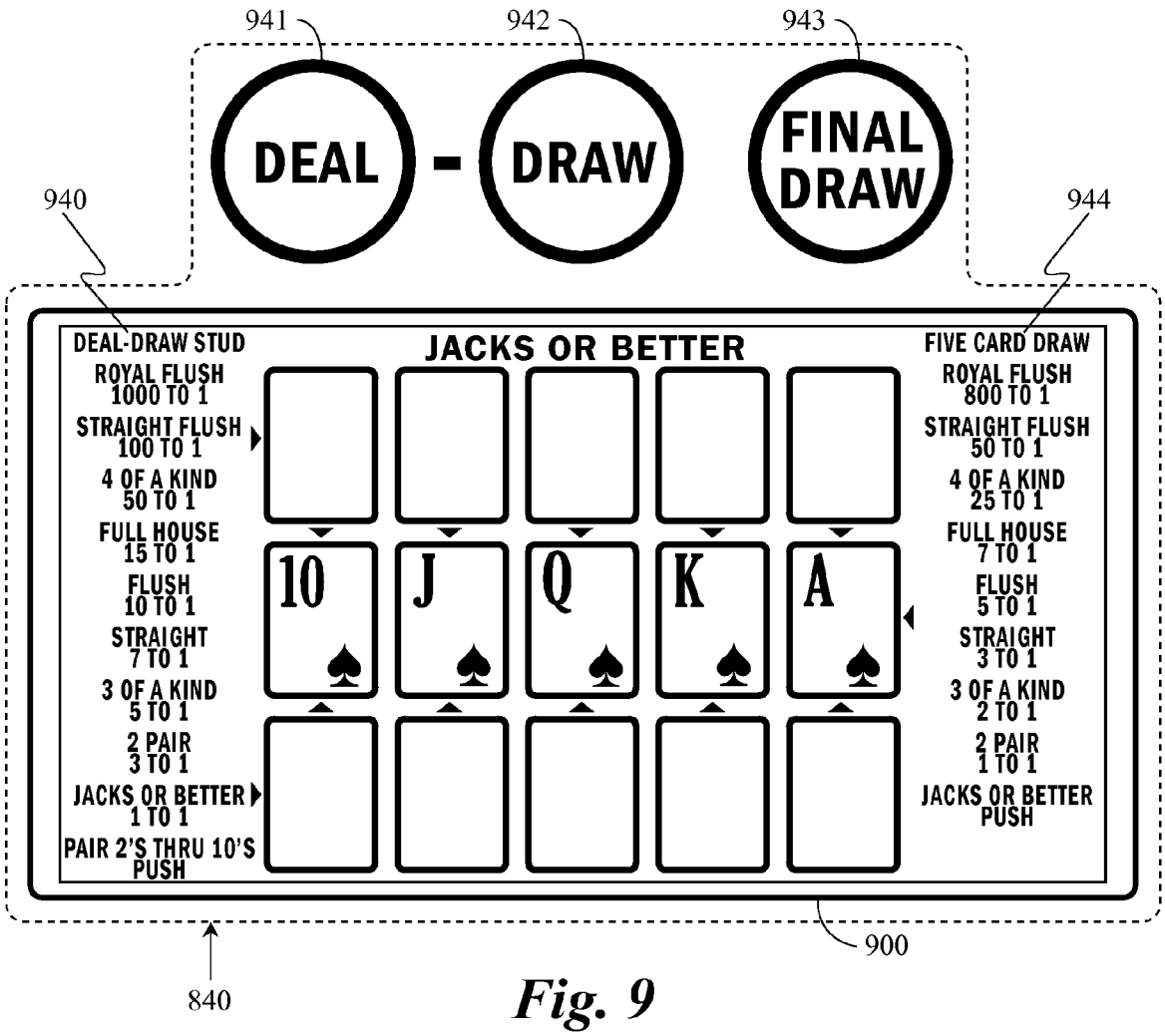
FIG. 9 shows a player station suitable for managing wagers and indicating hold selections in accordance with Version 1B.
Figure 10:
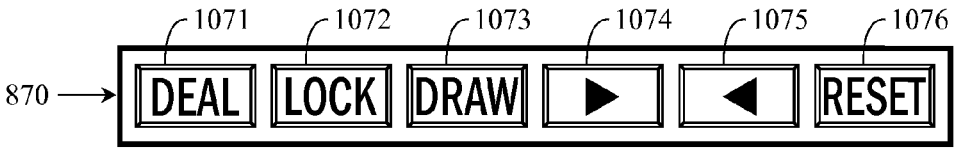
FIG. 10 shows a dealer control panel for signaling a server to display information on player stations and a common display with LCD for use in Version 1B.

Alternate Embodiment—FIGS. 8, 9, 10

Version 1B—Hybrid Table, 2 Community Hands, Touch Screen

Version 1B is similar to the preferred embodiment (Version 1A). The two chances stud game has been removed and replaced with a separate deal-draw stud game, where stud wagers are separate and the pay table is modified accordingly. This deal-draw stud game is interchangeable with both version 1A and 1B as is the two chances stud game. Additionally electronics have been added which will eliminate selection cards, facilitate faster play and improve game security for the casino.

Turning now to FIG. 8 a modified semicircular gaming table is shown. Above the table an area for a dealer 810 and his or her chip tray 820 is shown. To the left of the dealer position 810 a dealer control panel 870 and a card shuffler 860 with integrated card identification technology are present. Near the tables center a common display area 830 is shown with an integrated video screen displaying a royal flush of spades. Surrounding the common display area 830 are six player stations 840*a*-840*f* with integrated electronic video touch screens, corresponding player positions 850*a*-850*f* are also indicated. All electronics devices 860, 870, 830's (video display) and 840's (touch screen displays) are linked through conventional means to a central server (not shown) under the surface of the table.

FIG. 9 shows an enlarged view of the player station 840 with integrated electronic video touch screen 900 and positions for a deal stud wager 941, a draw stud wager 942 and a final draw wager 943. Shown at the center of the video display 900 is the SDM card grid that mimics the one shown in FIG. 8 830. The SDM grid is surrounded by a deal-draw stud pay table 940 and a five card draw pay table 944. Note that in this embodiment and other where electronic video displays are used it is possible for the casino to change the pay tables and or the variation of game being offered. For example one day you could offer Jacks or Better and the next day Deuces Wild; it's even possible to offer multiple variations on the same table at the same time with the same cards as long as the video poker variations utilize a 52 card deck.

FIG. 10 shows an enlargement of the dealer control panel 870. On the control panel are six buttons 1071-1076. The deal button 1071 signals the server that the initial stud hand of a round has been dealt on to the table. The lock button 1072 signals the server that the dealer has locked the selections of the players. The draw button 1073 signals the server that the draw stud hand of a round has been dealt on to the table. The toggle buttons both forward 1074 and reverse 1075 send signals to the server to display players final results on to the common display area 830 (FIG. 8). The reset button 1076 sends a signal to the server that a new round of play is about to commence.

Figure 11:
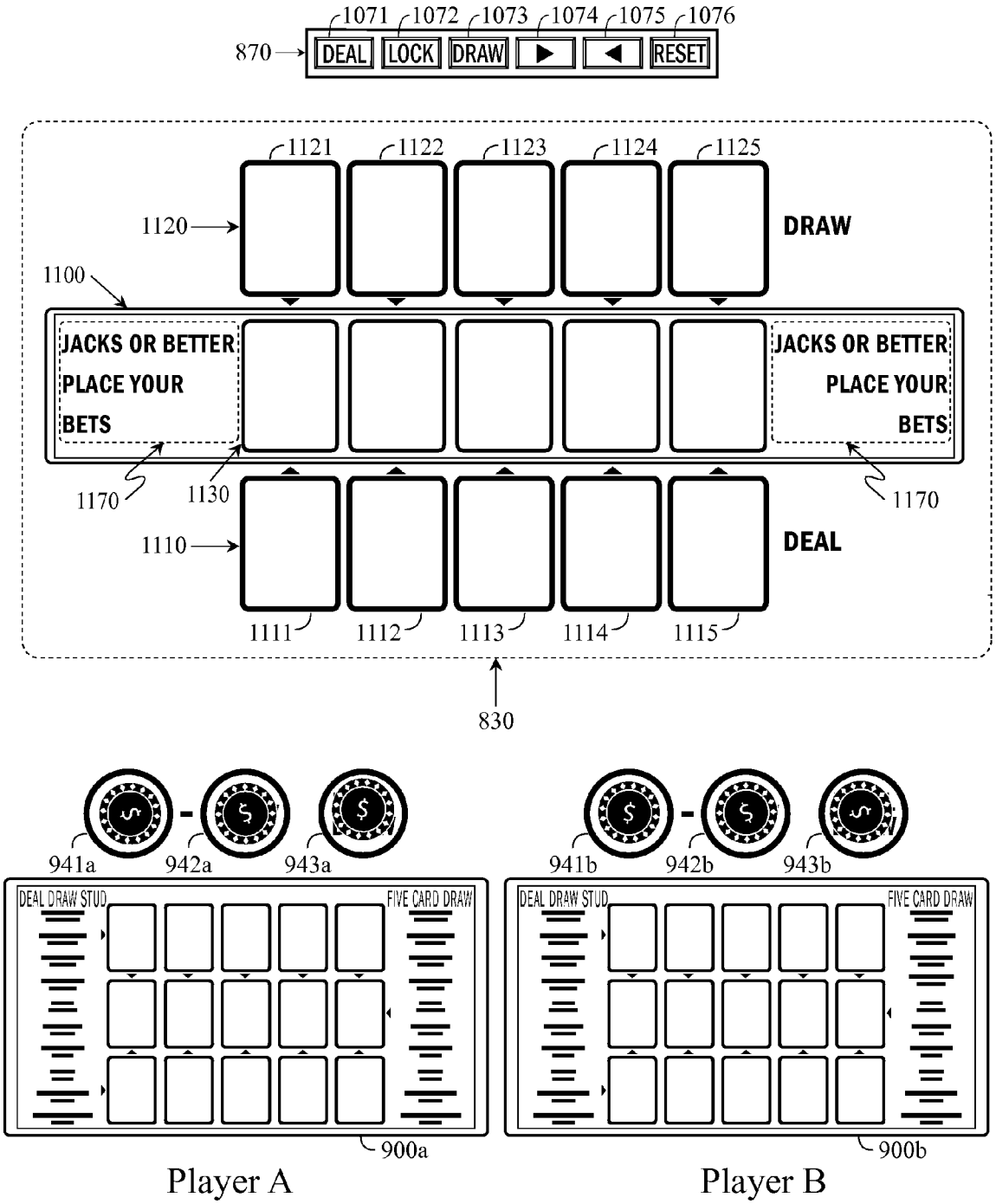
FIG. 11 shows a common display with LCD and player stations for Version 1B as they appear after wagers are made.

FIG. 11 shows an enlarged view of the common display area 830. At its center is a video display 1100 that is showing players the variation of video poker being offered 1170 and row to display players final draw hands 1130. Below the video display 1100 is row 1110 with five card positions 1111-1115 to place the initial deal stud hand. Above the video display 1100 is a row 1120 with five card positions 1121-1125 to place the draw stud hand.

Operation

Alternate Embodiment—FIGS. 8, 9, 10, 11, 12, 13, 14, 15

Continuing on FIG. 11 we see that Player A has placed a single chip in each of the wager spots 941*a*, 942*a*, 943*a* indicating a desire to play all portions of the game. Likewise Player B has indicated the same 941*b*, 942*b*, 943*b*. The dealer (not shown) has pressed the reset button 1076 signaling the server to clear all video displays 1100, 900*a*, 900*b* and prepare for a new round. The player then operates the shuffler (not shown) to dispense five cards from a freshly shuffled deck. The shuffler has a built in card recognition feature which allows it to read the five cards dealt and send that information to the server.

Figure 12:
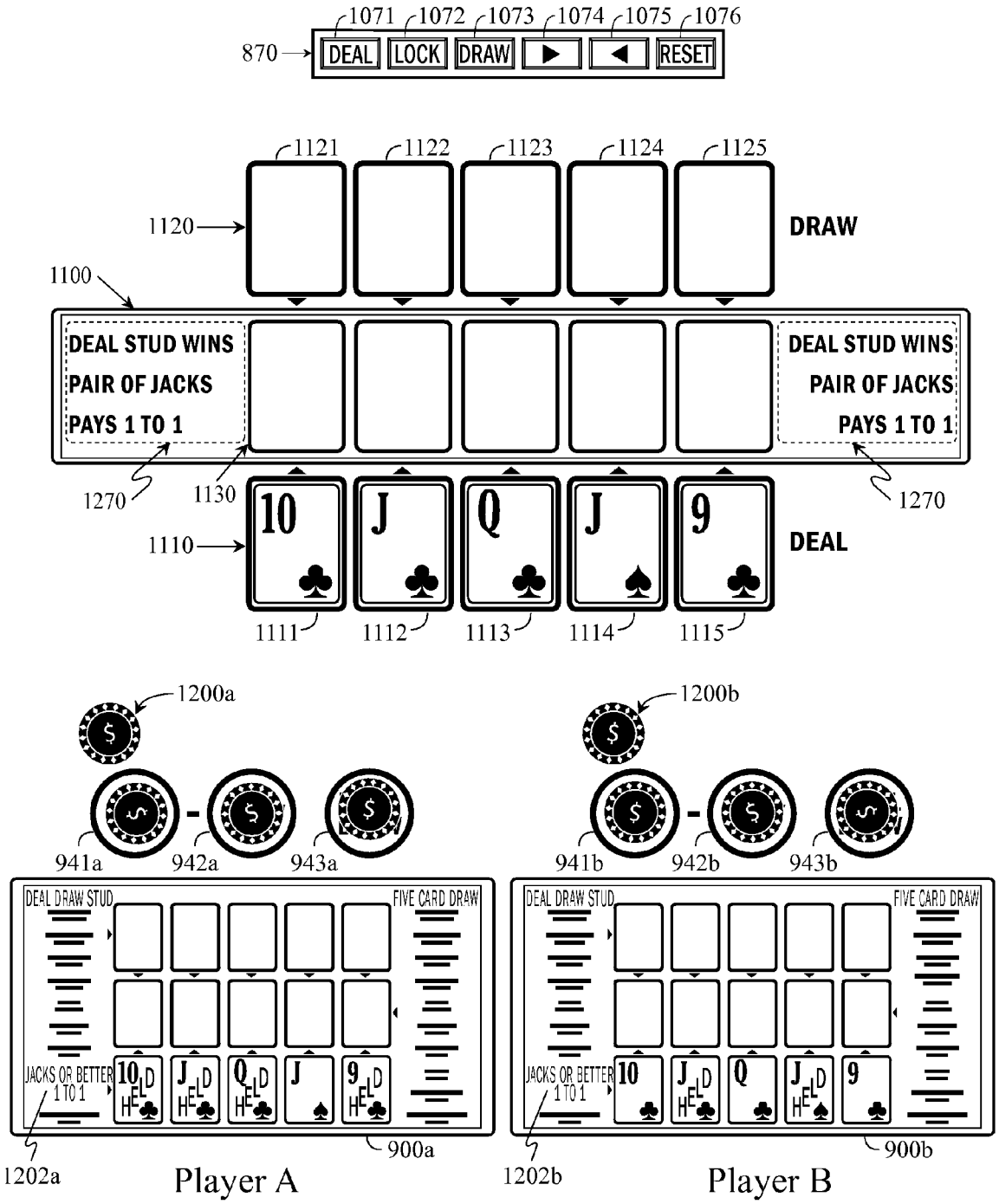
FIG. 12 shows a common display and player stations for Version 1B as they appear after the deal, deal stud wager settlement and holding selections are made.

FIG. 12 shows that the dealer has dealt the initial community deal stud hand 1110 containing a ten of clubs 1111, jack of clubs 1112, queen of clubs 1113, jack of spades 1114 and nine of clubs 1115. After the initial deal a corresponding deal button 1071 was pressed by the dealer. This action signaled the server to create representations of the deal stud hand 1110 onto the video displays 900*a*, 900*b* (FIG. 12). Also shown on the video display 1100 are ranks and awards 1270 if any. Using the touch screen video displays 900*a*, 900*b* both players have indicated which cards they wish to hold by touching the selected card representations. Player A held the ten of clubs, jack of clubs, queen of clubs and the nine of clubs and a jack of diamonds the selections are indicated by the word "held" being displayed over the card representations 900*a*. Player B held the jack of clubs and the jack of spades as indicated 900*b*. FIG. 12 also shows that the dealer has paid each player 1200*a*, 1200*b* for their deal stud wager 941*a*, 941*b* according to the deal-draw payout for a pair of jacks 1202*a*, 1202*b*, 1270.

After stud wagers are settled the dealer confirms that all players are satisfied with their hold selections and uses the dealer control panel 870 to lock 1072 in selections. The lock button 1072 is a security feature that signals the server to no longer allow changes to the players' selections thus preventing players from changing their selections after seeing replacement cards of the community draw stud hand. At this point the table is readied for accepting the draw stud hand from the shuffler. The dealer operates the shuffler to dispense five more cards and send the identification of those cards to the server. Optionally a deal button (not shown) could be added to the display 900*a*, 900*b* to allow each player to lock in their selections.

Figure 13:
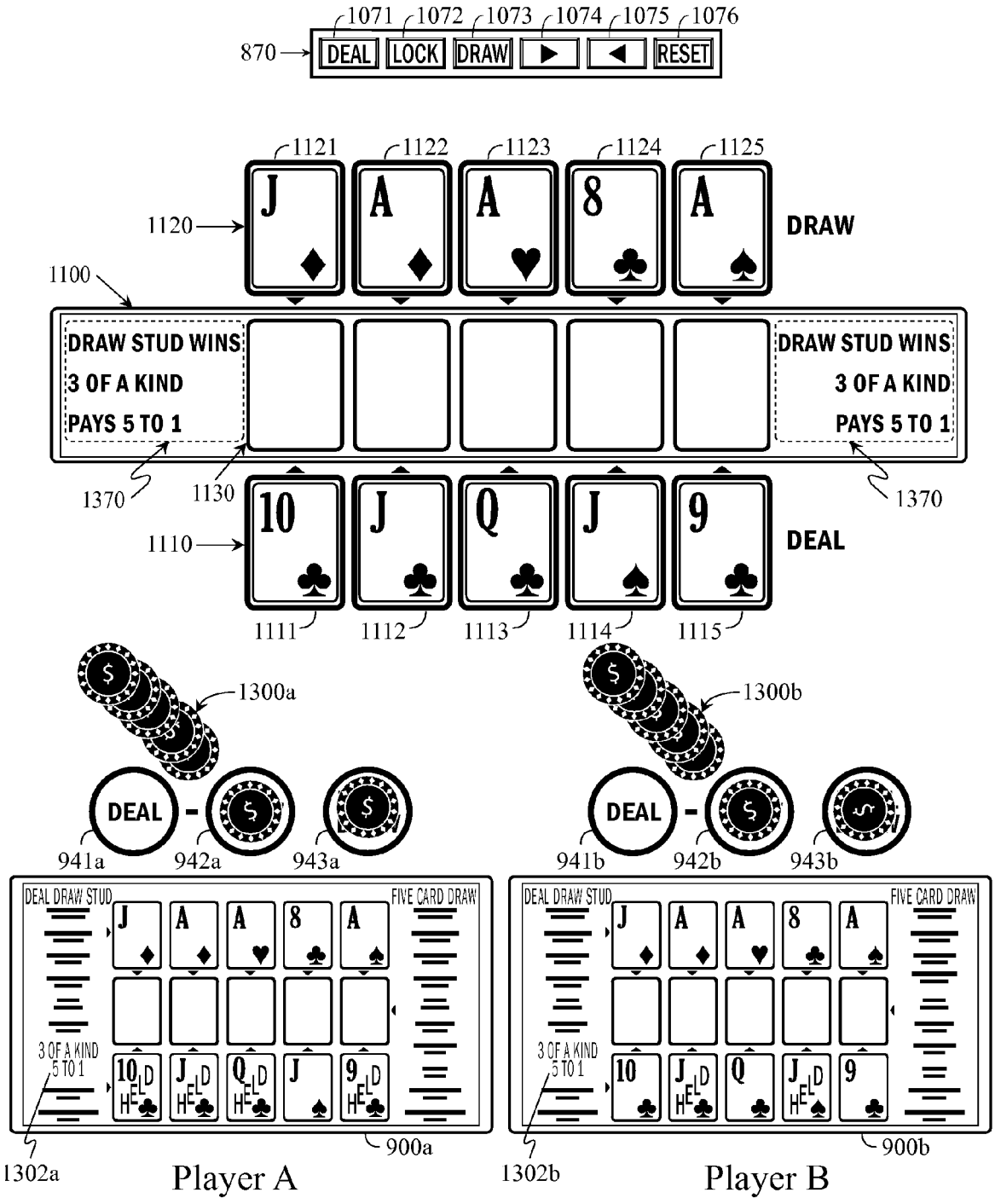
FIG. 13 shows a common display, player stations for Version 1B as they appear after draw stud wagers are settled.

FIG. 13 shows conditions after the dealer has dealt the community draw stud hand 1120 containing a jack of diamonds 1121, ace of diamonds 1122, ace of hearts 1123, eight of clubs 1124 and an ace of spades 1125. The dealer then pressed the draw button 1073 to signal the server to use the hand information sent from the shuffler to create representations of the actual cards onto the displays 900*a*, 900*b* of the player stations and to show rank and awards if any on the display 1100, 1370. FIG. 13 also shows that the dealer has paid each player 1300*a*, 1300*b* for their draw stud wager 942*a*, 942*b* according to the deal-draw payout for a three of a kind 1302*a*, 1302*b*.

Figure 14:
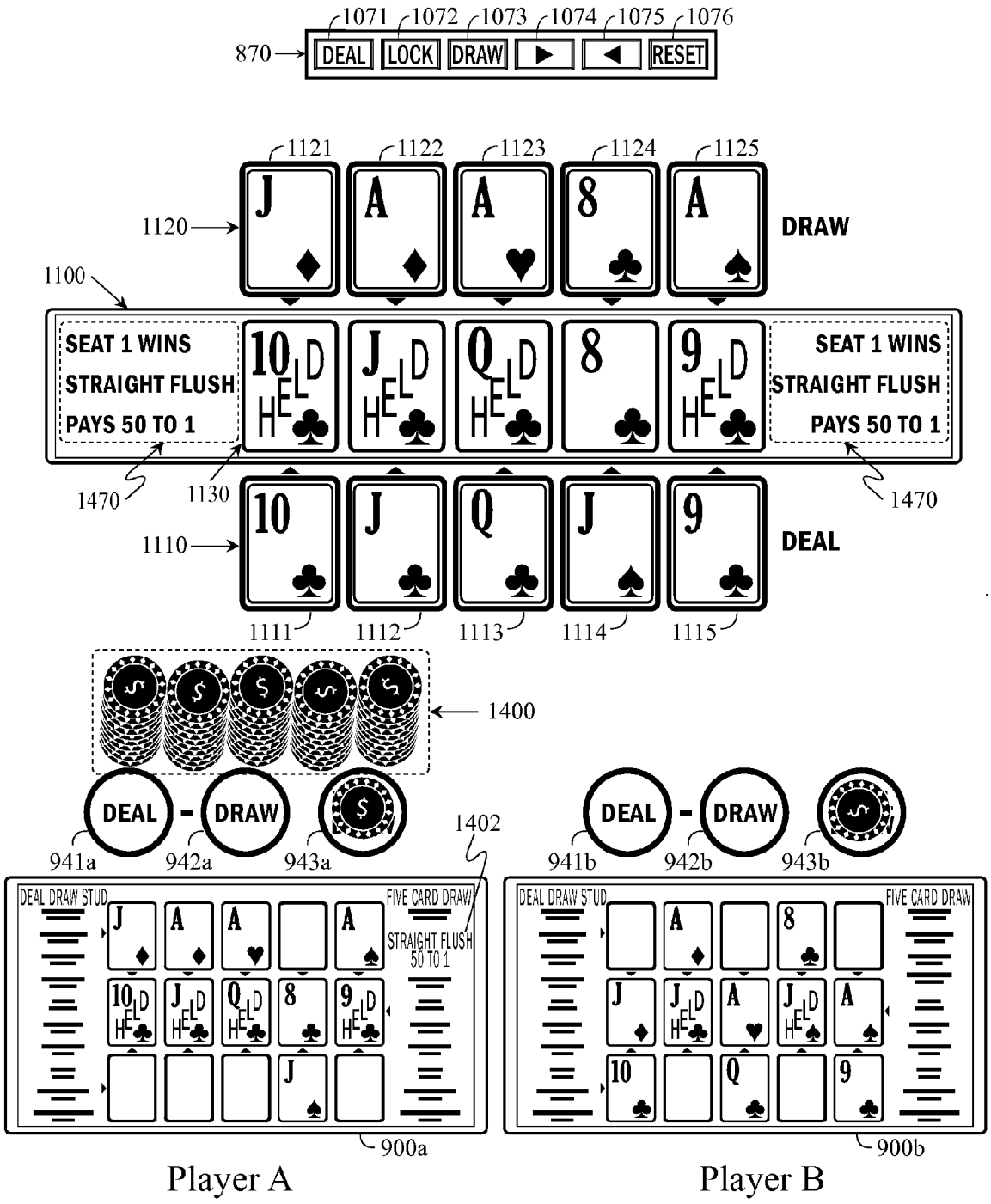
FIG. 14 shows a common display, player stations and selection cards for Version 1B as they appear after Player A's final draw hand is settled.

FIG. 14 shows conditions after the dealer has pressed the forward toggle button 1074 one time to signal the server to display 1100 Player A's final draw hand 1130 and its rank 1470. The toggle button 1074 signal also has instructed the server to display each individual player's final draw hand in their respective displays 900*a*, 900*b*. Player A is paid 1400 for successfully drawing a straight flush according to a five card draw straight flush payout 1402.

Figure 15:
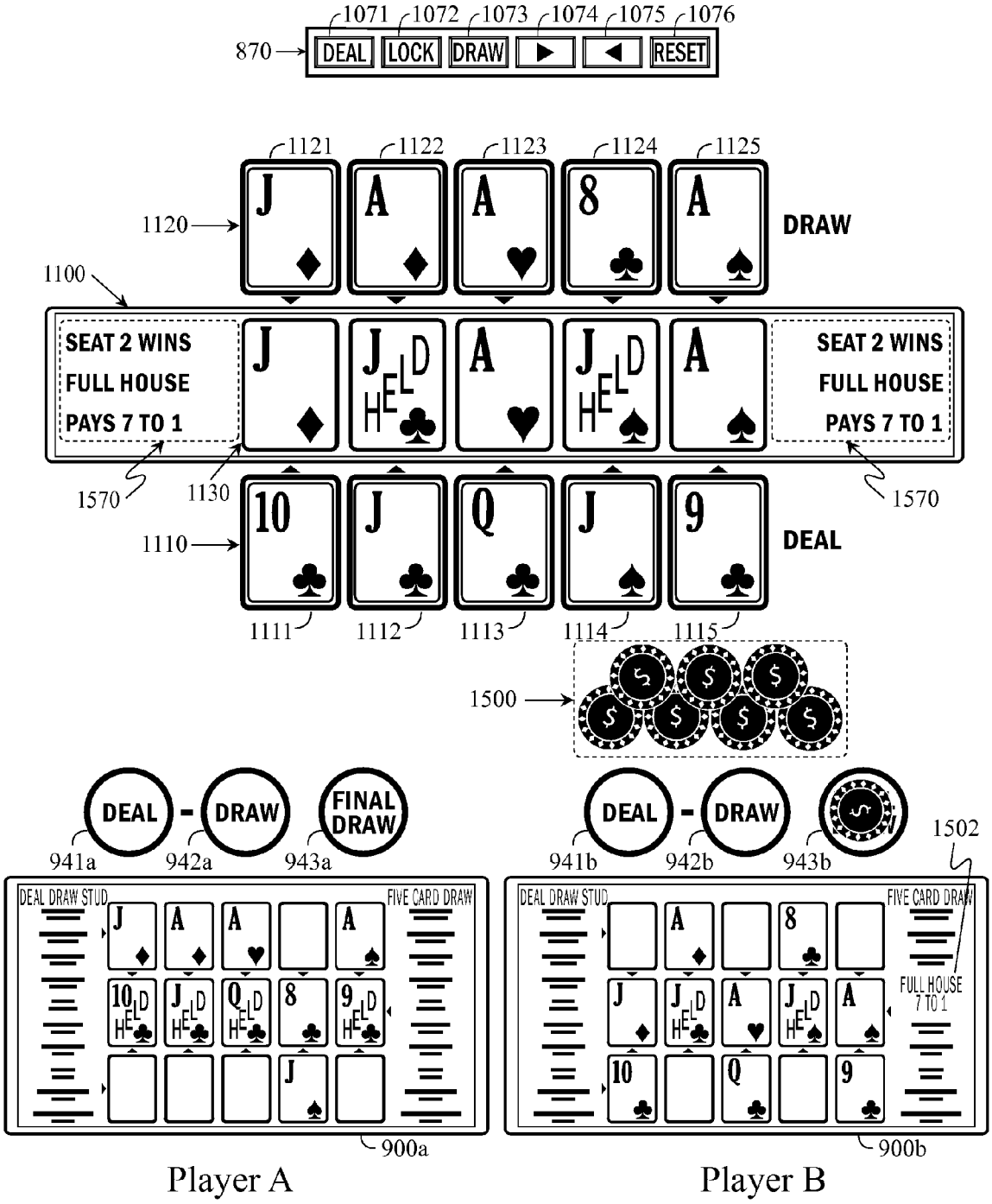
FIG. 15 shows a common display, player stations and selection cards for Version 1B as they appear after Player B's final draw hand is settled.

FIG. 15 shows the table layout after the dealer has pressed the forward toggle button 1074 a second time that signal the server to display Player B's final draw hand 1130 and its rank 1570 of Player B in the common video display 1100. Player B is paid 1500 for successfully drawing a full house according to a five card draw full house payout 1502.

The dealer or pit managers can use the forward and reverse toggle buttons 1074 & 1075 to go back to a previously paid player for additional hand and payout verification or correction. Once all final draw wagers 943*a*, 943*b* are settled the dealer presses the reset button 1076 to clear all displays so that preparation of the table for the next round of play can begin.

Those skilled in the art will see that Version 1B's player stations 840*a*-840*f* (FIG. 8) have an advantage of more closely resembling the interface a video poker player would be familiar with. It is also apparent that the Sandwich Draw Method (SDM) disclosed in Version 1A is still being used; however with the aid of electronics it is not necessary to label the card column positions. A modification to Version 1B could be to include management of wagers in an electronically whereby chips are eliminated and players can deposit cash or credit vouchers into the player stations. This slot wager management system could utilize the familiar "for 1" type pay tables.

An additional modification not shown would be to integrate control of the shuffler 860 with that of the dealer control panel 870. This would simplify steps for the dealer procedure.

Description

Figure 16:
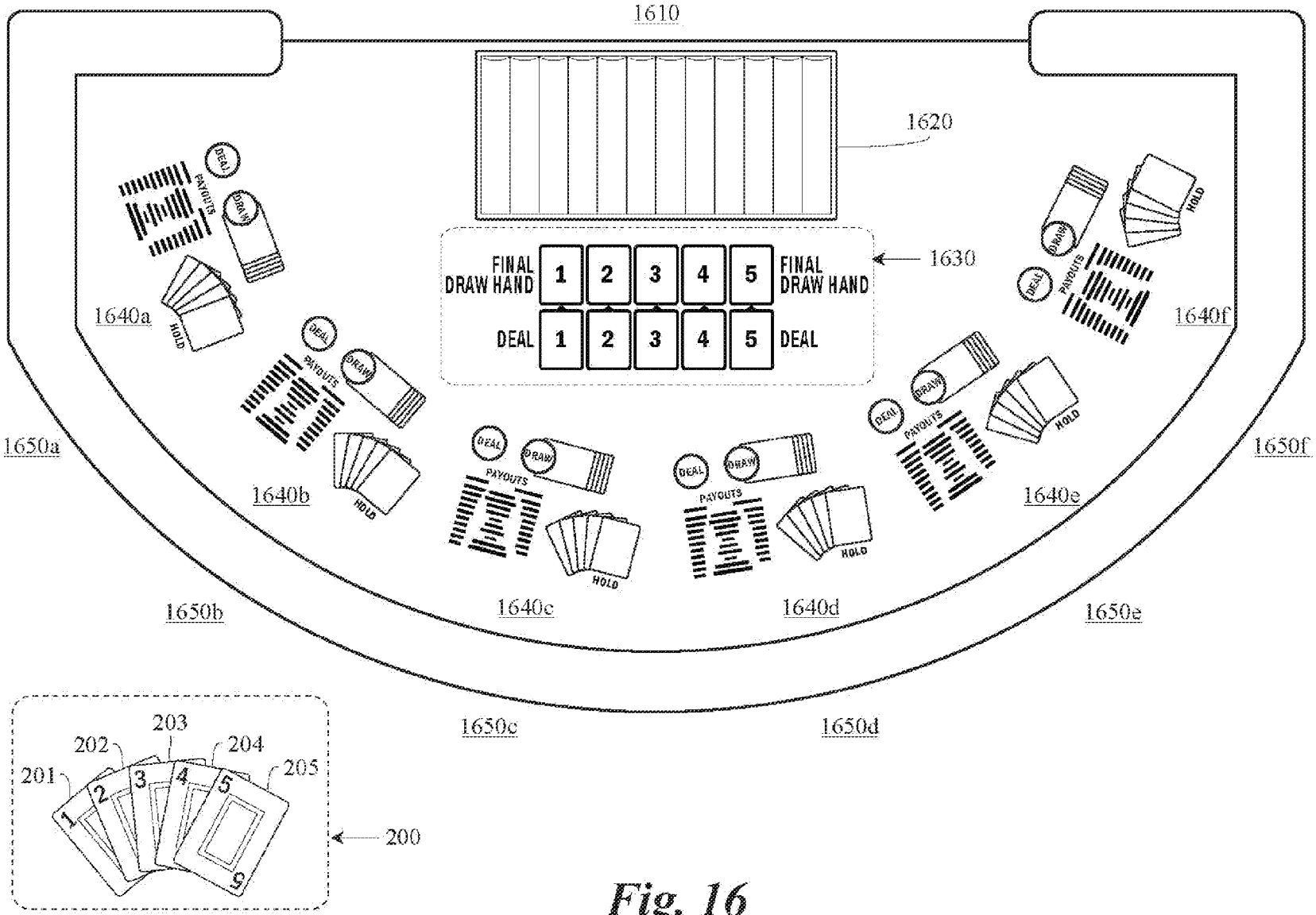
FIG. 16 shows a non-electronic table, player stations/positions and selection cards suitable for implementing Version 2A.
Figure 17:
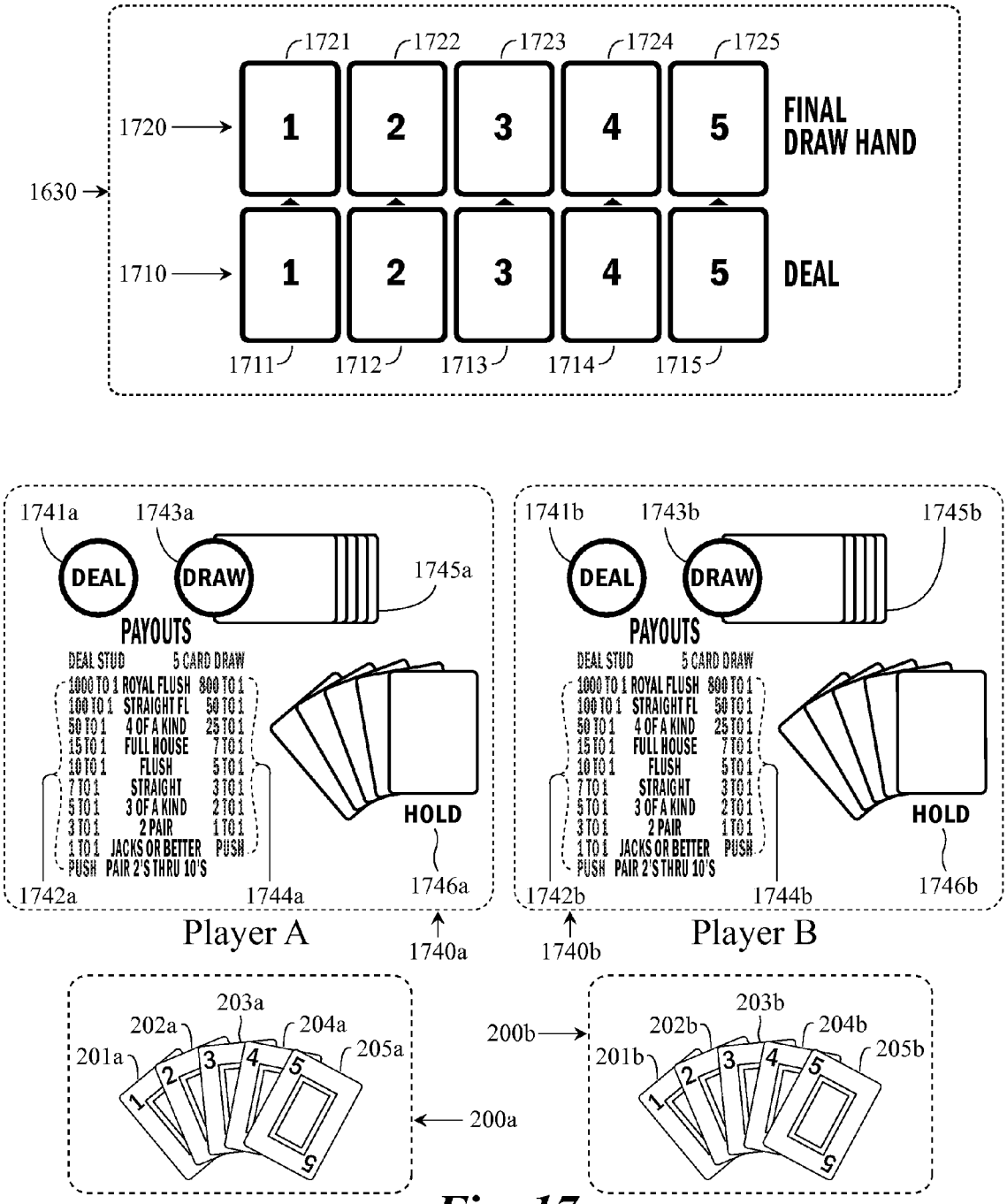
FIG. 17 shows a common display, player stations and selection cards for Version 2A as they appear before any wagers are made.

Alternate Embodiment—FIGS. 16, 17

Version 2A—Live Table, 1 Community Hand, Selection Cards

Version 2A removes a second community hand for use as the players' replacement cards. Instead players will receive replacement cards from the deck. As in Version 1A selection cards will be used by players to indicate their hold selections. This embodiment discloses how everyone can share an initial deal hand while not sharing replacement cards.

FIG. 16 shows a semicircular gaming table and a set of selection cards 200-205. Above the table an area for a dealer 1610 and his or her chip tray 1620 is shown. Near the tables center a common display area 1630 is shown. Surrounding the common display area 1630 are six player stations 1640*a*-1640*f*, corresponding player positions 1650*a*-1650*f* are also indicated.

FIG. 17 shows an enlargement of the common display area 1630 with two rows 1710 & 1720. Each row 1710 & 1720 contains five rectangular shaped card positions 1711-1725. Each card position has a number 1 thru 5 printed within the each rectangular shape representing one of five numbered columns. Also shown in FIG. 17 are two player stations 1740*a* & 1740*b*. Each contains an area to place stud wagers 1741*a* & 1741*b* and corresponding stud pay tables 1742*a* & 1742*b*. Each also contains an area to place draw wagers 1743*a* & 1743*b* and corresponding draw pay tables 1744*a* & 1744*b*. With respect to each player's station 1740*a* & 1740*b* is provided a discard area 1745*a* & 1745*b* for selection cards 200*a* & 200*b* to be placed face down and a hold area 1746*a* & 1746*b* for selection cards 200*a* & 200*b* to be placed face up. Player A will use selection cards 201*a*-205*a* as an additional component of the player station 1740*a*. Player B will use selection cards 201*b*-205*b* as an additional component of the player station 1740*b*.

Operation

Alternate Embodiment—FIGS. 16, 17, 18, 19, 20

Figure 18:
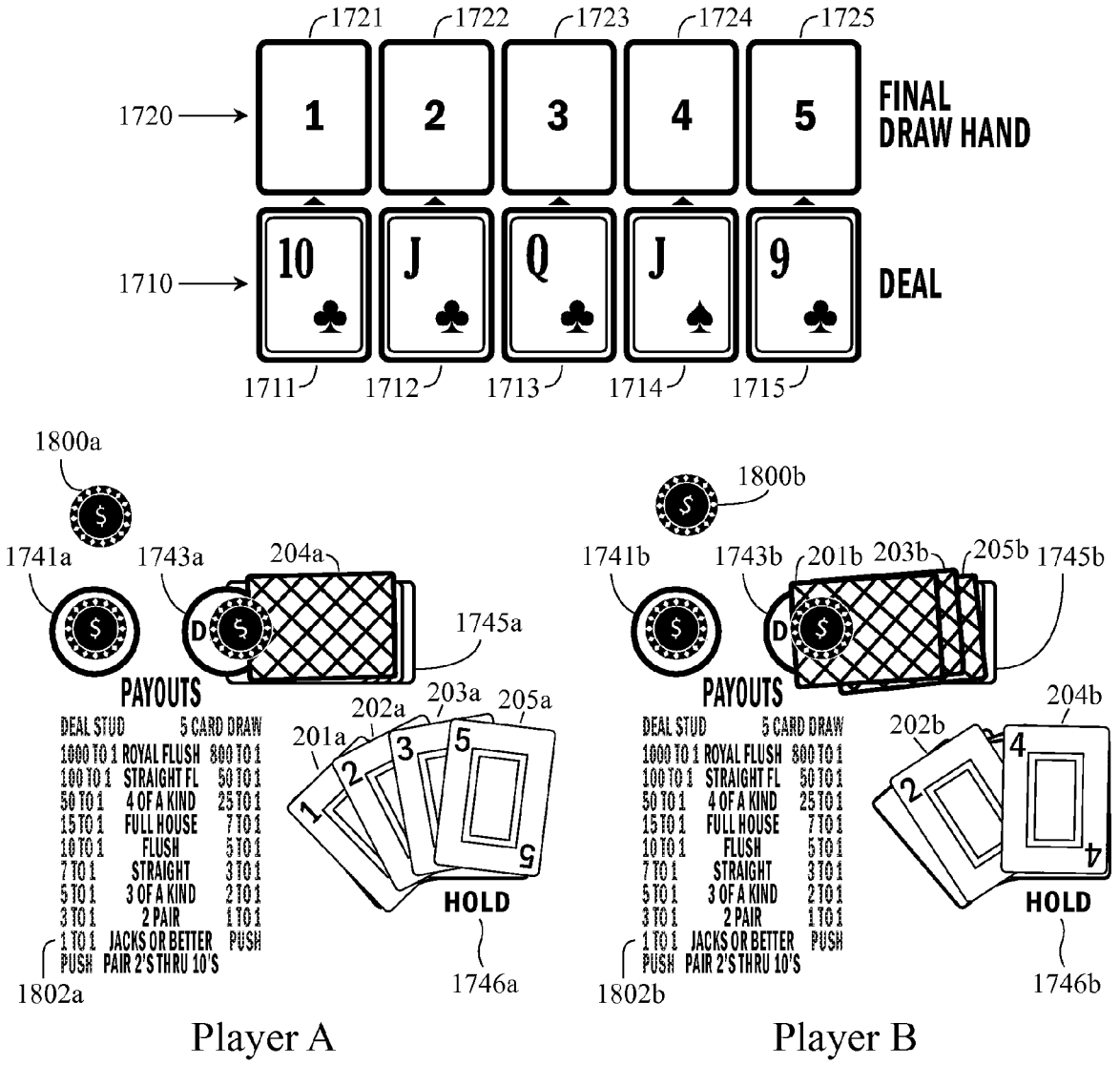
FIG. 18 shows a common display, player stations and selection cards for Version 2A as they appear after all wagers, the deal, deal stud settlements and holding selections are made.

With reference now to FIG. 18 we see that Player A and Player B have placed deal stud wagers 1741*a* & 1741*b* and draw wagers 1743*a* & 1743*b*. In this embodiment of the present invention, the players are able to make two types of wagers—one for a draw game and one for a deal stud game. The dealer has dealt an initial community deal stud hand containing the ten of clubs 1711, jack of clubs 1712, queen of clubs 1713, jack of spades 1714 and the nine of clubs 1715. Deal stud wagers 1741*a*, 1741*b* have been paid 1800*a*, 1800*b* according to the deal stud payout for a pair of jacks 1802*a* & 1802*b*.

Player A has placed selection cards numbered 1 201*a*, 2 202*a*, 3 203*a* and 5 205*a* in the hold area 1746*a* and one card, numbered 4 204*a*, face down in the discard area 1745*a* indicating to the dealer that they want to hold the card in column 1 1711, the card in column 2 1712, the card in column 3 1713 and the card in column 5 1715. As in Version 1A the selection cards 201*a*-205*a* contain numbers 1 thru 5 that correspond to the column numbers 1 thru 5 respectively.

Continuing of FIG. 18 Player B has placed selection cards 2 202*b* and 4 204*b* in the hold area 1746*b* and card 1 201*b*, 3 203*b* and 5 205*b* face down in the discard area 1745*b* indicating to the dealer that they want to hold the card in column 2 1712 and column 4 1714. At this point the dealer locks each player's decision by placing any face down discard selections under the draw bet 1743*a* & 1743*b* respectively.

Figure 19:
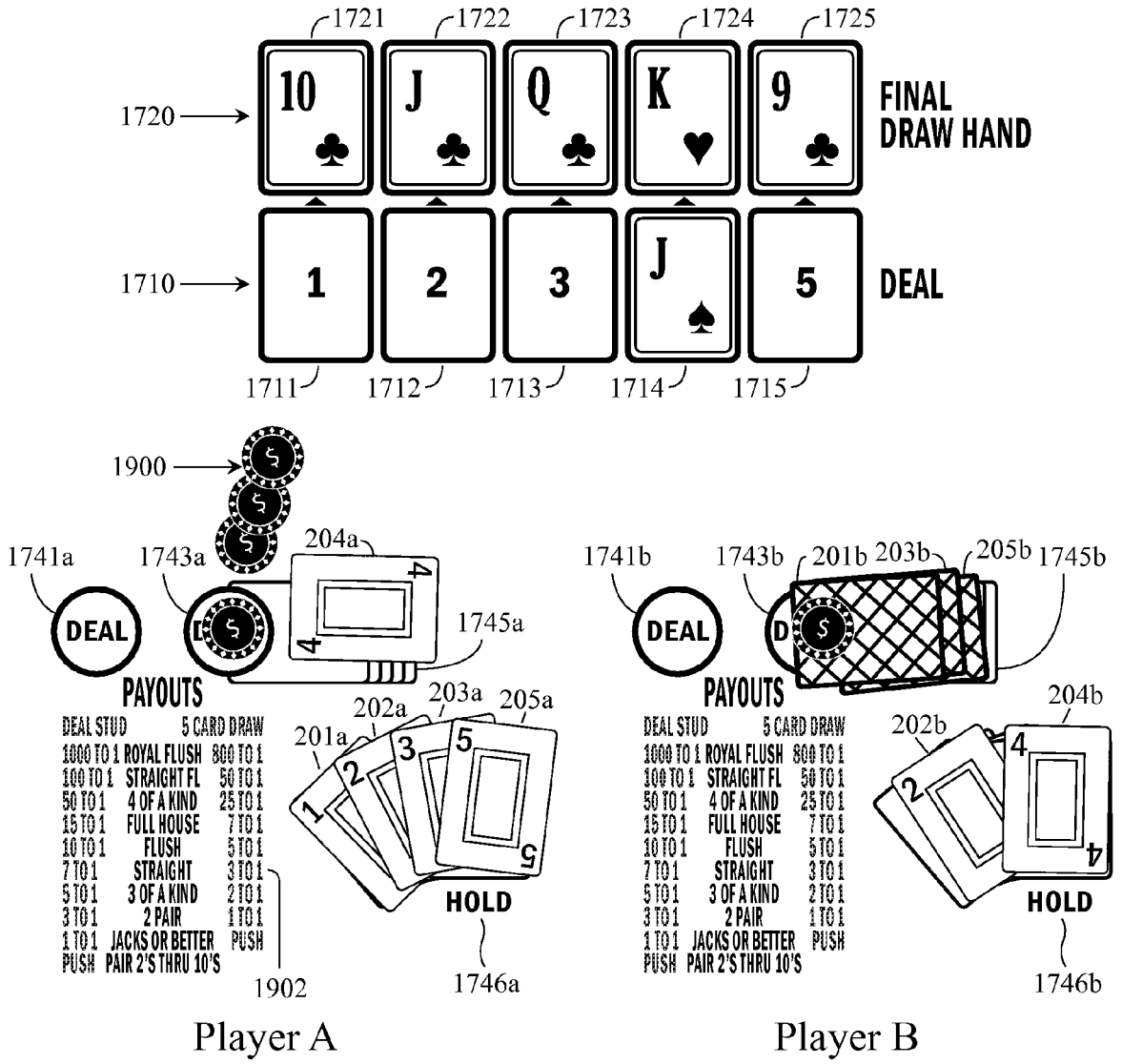
FIG. 19 shows a common display, player stations and selection cards for Version 2A as they appear after Player A's final draw hand is settled.

FIG. 19 shows the layout after the dealer has moved Player A's hold selections 1721, 1722, 1723, 1725 to the final draw hand row 1720 and dealt a replacement card from the deck into the only available position 1724 of the final draw hand row 1720. The replacement card was a king of hearts 1724. The resulting hand ranking was a straight (nine thru kings 1721-1725). Player A was paid 1900 according to the draw payout 1902 for a straight. The dealer then discarded the king of hearts 1724 into a discard area (not shown).

Figure 20:
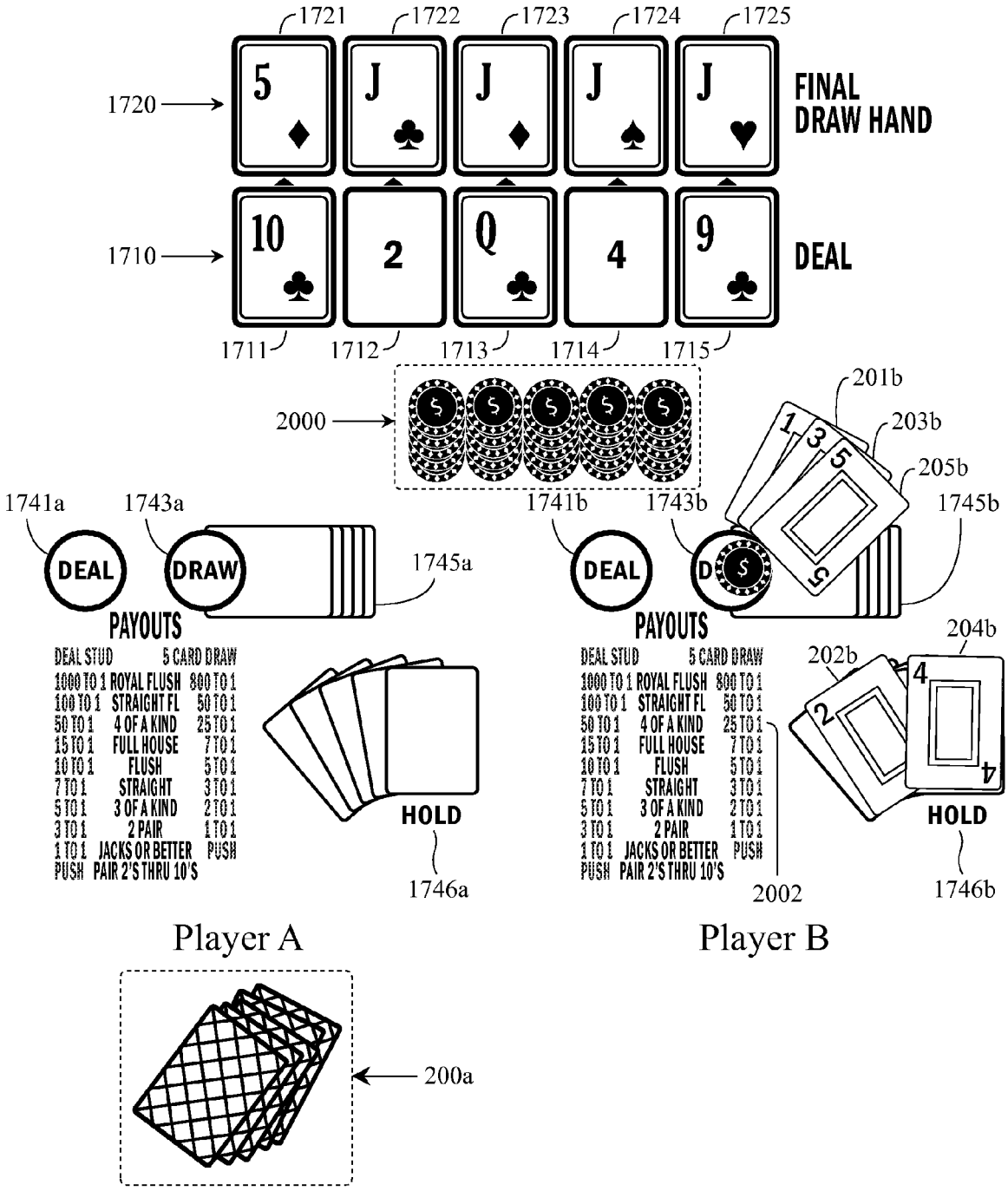
FIG. 20 shows a common display, player stations and selection cards for Version 2A as they appear after Player B's final draw hand is settled.

FIG. 20 shows the layout after the dealer has moved Player B's hold cards the jack of clubs 1722 and the jack of spades 1724 to the final draw hand row 1720. Three replacement cards from the deck are dealt into the final draw hand row's 1720 vacant positions. The replacement cards were a five of diamonds 1721, a jack of diamonds 1723 and a jack of hearts 1725. The resulting hand ranking was four of a kind (jacks). Player B was paid 2000 according to a draw payout 2002 for a four of a kind.

With additional players the dealer would discard the five of diamonds 1721, a jack of diamonds 1723 and a jack of hearts 1725 into a discard area and set community cards for the next player. The dealer continues to deal replacement cards from the deck until all players' hands are settled.

In Version 2A, unless all cards are held by more than one player, no two final draw hands could contain the exact same cards. Those skilled in the art will understand that this offers the advantage of lower volatility for the casino's bankroll while preserving video poker pay table odds, strategies and some community aspects. In previous versions where two community stud hands are used a drawn royal flush requires the casino to pay every player drawing alike a large royal flush payout in a single round. Any casino fearful of a large multi-royal payout might offer this embodiment or other single community hand versions disclosed herein.

Description

Figure 21:
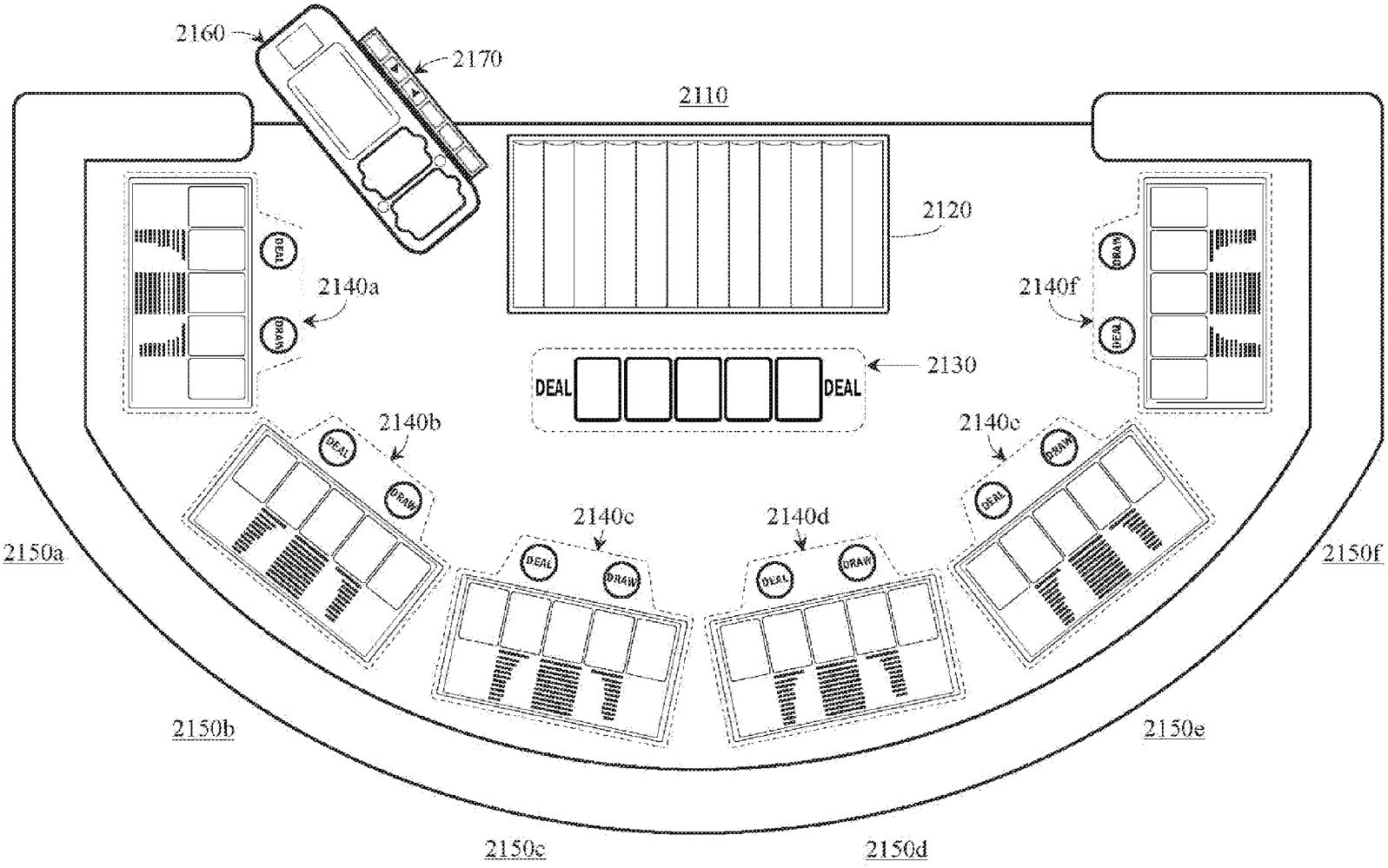
FIG. 21 shows a partially electronic table, auto shuffler/card reader, dealer control panel, player stations and positions suitable for implementing Version 2B.
Figure 22:
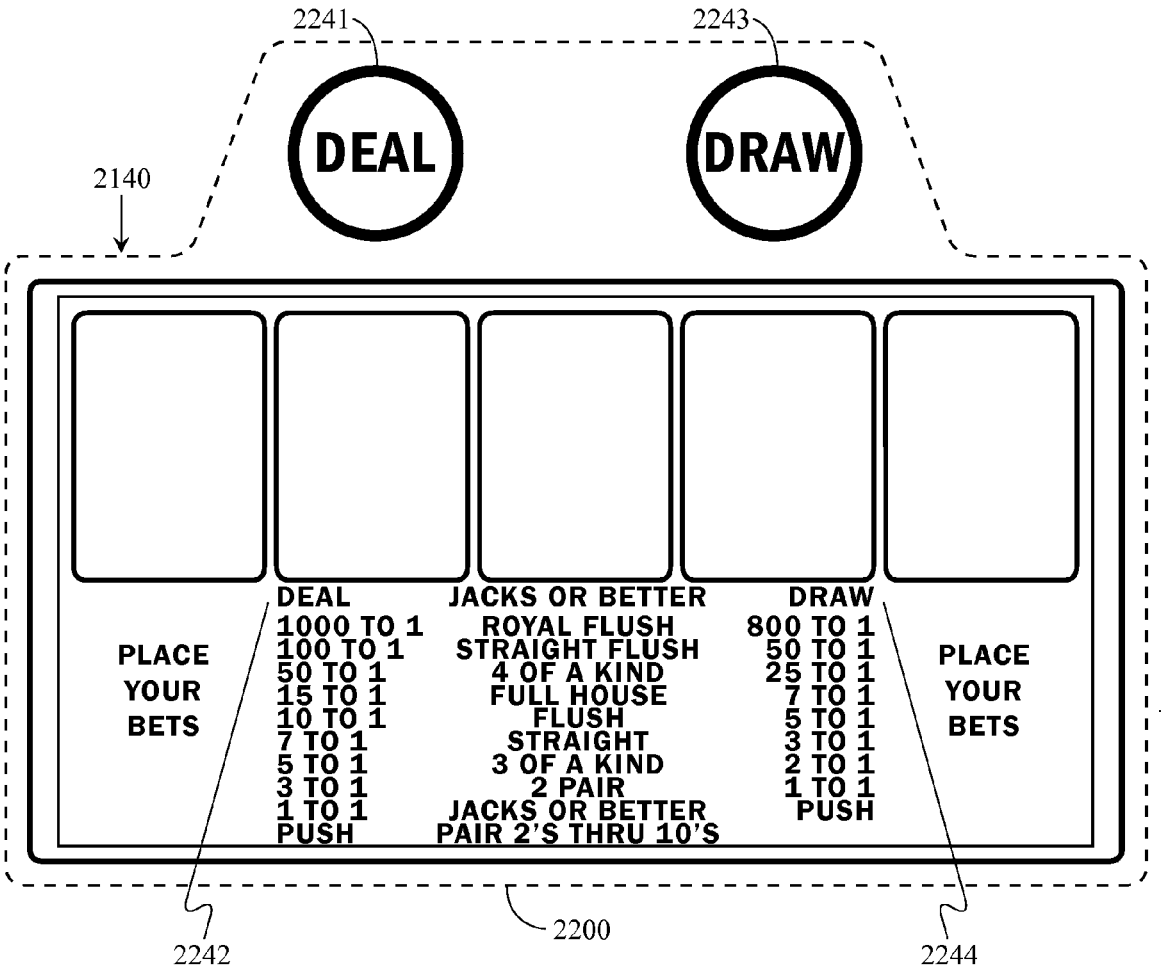
FIG. 22 shows a player station suitable for managing wagers and indicating hold selections in accordance with Version 2B.
Figure 23:
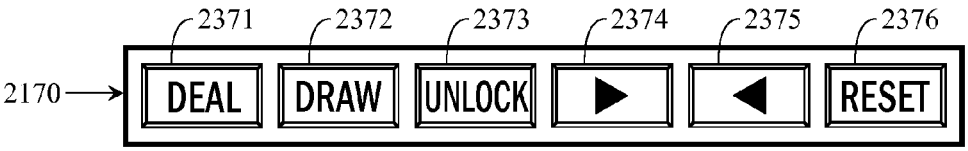
FIG. 23 shows a dealer control panel for signaling a server to display information on player stations for use in Version 2B.

Alternate Embodiment—FIGS. 21, 22, 23

Version 2B—Hybrid Table, 1 Community Hand, Touch Screen

Version 2B is an electronic embodiment of Version 2A. As the reader will see this variation offers a true hybrid (part electronic/part real) video poker type experience where players will actually receive playing cards.

Turning now to FIG. 21 a modified semicircular gaming table is shown. Above the table an area for a dealer 2110 and his or her chip tray 2120 is shown. To the left of the dealer position 2110 a dealer control panel 2170 and a card shuffler 2160 with integrated card identification technology are present. Near the tables center a community hand row 2130 is shown with five card positions. Surrounding the community card row 2130 are six player stations 2140*a*-2140*f* with integrated electronic video touch screens; corresponding player positions 2150*a*-2150*f* are also indicated. All electronics devices 2160, 2170 and the touch screen displays of the player stations 2140*a*-2140*b* are linked through conventional means to a central server (not shown) under the surface of the table.

FIG. 22 shows an enlarged view of the player station 2140 with integrated electronic video touch screen 2200 and positions for a deal stud wager 2241 and a final draw wager 2243. Shown at the upper half of the video display 2200 is a row that will mimic the community hand row 2130 (FIG. 21). Also in the display 2200 (FIG. 22) is located a deal stud pay table 2242 and a five card draw pay table 2244.

FIG. 23 shows an enlargement of the dealer control panel 2170. On the control panel are six buttons 2371-2376. The deal button 2371 signals the server that the initial stud hand of a round has been dealt on to the table. The draw button 2372 signals the server that the replacement draw cards have been dealt to all players at the table. The unlock button 2373 signals the server that the dealer has discovered a player selection error that requires a correction. The toggle buttons both forward 2374 and reverse 2375 send signals to the server to verify final results on the video display 2200 (FIG. 22) of a respective player station 2140. The reset button 2376 (FIG. 23) sends a signal to the server that a new round of play is about to commence.

Figure 24:
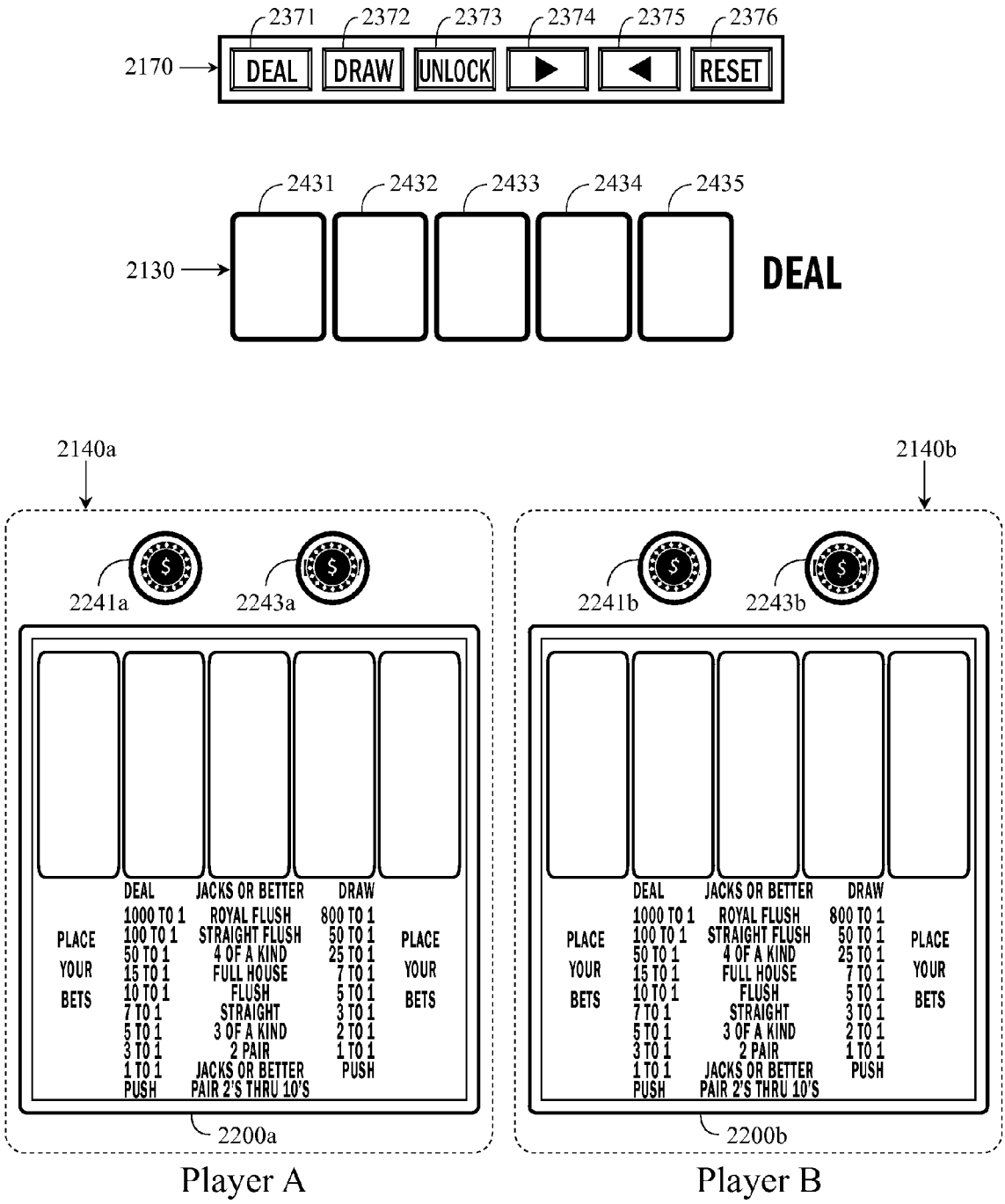
FIG. 24 shows a common display and player stations for Version 2B as they appear after wagers are made.

FIG. 24 shows the dealer control panel 2170, the community hand row 2130 and two player stations 2140*a* & 2140*b*.

Operation

Alternate Embodiment—FIGS. 21, 22, 23, 24, 25, 26, 27

Referring again to FIG. 24 we see conditions as they would appear after the dealer pressed the reset button 2376 to clear the displays of cards from the previous round. Players A and B have placed wagers for both the community deal stud game 2241*a* & 2241*b* and the draw game 2243*a* & 2243*b*.

Figure 25:
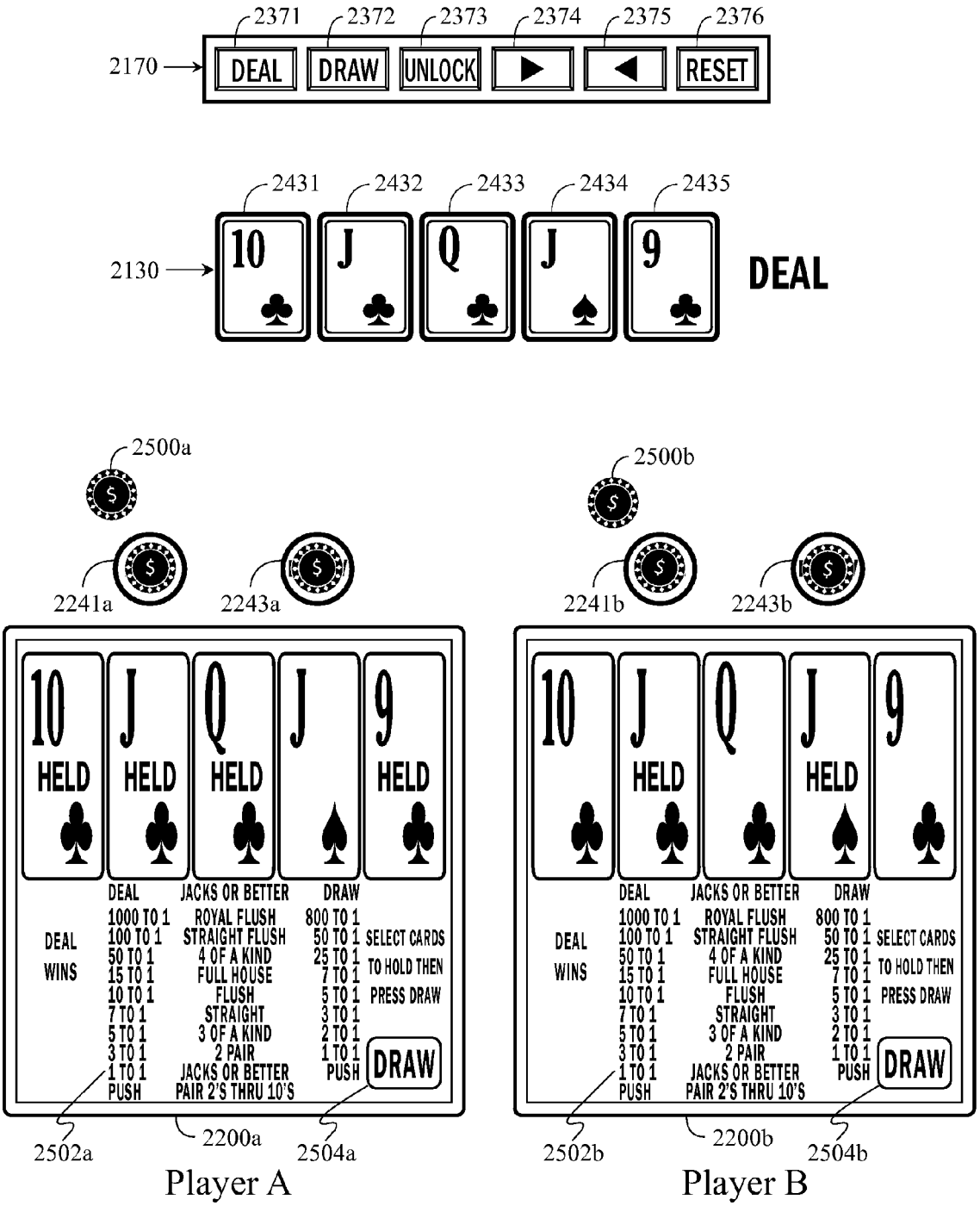
FIG. 25 shows a common display and player stations for Version 2B as they appear after the deal, deal stud wager settlement and holding selections are made.

FIG. 25 shows conditions after the dealer operated the shuffler (not shown) to dispense five cards and send the identification of those cards to the server. The dealer then placed the dispensed cards in proper order onto the layout in the community deal hand row 2130. The dealer pressed the deal button 2371 on the control panel 2170 to signal the server to display representations of the cards dispensed from the shuffler on to the players' video displays 2200*a* & 2200*b*. The initial community deal stud hand 2130 contains a ten of clubs 2431, jack of clubs 2432, queen of clubs 2433, jack of spades 2334 and nine of clubs 2435.

The rank of the initial community deal stud hand is determined by the server and a corresponding payout for a pair of jacks flashes on the players displays 2502*a* & 2502*b*. The dealer has paid each player 2500*a* & 2500*b* for their respective deal stud bets 2241*a* & 2241*b*. As in video poker each player makes hold selections using the touch screens 2200*a* & 2200*b* and pressing the draw button 2504*a* & 2504*b*. When all players have pressed the deal button 2504*a* & 2504*b* the server can signal or unlock operation of the shuffler.

Figure 26:
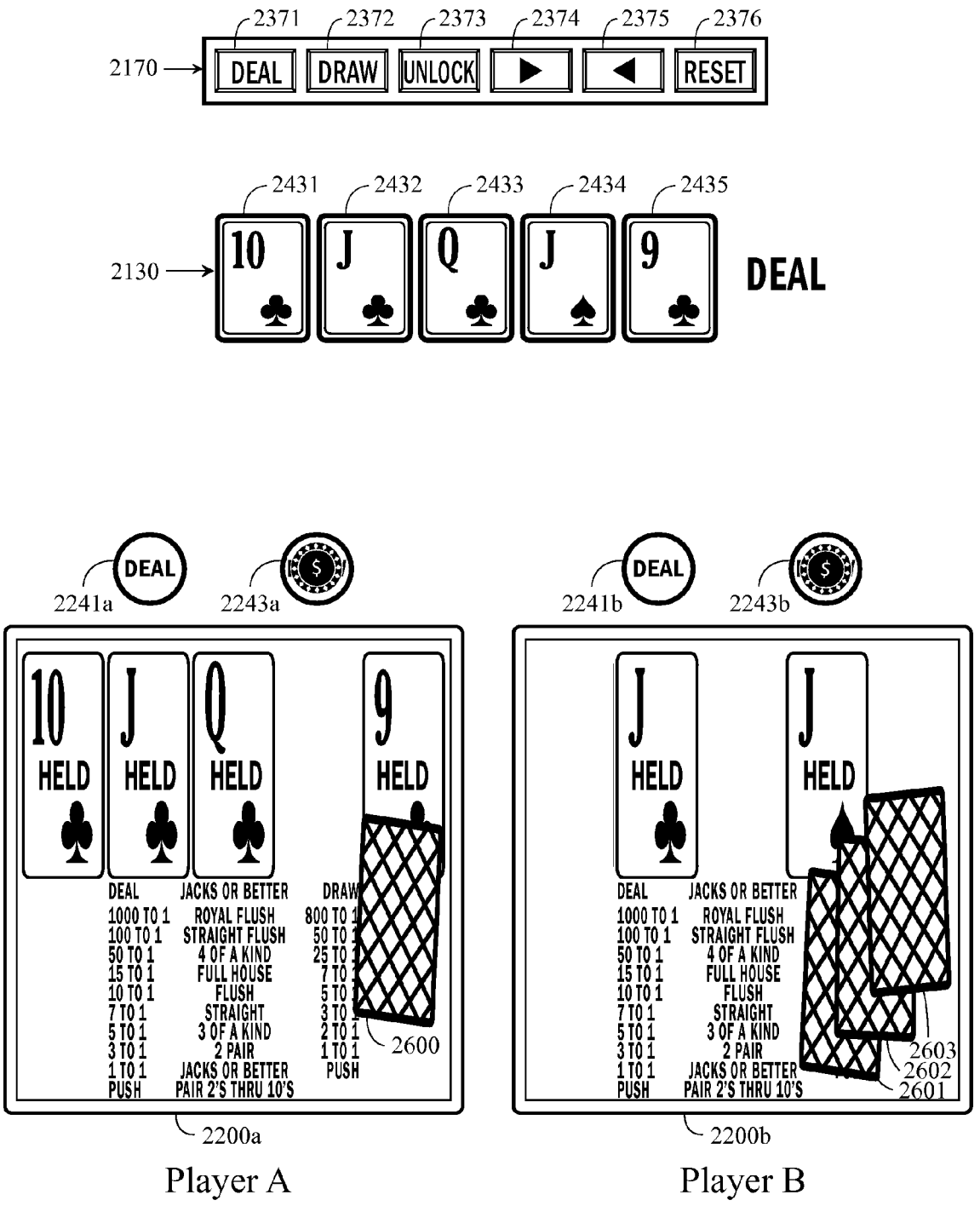
FIG. 26 shows a common display, player stations for Version 2B as they appear after draw cards are dealt to each player.

Turning now with reference to FIG. 26 we see that the shuffler has dispensed and in turn the dealer dealt one card face down to Player A2600. We also see that the shuffler has dispensed and in turn the dealer has dealt three cards face down to Player B 2601, 2602, 2603. The shuffler has signaled the server of the resulting dealt cards and the server records who got which cards for later verification of the hand.

Figure 27:
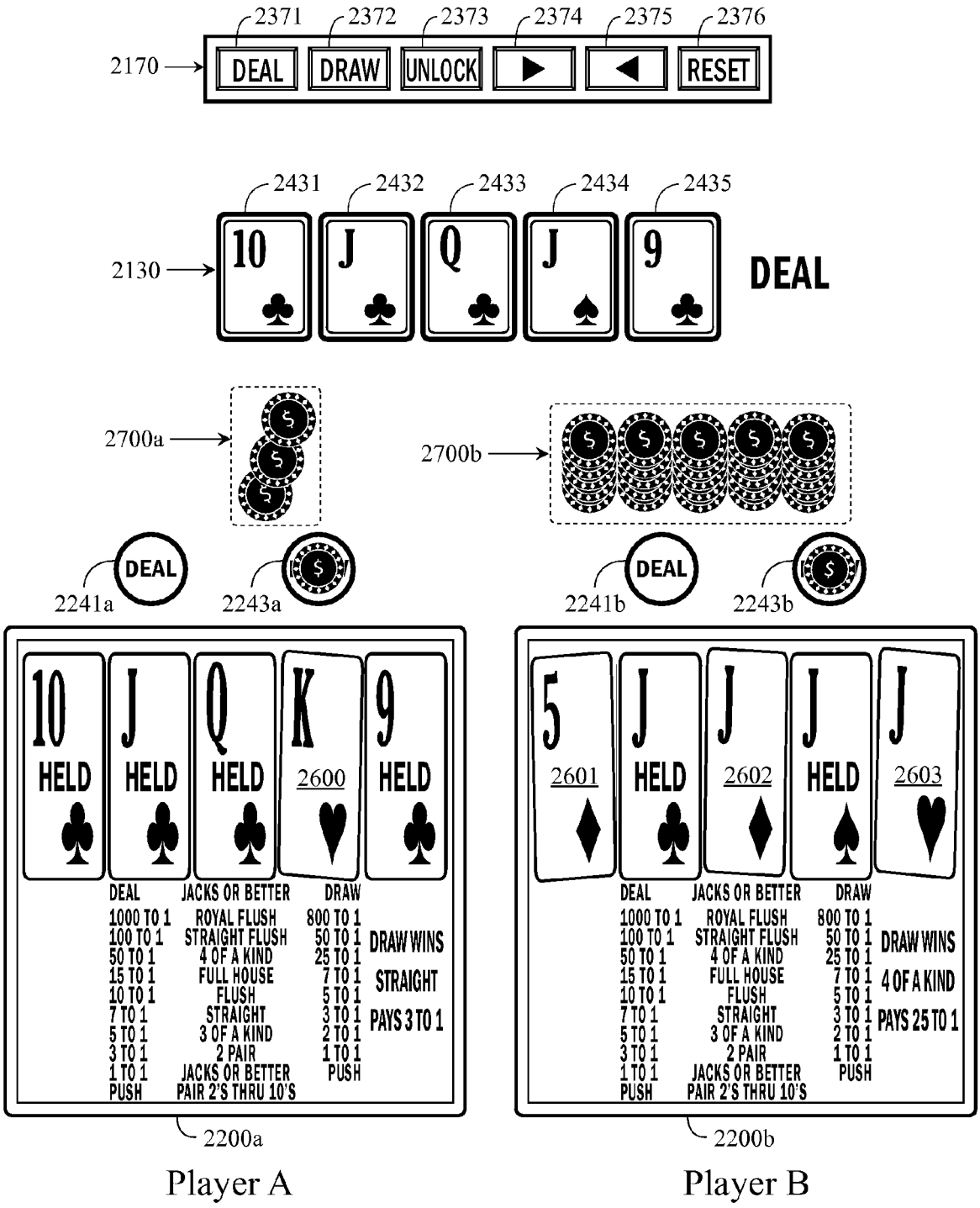
FIG. 27 shows a common display, player stations for Version 2B as they appear after both players' final draw hands are settled.

FIG. 27 shows that each player has turned over their playing cards 2600, 2601, 2602, 2603 and laid them on respective displays 2200*a* & 2200*b* to reveal their final draw hands. As shown 2200*a* Player A's final draw hand contains a ten of clubs, a jack of clubs, a queen of clubs, a king of hearts and a nine of clubs resulting in a rank of straight. Also shown is Player B's hand a five of diamonds, jack of clubs, jack of diamonds, jack of spades and a jack of hearts resulting in a four of a kind ranking. The dealer has paid each player an award 2700*a* & 2700*b* based off their wager 2243*a* & 2243*b* and a draw pay table.

If desired the dealer can use the toggle buttons 2374 & 2375 to signal the server to show on each respective players' display 2200*a* & 2200*b* the draw cards dealt to that player. It is anticipated that placing real playing cards in players' hands will be an attractive feature to some players.

Another attractive feature of this embodiment is its tournament play potential. Casino's commonly use video poker tournaments as a promotional tool to attract casino patrons. Likewise gaming suppliers use local and national tournaments to promote their proprietary game offerings. The embodiments disclosed herein especially where only one community hand is used offer a compelling tournament style of play for the video poker playing community. Those skilled in the art will recognize that since all players at a table—or a limited number of linked video poker machines—would be dealt the same starting hand, tournament skill of the game has a larger effect on a player's outcome within that group as compared to current video poker tournament play. Another important component of table tournaments that is practically missing from current video poker tournament offerings is skilled varying of the bet with relation to your opponents chip count (credit balance). These and many other advantages are anticipated with the present invention.

Description

Figure 28:
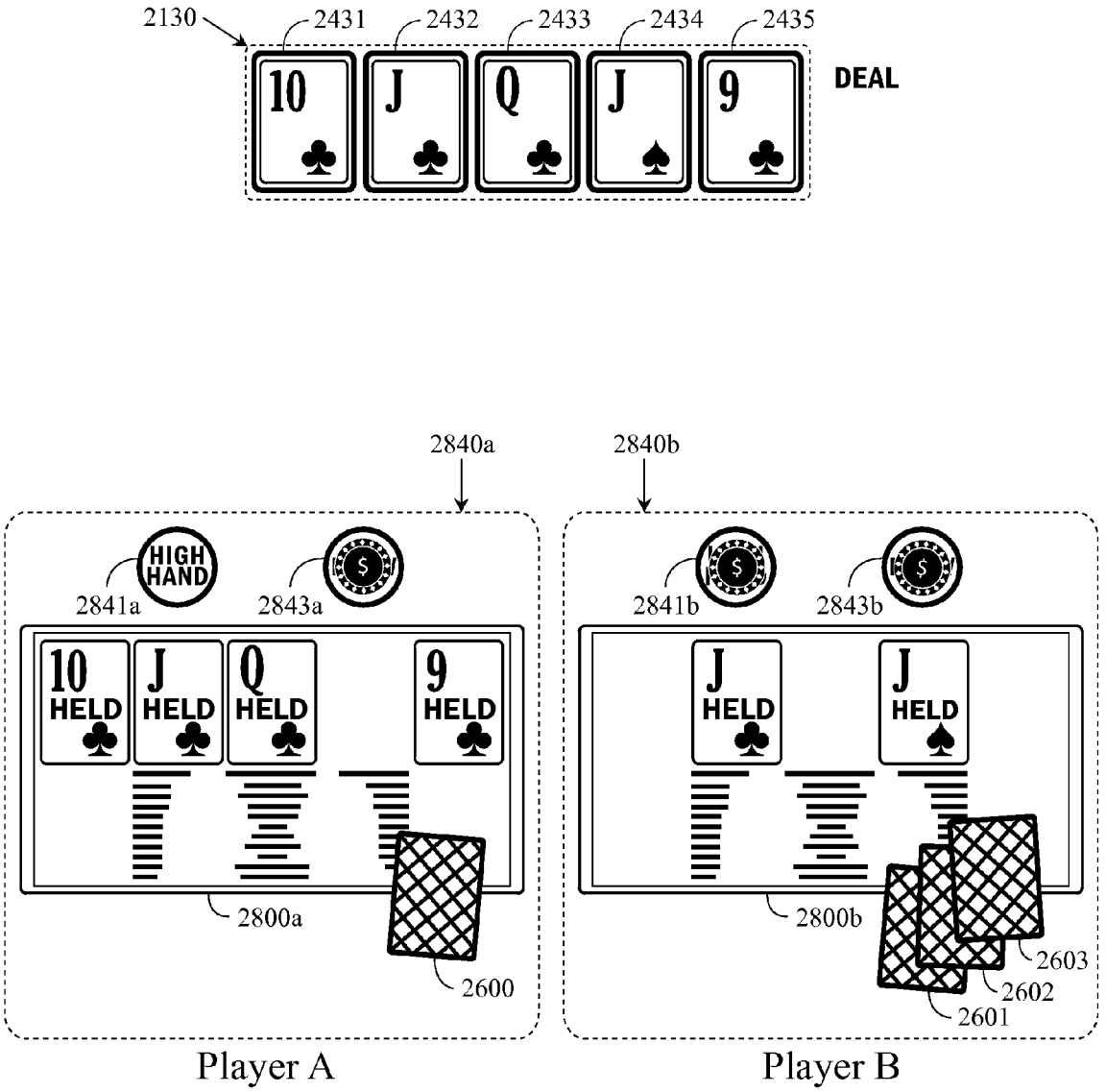
FIG. 28 shows a common display, player stations for Version 2C with a high hand wager as they appear after draw cards are dealt to each player.
Figure 29:
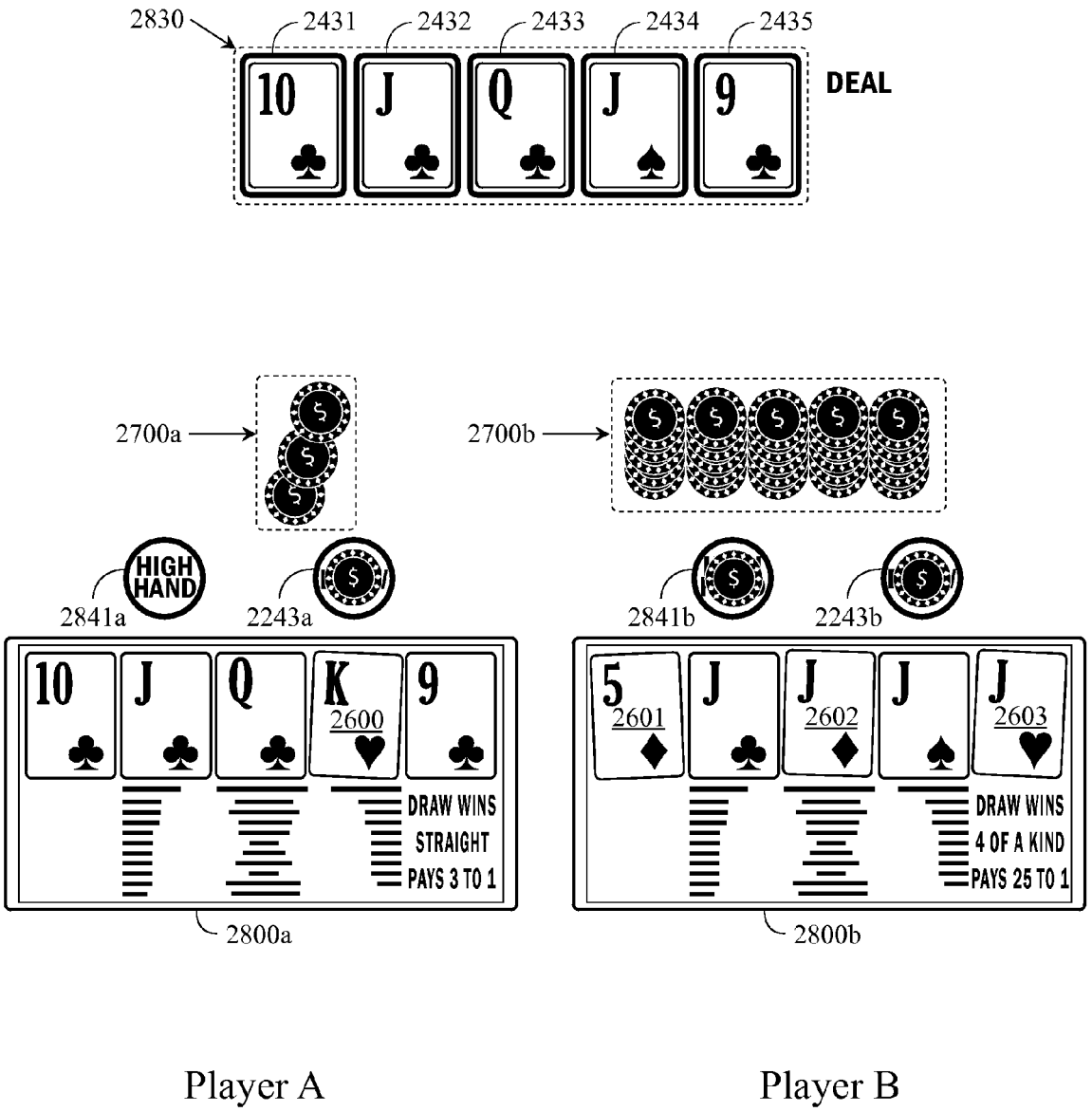
FIG. 29 shows a common display, player stations for Version 2C as they appear after both players' final draw hands are settled.
Figure 30:
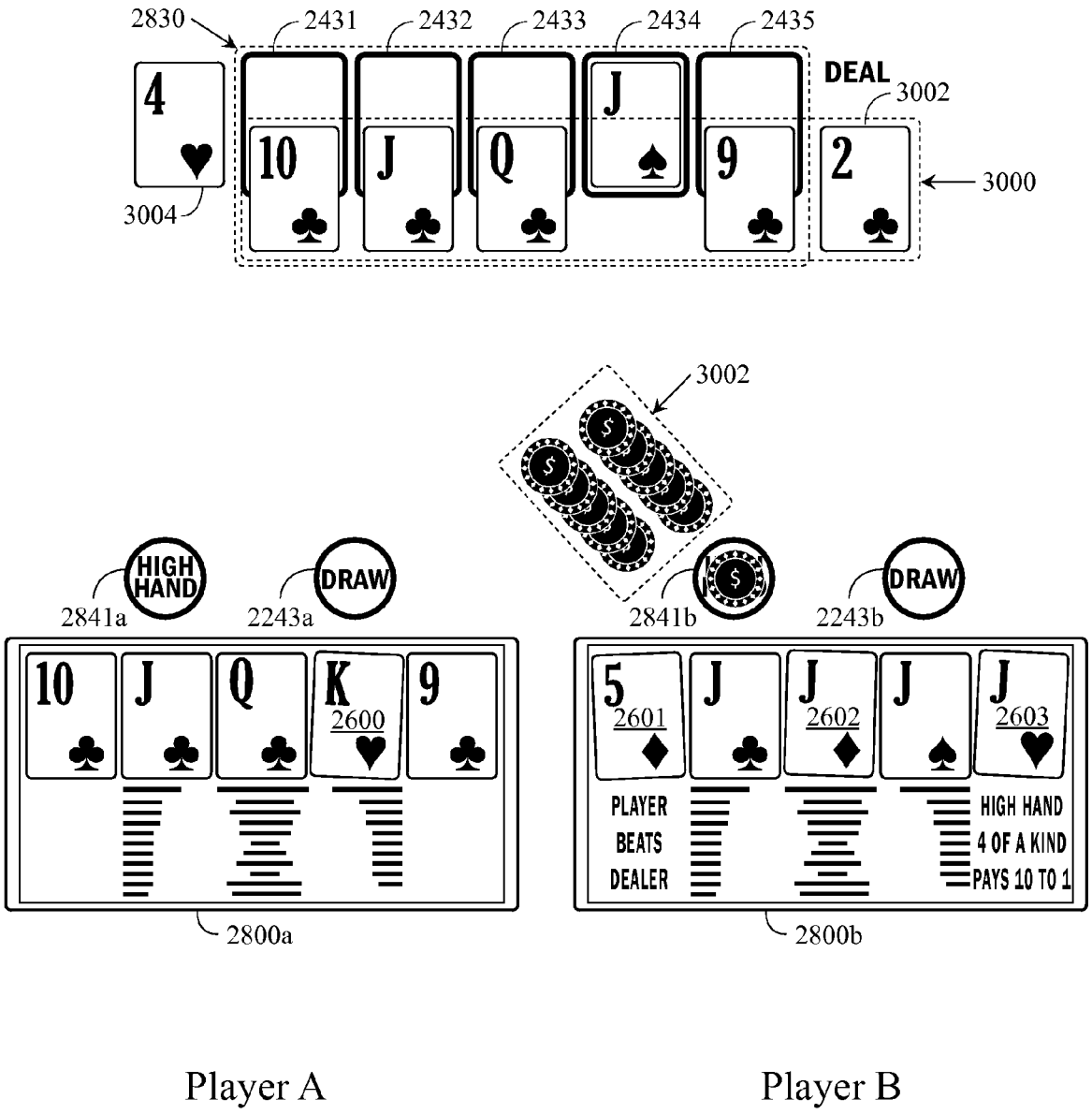
FIG. 30 shows a common display, player stations for Version 2C as they appear after adding two cards to the deal to make a seven card stud hand that competes with each player's final draw hand.

Alternate Embodiment—FIGS. 28, 29, 30

Version 2C—Live Table, 1 Community Hand, Beat Dealer Feature

Version 2C is an extension of Version 2B with a modification that pits the players final draw hand against a dealer hand. With reference to FIG. 28 we see two modified player stations 2840*a* & 2840*b*. At each are a high hand bet area 2841*a* & 2841*b* and a draw bet area 2843*a* & 2843*b*. Player A has elected not to play the high hand game by only making a draw game wager 2243*a*. Player B has made a high hand wager 2841*b* and a draw game wager 2243*b* indicating participation in both. On surface of Player A's video display 2800*a* is a playing card 2600 dealt to the player face down. On surface of Player B's video display 2800*b* are three playing cards 2601, 2602, 2603 dealt to the player face down. A community deal hand row 2130 is shown displaying a ten of clubs 2431, jack of clubs 2432, queen of clubs 2433, jacks of spades 2434 and a nine of clubs 2435.

Operation

Alternate Embodiment—FIGS. 28, 29, 30

Continuing on FIG. 28 we see that cards have been held in the same manner as in Version 2B. Player A is holding the ten of clubs, jack of clubs, queen of clubs and nine of clubs 2800*a* and Player B held the jack of clubs and the jack of spades 2800*b*. Accordingly each player received the appropriate quantity of replacement cards 2600, 2601, 2602, 2603.

In FIG. 29 we see that Player A drew a straight (nine thru kings) as shown on the display 2800*a*. Player B drew a four of a kind (jacks) 2800*b*. Just as in Version 2B both players draw wagers are settled 2700*a* & 2700*b*.

FIG. 30 shows that after settling all the draw wagers the dealer has dealt two additional cards 3004 & 3002 on to the layout one on each side of the community deal stud row 2830. The dealer makes the best five card hand by using any of the five community cards 2431-2435 and none, one or two of the additional cards 3004 & 3002. The dealers hand will compete against the final draw hand of all players who had placed a high hand wager 2841*a* & 2841*b*. In the example of FIG. 30 the dealer was able to use the two of clubs 3002 to create a queen high club flush 3000 as the final dealer hand. In the event Player A had made a high hand 2841*a* wager he would have lost it as a flush 3000 would beat a straight 2800*a*. Player B who did make a high hand wager 2841*b* was able to beat the dealer with four of a kind (jacks) 2800*b* versus the dealers flush 3000.

Further modifications to Version 2C are be to deal more or less additional cards to the dealer, thereby adjusting odds to make desirable pay tables. Additionally rather than using the dealer hand to compete with the players hands a seven card stud hand bonus game could be added. Using the example above, players would have been awarded a flush payout according to a seven card stud pay table and the amount of their wager. As with the dealer versus player game more or less cards can be used in this player versus pay table game.

A common trend in gaming is to offer progressive jackpots. Progressive jackpots for the present invention are anticipated; single community deal hand embodiments may have advantages in this regard over the two community handed variations since the likelihood of sharing a royal flush or other high ranking hand is greatly diminished. To those skilled in the art additional embodiments of this single community deal hand method will become apparent.

Description

Figure 31:
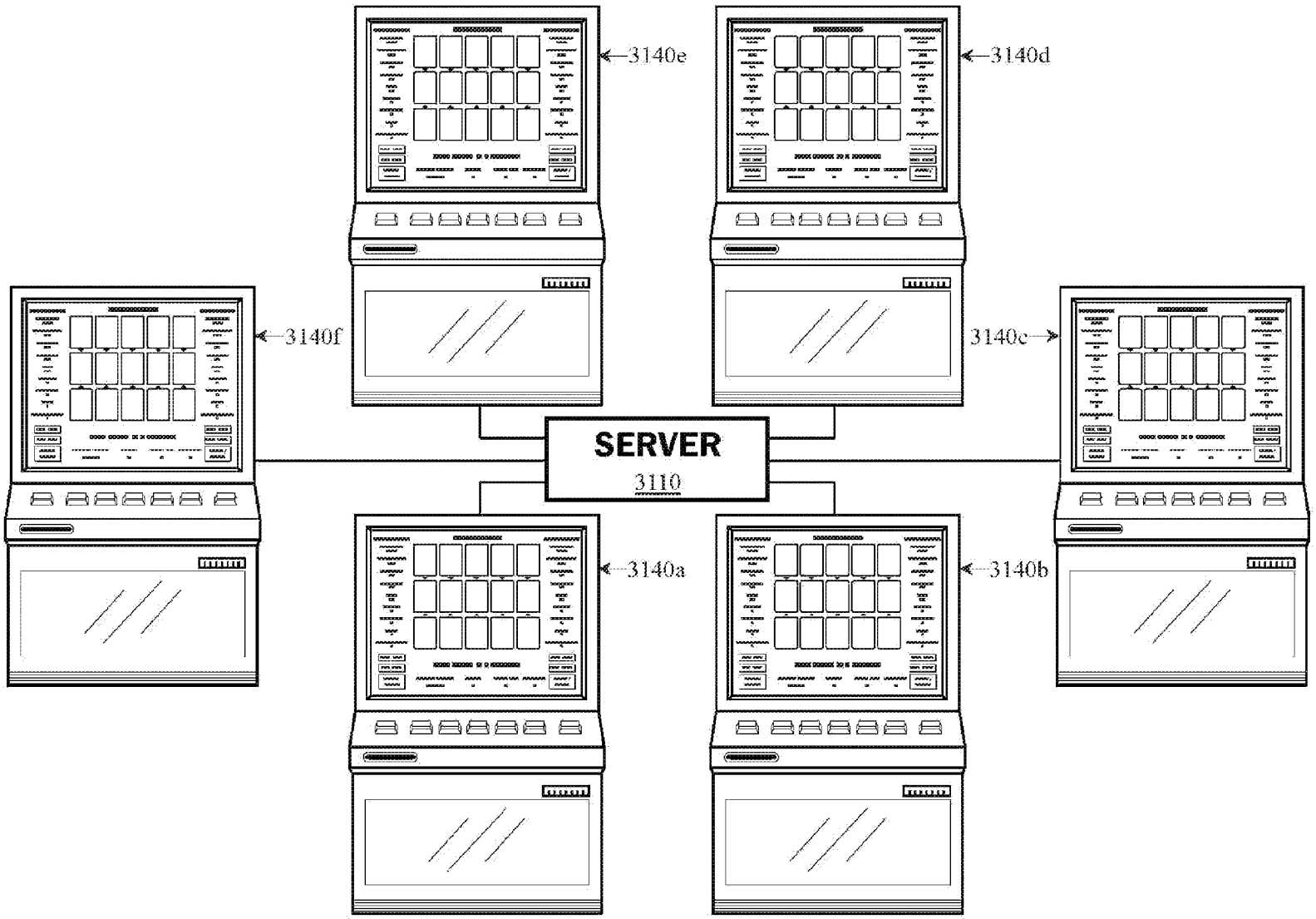
FIG. 31 shows video poker machines linked to a server in a suitable fashion to implement Version 3A.
Figure 32:
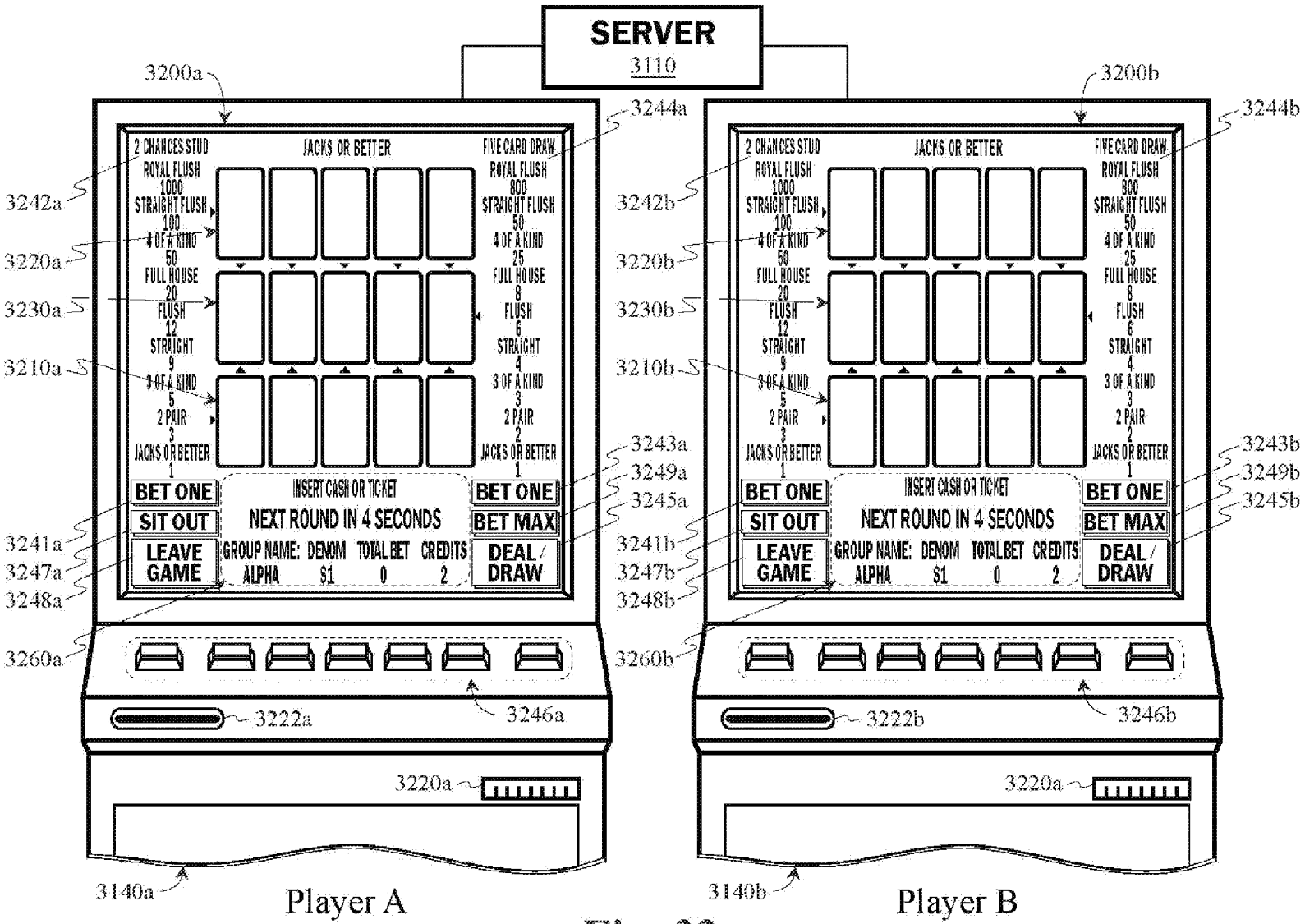
FIG. 32 shows linked video poker machines (two) for Version 3A as they appear after players have formed a group and inserted credits.

Alternate Embodiment—FIGS. 31, 32

Version 3A—Linked Machines, Full Time Community Game

Version 3A utilizes linked video poker machines as a multi-player platform for implementation of the present invention. In FIG. 31 we see six video poker machines 3140*a*-3140*f* linked by conventional methods to a central server 3110. For brevity throughout the description the term video poker machine will be referred to as VPM. VPMs could be slot machines, wireless hand held devices, personal computers and any other item which can act as a gaming terminal. Version 3A will use the Sandwich Drawing Method (SDM), theoretically enabling any number of players to play the game at the same time; therefore the number of players should not be limited to the drawing depictions.

FIG. 32 is an enlarged view of two VPMs 3140*a* & 3140*b* and the connected server 3110. The server 3110 will act as a dealer to manage game play and dispense the equivalent of randomly shuffled playing cards. Each VPM has a credit input 3220*a* & 3220*b* and a credit output 3222*a* & 3222*b*. Auxiliary buttons 3246*a* & 3246*b* may be used in place of the provided touch screen video display 3200*a* & 3200*b*. On the displays 3200*a* & 3200*b* are shown a two chances stud pay table 3242*a* & 3242*b* and a five card draw pay table 3244*a* & 3244*b*. At the center of each display are three rows 3210*a* & 3210*b*, 3220*a* & 3220*b*, 3230*a* & 3230*b*. Each VPM has wager management controls 3241*a* & 3241*b*, 3243*a* & 3243*b*, 3249*a* & 3249*b*. Players are enabled to sit out rounds by utilizing the sit out button 3247*a* & 3247*b*. To leave the game and join another group or change the game a leave game button 3248*a* & 3248*b* is provided. A deal/draw button 3245*a* & 3245*b* is provided to initiate play and lock selections. In the lower portion of each display 3200*a* & 3200*b* is a variable display area 3260*a* & 3260*b* showing a group name (Alpha), credit denomination ($1), total credits bet (0), credit balance (2), time to next round (4 seconds) and a message to insert credits. The display 3260*a* & 3260*b* will change with respect to various stages of play and changing game conditions.

Linked VPMs can have preset groups or player definable groups. Groups act as virtual tables giving players flexibility to move from one table/group to another. For instance a bank of linked VPM's might be pre-linked wherein players at the bank are automatically a member of the same group, in these cases a group name might be omitted from the displays 3260*a* & 3260*b*. Preset groups might be determined by the game variation being offered. For instance a bank of linked VPMs may offer Jacks or Better and Deuces Wild game variations. All players playing Deuces Wild would be a member of a Deuces Wild group separate from those players who chose Jacks or Better. Alternatively players can create their own groups/communities that potentially are accessible anywhere in the casino/network. For example if you and a friend walk up to a casino bar that offers the present invention an option to create a new group or join an existing one would be available through the VPMs user interface. In this way you and your friend can play together on separate machines or join a group already at the bar.

A clock in the server 3110 will facilitate timers that control the pace of the game. A predetermined maximum amount of time is provided between rounds of play. Additionally a server controlled preset timer controls the maximum time allowed for a player to make hold selections. The timers can be overridden if all players in a group press the deal/draw button 3245*a* & 3245*b* before the timer expires; this allow players to increase the games pace if desired. In the event a player fails to bet at least one credit before the start of a new round then he or she will lose the opportunity to participate in that round. Players failing to select cards and press the deal/draw button 3245*a* & 3245*b* will use all cards from the community draw stud hand as their final draw hand.

Operation

Alternate Embodiment—FIGS. 33, 34, 35, 36

Figure 33:
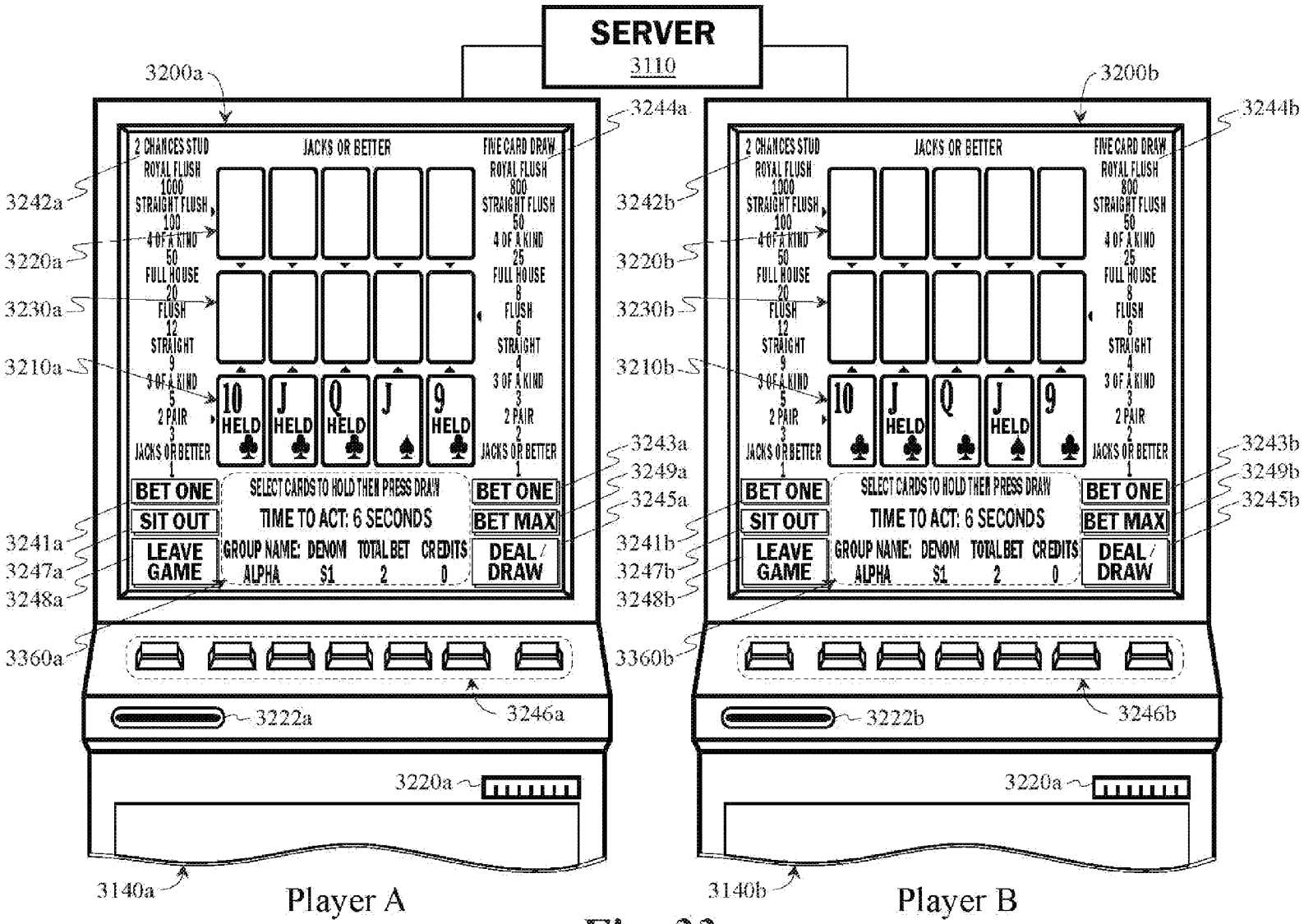
FIG. 33 shows linked video poker machines for Version 3A as they appear after the bet, the deal and selections are made.

With reference now to FIG. 33 we see on the variable display 3360*a* & 3360*b* that Player A and Player B have joined a group named Alpha prior to commencing a round of play. The displays 3360*a* & 3360*b* also show that two credits have been bet, one for the two chances stud game and one for the five card draw game. Note: if any player had bet more than one credit on any game that the pay tables 3242*a* & 3242*b*, 3244*a* & 3244*b* would display double or triple the amounts shown for a second or third credit bet respectively on each game. The server has virtually dealt an initial community deal stud hand shown in the bottom rows 3210*a* & 3210*b* of every Alpha group member's display 3200*a* & 3200*b*. The initial community deal stud hand contains a ten of clubs, a jack of clubs, a queen of clubs, a jack of spades and a nine of clubs. Alpha group has six seconds remaining to complete hold selections as indicated in the variable displays 3360*a* & 3360*b*. Player A and Player B have selected hold cards in the bottom row 3210*a* & 3210*b* as is indicated by the word held over the cards selected. If both players do nothing else then in six seconds the selections would be locked in and the community deal stud hand would be dealt. Alternatively all players can press the deal/draw button 3245*a* & 3245*b* stopping the timer and signaling the server 3110 to deal the community deal stud hand.

Figure 34:
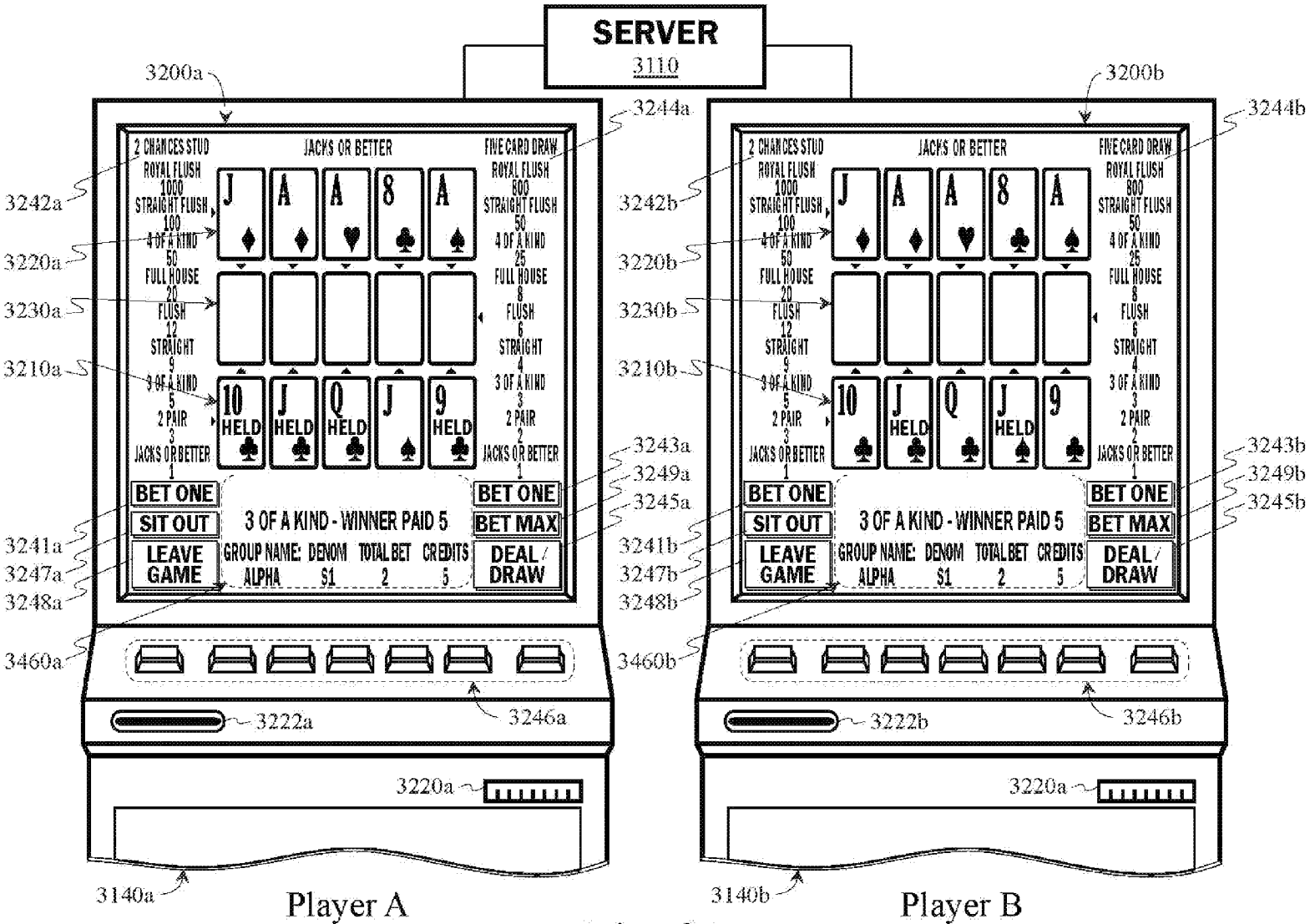
FIG. 34 shows linked video poker machines for Version 3A as they appear after the draw cards are dealt and the two chance stud wagers are settled.

FIG. 34 shows the displays 3200*a* & 3200*b* after the server 3110 has dealt the community draw stud hand 3220*a* & 3220*b* containing a jack of diamonds, ace of diamonds, ace of hearts, eight of clubs and the ace of spades. The variable displays 3460*a* & 3460*b* indicate that the highest ranking hand of the two community stud hands is the draw stud hand with three of a kind (aces) and that the corresponding payouts have been paid.

Figure 35:
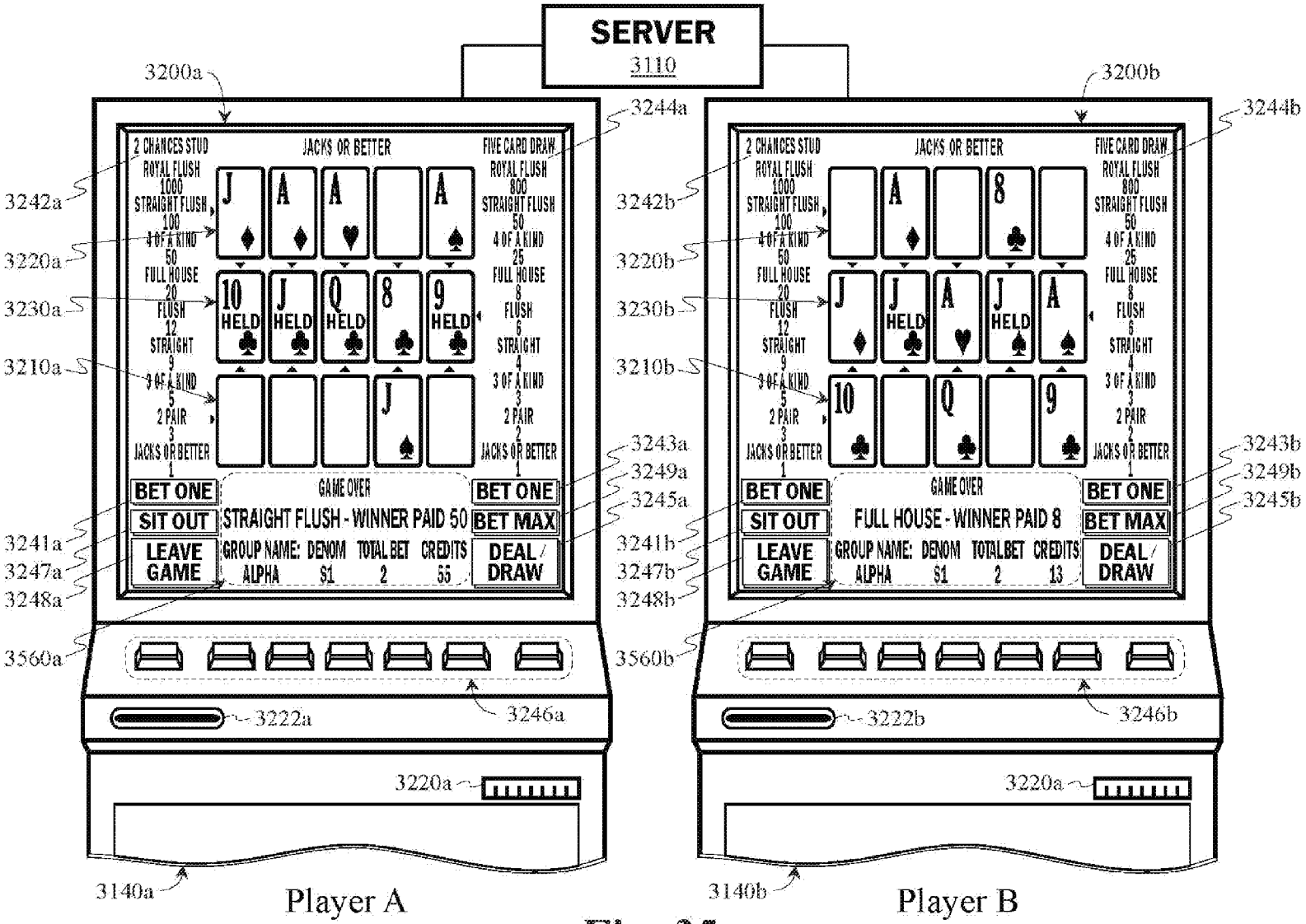
FIG. 35 shows linked video poker machines for Version 3A as they appear after both players' final draw wagers are settled.

FIG. 35 shows the displays 3200*a* & 3200*b* after the server 3110 has signaled the VPMs to display each player's final draw hand in the center row 3230*a* & 3230*b* in accordance with the SDM. Player A is awarded for a straight flush as is indicated in the variable display 3560*a*. Player B is awarded for a full house as is indicated in the variable display 3560*b*. Shortly following the final draw wager settlements the server 3110 initiates and displays the next round timer as seen in FIG. 32 3260*a* & 3260*b*.

While the SDM of two community stud hands is shown. It is anticipate that the single community deal stud hand method of Version 2A, 2B & 2C can be integrated in similar fashion but with a limited number of players as there is a limit to the number of cards in the deck. Further modifications to Version 3A are anticipated.

Description

Figure 36:
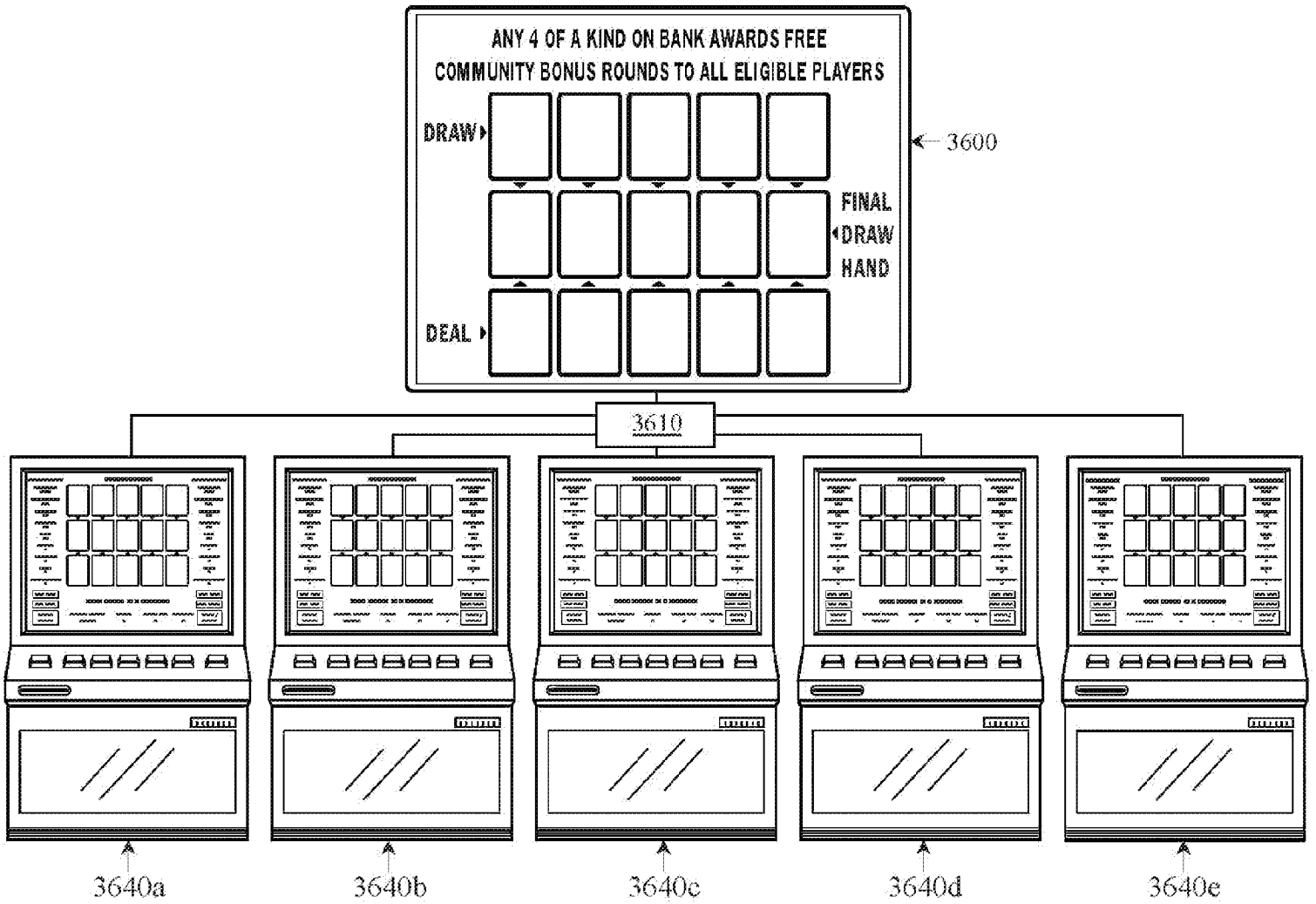
FIG. 36 shows video poker machines linked to a server and a common display suitable implementing Version 3B.
Figure 37:
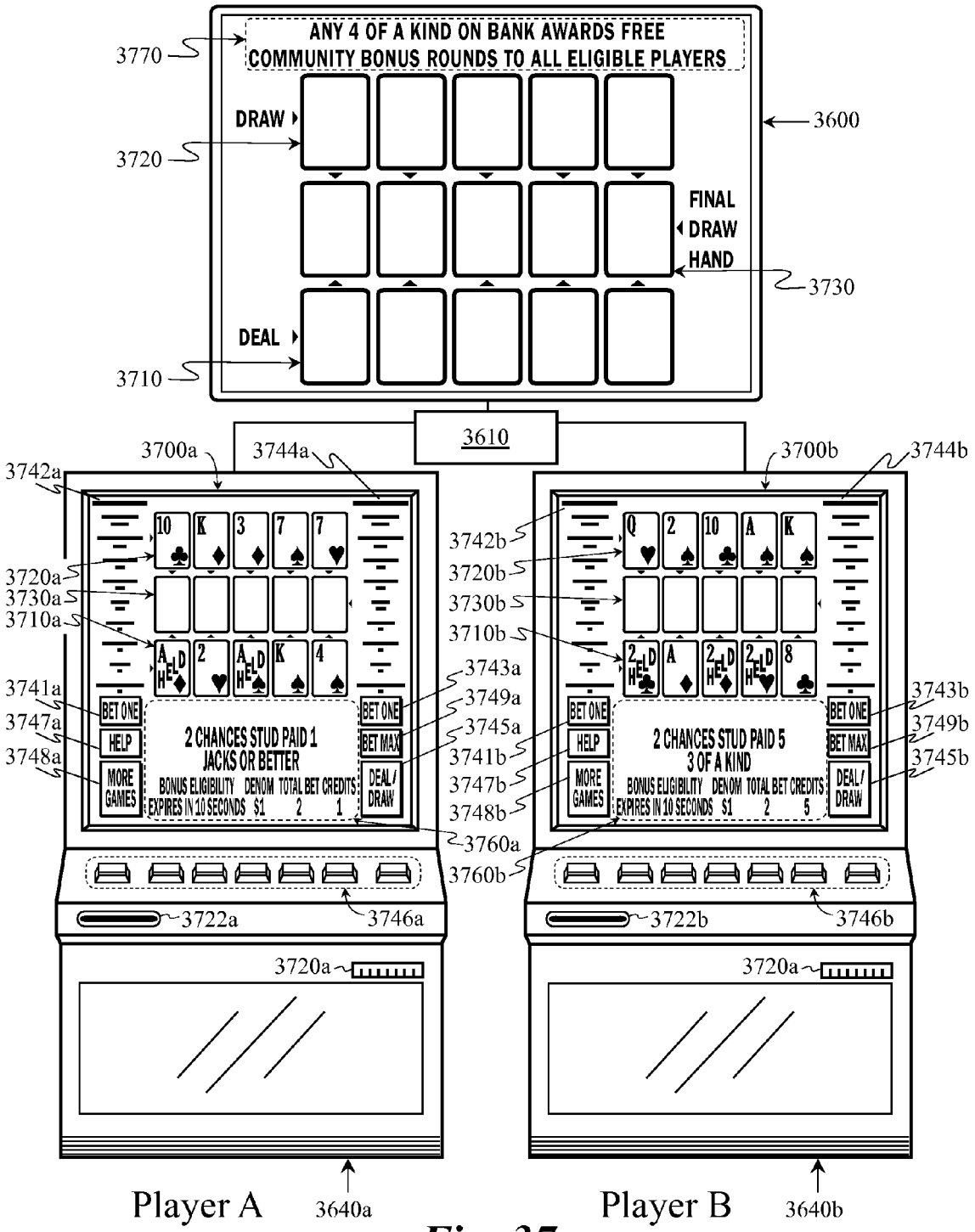
FIG. 37 shows linked video poker machines and a common display for Version 3B as they appear after draw cards are dealt while the machines are in single player mode.

Alternate Embodiment—FIGS. 36, 37

Version 3B—Linked Machines, Single Player until Community Bonus

Version 3B is a video poker community bonus game. This alternate embodiment as shown starts as a single player game similar to Version 3A. When a predetermined outcome occurs on any of the linked single player VPMs a community bonus round is activated.

FIG. 36 shows five VPMs 3640*a*-3640*e* linked through conventional means to a central server 3610. Above the VPMs 3640*a*-3640*e* a large common video display area 3600 is shown. The multi-player platform of FIG. 36 appears as it would before any players began play.

Turning to FIG. 37 we see that the common display area 3600 is displaying a message that any four of a kind on this bank will award free community bonus rounds to all eligible players. Also shown in the common video display 3600 are three rows 3710, 3720, 3730 consistent with the SDM. Each VPM has a credit input 3720*a* & 3720*b* and a credit output 3722*a* & 3722*b*. Auxiliary buttons 3746*a* & 3746*b* may be used in place of the provided touch screen video display 3700*a* & 3700*b*. On the displays 3700*a* & 3700*b* are shown a two chances stud pay table 3742*a* & 3742*b* and a five card draw pay table 3744*a* & 3744*b*. At the center of each display are three rows 3710*a* & 3710*b*, 3720*a* & 3720*b*, 3730*a* & 3730*b*. Each VPM has wager management controls 3741*a* & 3741*b*, 3743*a* & 3743*b*, 3749*a* & 3749*b*. A help button 3747*a* & 3747*b* takes players to an instructions screen. To change game variations a more games button 3748*a* & 3748*b* is provided currently both machines 3640*a* & 3640*b* are set to Jacks or Better. A deal/draw button 3745*a* & 3745*b* is provided to initiate play and lock selections. In the lower portion of each display 3700*a* & 3700*b* is a variable display area 3760*a* & 3760*b* showing a bonus eligibility timer, credit denomination ($1), total credits bet, credit balance and a message that the two chances stud wager just paid Player A for a pair (aces) 3710*a* and Player B for a three of a kind (2's) 3710*b*. The display 3760*a* & 3760*b* will change with respect to various stages of play and changing game conditions. A close look at the displays 3700*a* & 3700*b* of FIG. 37 will show that both machines are being played in an independent single player manner whereby no community cards are used.

Operation

Alternate Embodiment—FIGS. 36, 37, 38, 39, 40

Figure 38:
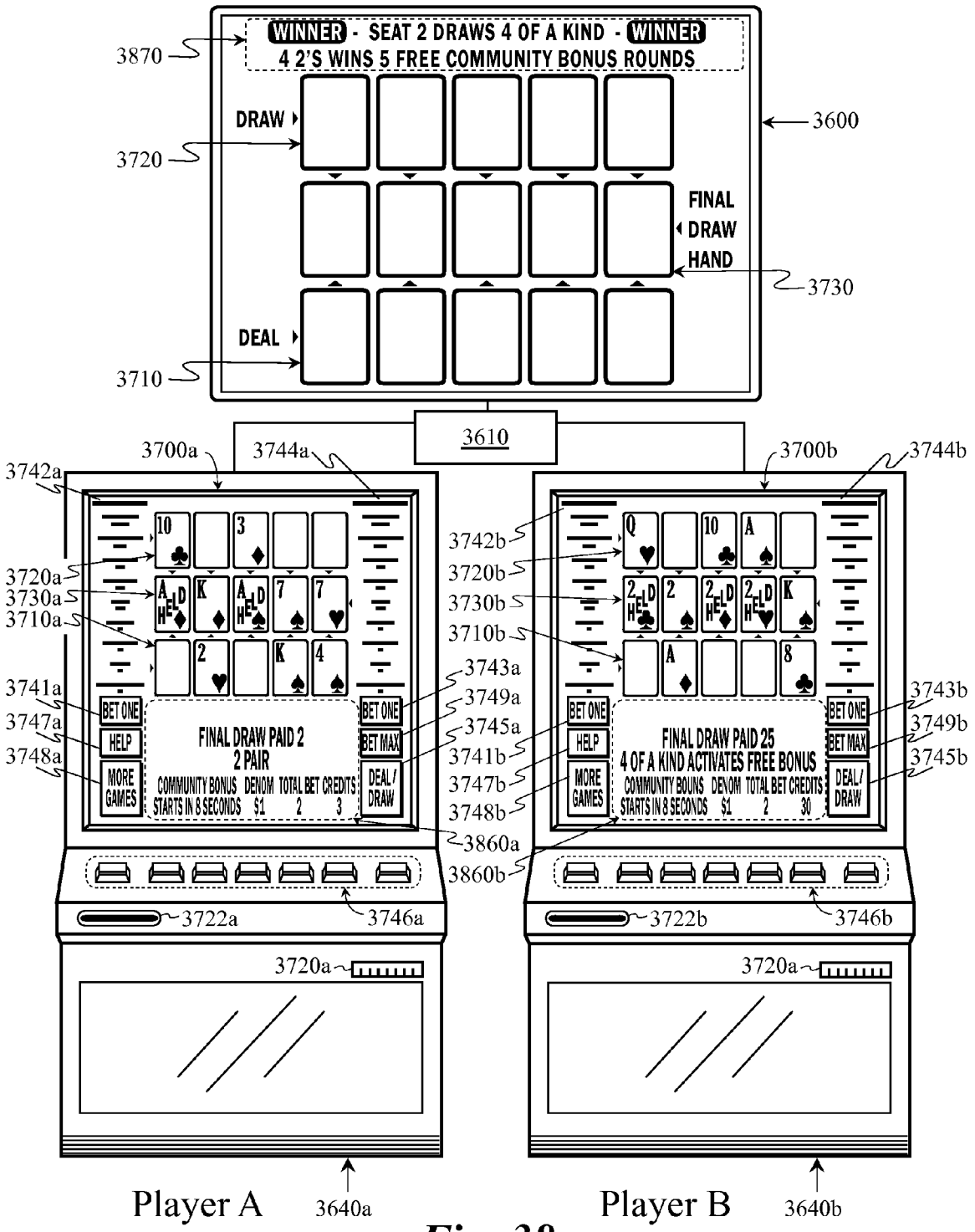
FIG. 38 shows linked video poker machines and a common display for Version 3B as they appear after one player's hand activates community bonus mode.

FIG. 38 shows that Player B has drawn a four of a kind (2's) 3730*b*. The VPM 3640*b* has signaled the server 3610 to activate a community bonus round. The server has signaled the common video display 3600 to display the four of a kind winner (Player B, Seat 2) 3870. In the variable display areas 3860*a* & 3860*b* we see a community bonus timer indicating eight seconds are left before the free community bonus round begins. Also indicated in the variable display area 3860*a* & 3860*b* are the Player's final draw hand payouts.

Figure 39:
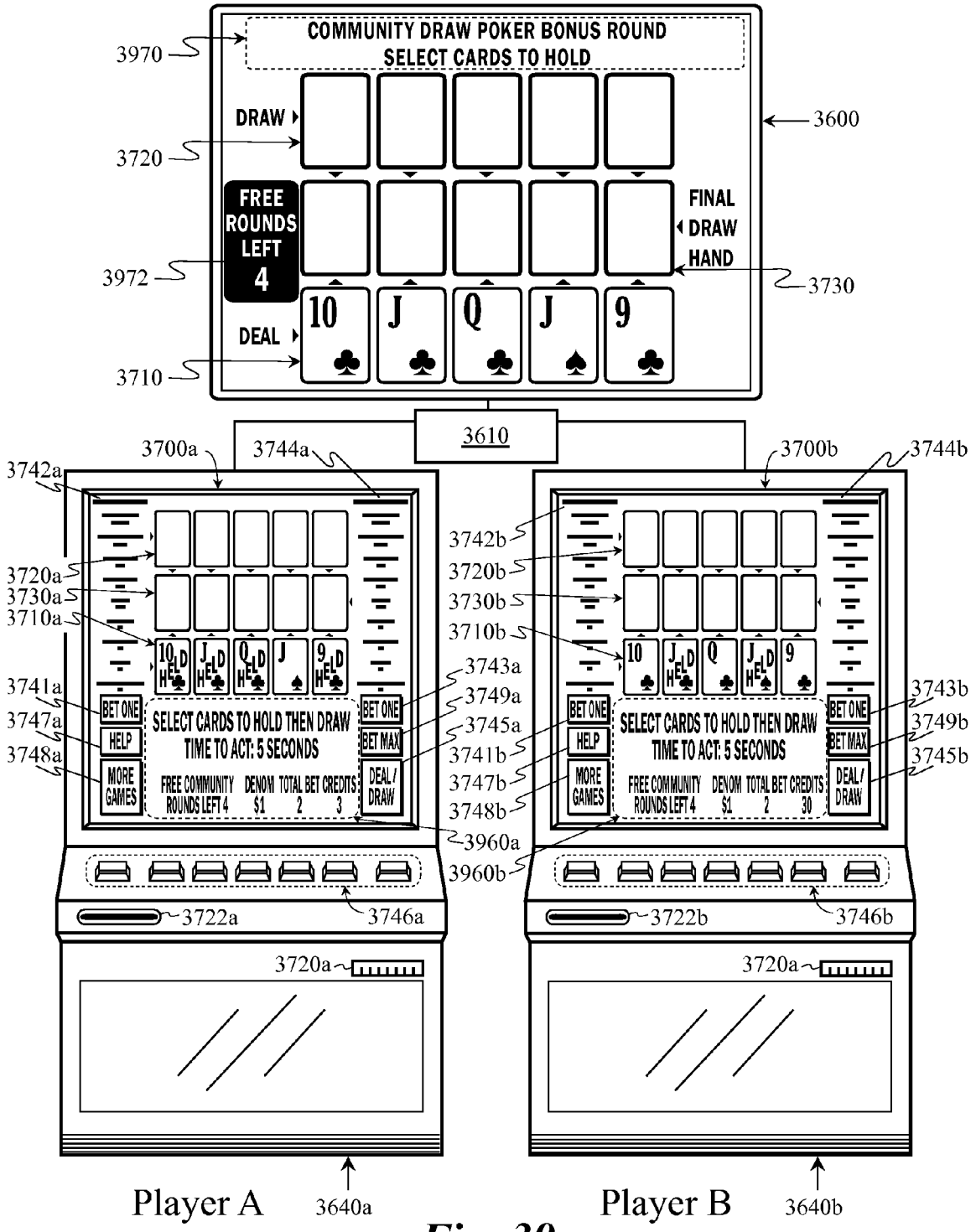
FIG. 39 shows linked video poker machines and a common display for Version 3B as they appear after the deal and selections are made.

FIG. 39 shows conditions after the start of the first community bonus round. The common video display 3600 shows the initial community stud hand dealt 3710 by the server 3610. The initial community deal stud hand 3710 contains a ten of clubs, a jack of clubs, a queen of clubs, a jack of spades and a nine of clubs. Also shown is a message telling players to select cards to hold 3970 and a free rounds remaining meter 3972. Player A and Player B have selected hold cards in the bottom row 3710*a* & 3710*b* as is indicated by the word held over the cards selected. As in Version 3A a timer is used by the server to control pace of the game as indicated in the variable display area 3960*a* & 3960*b*. After players have made their selections they press the deal button 3745 or allow the timer to run out.

Figure 40:
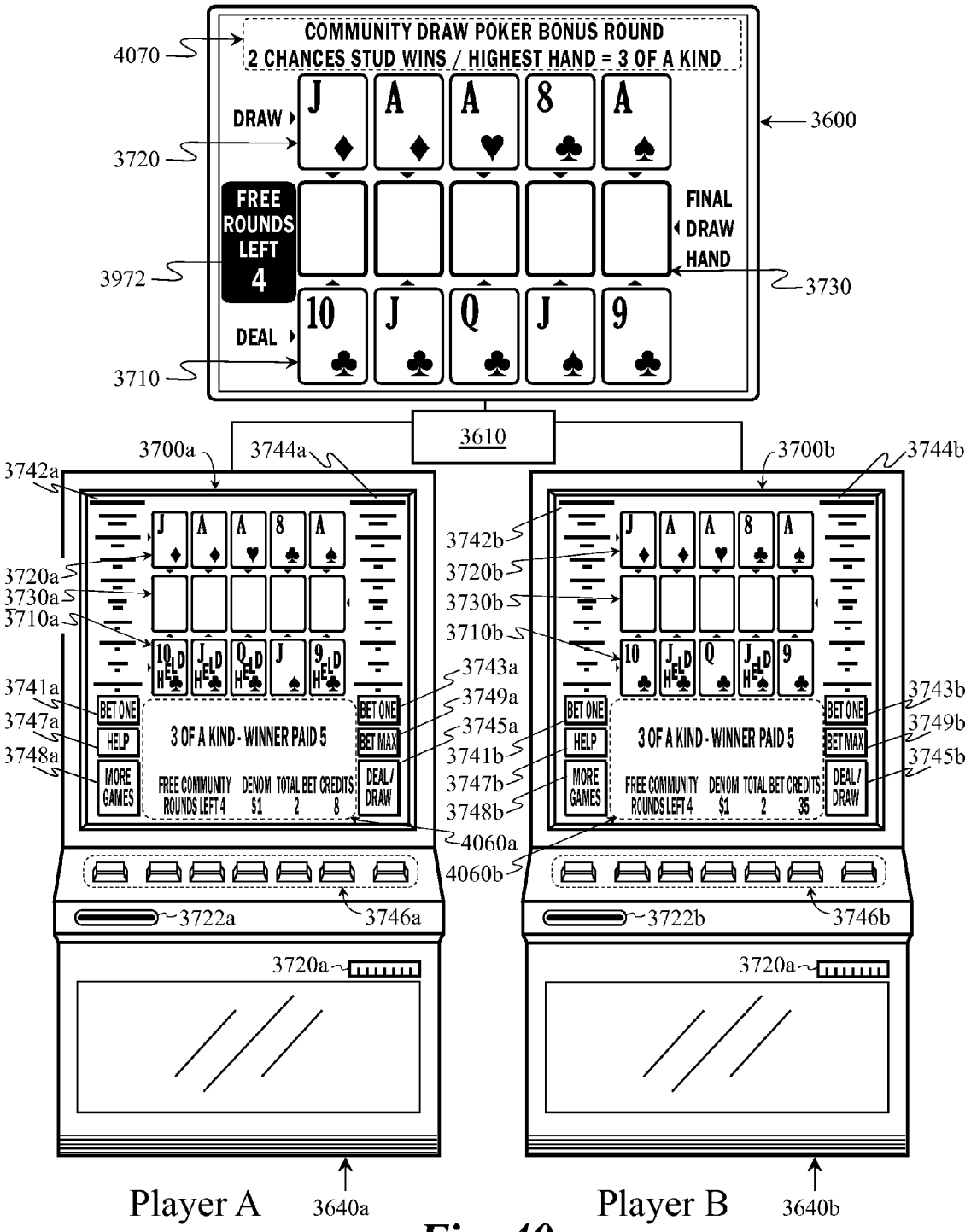
FIG. 40 shows linked video poker machines and a common display for Version 3B as they appear after the draw cards are dealt and the two chance stud bonus awards are paid.

FIG. 40 shows the displays 3600, 3700*a*, 3700*b* after the server 3610 has dealt the community draw stud hand 3720, 3720*a* & 3720*b* containing a jack of diamonds, ace of diamonds, ace of hearts, eight of clubs and the ace of spades. The variable displays 4060*a*, 4060*b*, 4070 indicate that the highest ranking hand of the two community stud hands is the draw stud hand with three of a kind (aces). Corresponding payouts have been paid.

Figure 41:
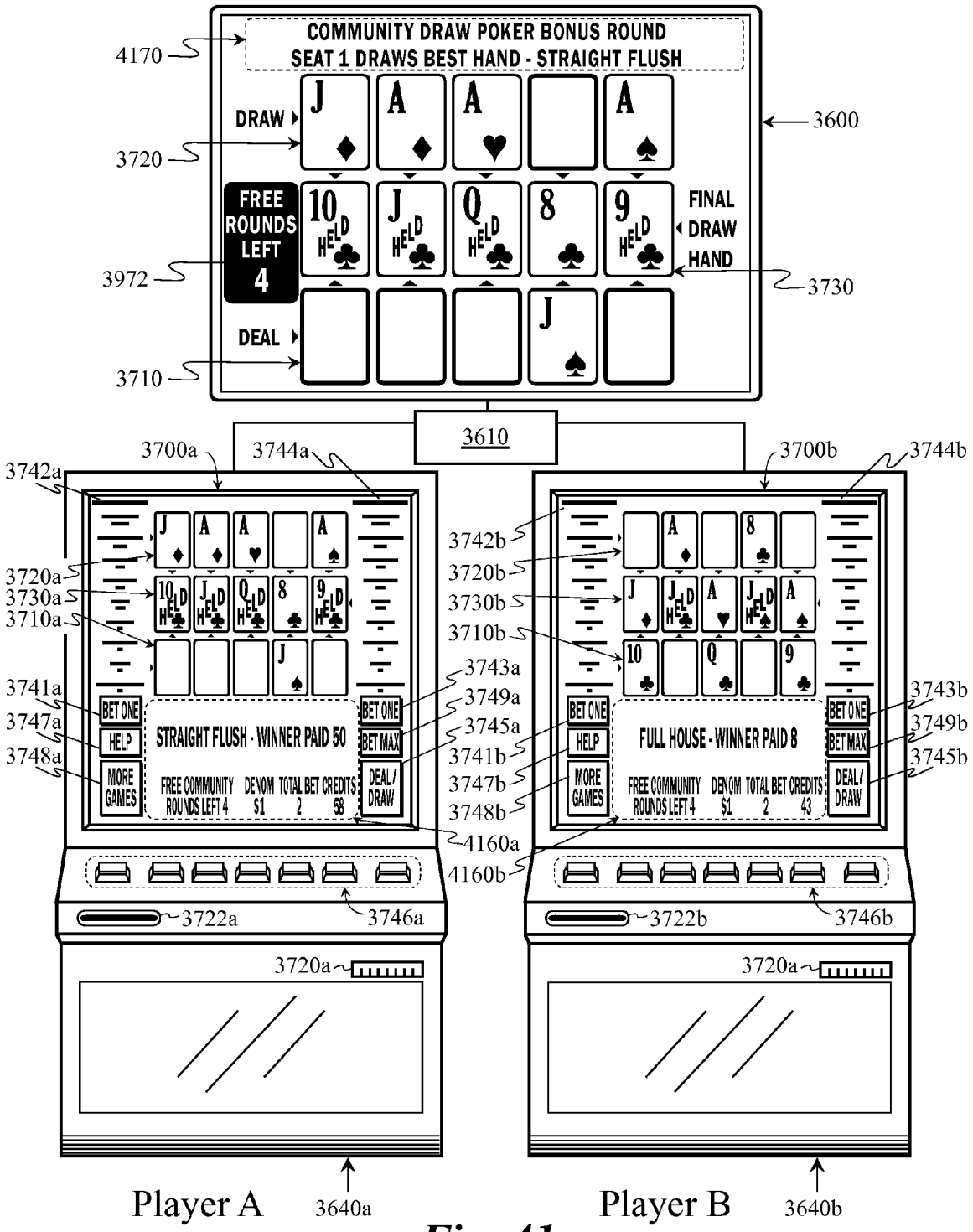
FIG. 41 shows linked video poker machines and a common display for Version 3B as they appear after the final draw bonus awards are paid.

FIG. 41 shows the displays 3600, 3700*a* & 3700*b* after the server 3610 has signaled the VPMs to display each player's final draw hand in the center row 3730*a* & 3730*b* in accordance with the SDM. Player A is awarded for a straight flush as is indicated in the variable display 4160*a*. Player B is awarded for a full house as is indicated in the variable display 4160*b*. Displayed on the common video display 3600 is a message giving acknowledgement to the player or players who drew the highest ranking hand in the last round 4170. Shortly following the final draw payouts the server 3610 initiates and displays the next round.

The eligibility timer as seen in FIG. 37 3760*a* & 3760*b* is necessary to guarantee the game pace is of sufficient speed such that the casino receives enough play (profit) to fund the free community rounds given. Funds to facilitate the free rounds or progressive jackpots may be a portion of the stud wager, the draw wager or both. Alternatively, rather than using a predetermined hand outcome on one of the linked VPMs the community bonus event could occur randomly or when pooled funds achieve certain predetermined levels.

An alternative to using the single player method as shown in the drawings is to incorporate conventional single player VPMs already familiar to players. The SDM would then be limited to the bonus rounds. It is also anticipated that the bonus rounds may include multipliers; whereby players would be awarded two or more times the normal award. Either of these features could make the game more attractive to players.

Casino's use club memberships and player club cards to track play and award loyal patrons. The method of Version 3A & 3B can be used as promotional tool for casinos to award bonus rounds across a server based slot floor. For example video poker players who achieve certain player club points within a predetermined time period might be eligible for free casino wide community bonus rounds. This could be a great feature bringing video poker players all across the slot floor together in a common promotion in a relatively familiar video poker format.

ADVANTAGES

From the description above, a number of advantages of the present method for multi-player video poker-type card games become evident:

By making all cards community cards a new and unexpected result occurs which solves the problems disclosed in the prior art while creating the additional advantages disclosed throughout the specification.

By sharing only the first hand of cards a hybrid electronic/live table experience is brought to the video poker playing community complete with familiar progressive jackpots and improved tournament play if desired.

By having two stud rows sandwiching a center row minimal mechanics allow players to easily determine their final draw hands even while the dealer is creating other player's final draw hands.

A multi-chance wager allows for a simpler layout and has the added benefit of offering a more attractive higher odds pay table since only the highest hand is awarded.

Non-electronic embodiments offer lower cost, lower maintenance and speedier regulatory approval.

Electronic embodiments offer a familiar video poker type game play.

A slot machine style community bonus game is now possible for video poker slot play with shared rounds similar to other reel and wheel based community slot games.

CONCLUSION, RAMIFICATION, AND SCOPE

Accordingly the reader will see that the present invention can be used as a new way to play draw poker—in a manner like video poker—as a communal game that encourages camaraderie through shared experience.

It should be understood that while the games described herein assume the use of one standard deck of 52 cards they can be implemented with more than one deck. The deck or decks used for play may include wild cards such as jokers. The draw poker game shown in the examples utilize pay tables inherent to a variation of video poker known as "Jacks or Better". However rules, pay tables and play strategies from many other versions, such as "Deuces Wild", "Bonus®", "Double Bonus®", "Double Double Bonus®", "Joker Poker", may be used with the present invention.

While the above descriptions contain much specificity, they should not be construed as limitations on the scope of the invention, but as exemplifications of the presently preferred embodiments thereof. Many other ramifications and variations are possible within the teachings of the invention. For example, embodiments described herein show each hand as containing five cards, the use of three card hands or any other number of cards in a hand is anticipated, furthermore instead of using playing cards other objects might be used such as balls, tiles, dice, slot symbols and the like.

Thus the scope of the invention should be determined by the appended claims and their legal equivalents, and not by the examples given.

I claim:

1. A method of playing a poker-type card game, with a draw feature, among one or more players, on at least one gaming device, the method comprising the steps of:

(a) providing at least one gaming device configured with mechanisms to allow the one or more players to insert one or more physical items associated with a monetary value, place wagers, receive one or more physical items associated with a monetary value as winnings or balances, and to indicate card hold selections; each of the one or more players inserting one or more physical items associated with a monetary value into the at least one gaming device;

(b) before any cards are dealt, placing of a draw poker wager by each of the one or more players, with the mechanism to place wagers on the at least one gaming device;

(c) dealing an initial hand of poker cards face up into a first row;

(d) each of the one or more players selectively indicating none, one, or more cards from the initial hand to be held, the step of selectively indicating none, one, or more of the cards in the initial hand to hold carried out by way of the mechanism to indicate card hold selections on the at least one gaming device;

(e) only after each of the one or more players has selectively indicated the cards from the initial hand to be held, dealing a draw hand of poker cards face up into a second row, the draw hand positioned parallel to the initial hand in a manner that provides column alignment of cards such that each card in the initial hand is aligned in a column with a card in the draw hand, the first and second rows sufficiently spaced apart from each other so as to provide space for the construction of a centered third row, the resulting constructed centered third row positioned in parallel between the first and second rows;

(f) for each of the one or more players in turn, moving the cards selected to be held, if any, from the initial hand into aligned columnar positions in the centered third row and leaving the cards not selected to be held, if any, from the initial hand, face up and visible in the first row;

(g) for each of the one or more players in turn, moving columnar aligned cards from the draw hand into aligned columnar positions in the centered third row, if any, that do not contain a held card from the initial hand, and leaving the cards not moved into the centered third row, if any, from the draw hand, face up and visible in the second row, thereby completing that player's final draw poker hand in the centered third row;

(h) for each of the one or more players, determining a poker hand value of that player's final draw poker hand from a pay table;

(i) paying out on none, one, or more of the final draw poker hands, based on the placed wagers and the hand values in the pay table; and (j) each of the one or more players receiving one or more physical items associated with a monetary value as winnings or balances, if any, from the at least one gaming device;

wherein the one or more players are each able to see all possible final draw poker hand outcomes for that player while that player's final draw poker hand is being constructed and displayed, and further wherein the one or more players are each able to see draw poker hand outcomes for that player that were not created when that player's final draw poker hand was constructed and displayed.

2. The method of claim 1 further including the step of starting a timer to provide a predetermined amount of time for each of the one or more players to carry out the step of selectively indicating none, one, or more cards to be held from the first hand.

3. The method of claim 1 wherein the step of providing at least one gaming device comprises providing a computerized card table with an area to display digital images of cards, digitally manage wagers, and facilitate players selections.

4. The method of claim 1 wherein the deck of cards is a standard poker deck of 52 cards with one or two optional jokers.

5. The method of claim 1 wherein the first hand comprises five cards.

6. The method of claim 1 wherein the step of each of the one or more players selectively indicating none, one, or more cards from the initial hand to be held is carried out by way of the use of labeled card positions, each card in the initial hand being placed into a labeled card position such that all cards can be identified with corresponding indicia positions, the corresponding indicia being positioned on objects, the object indicia corresponding to that of the cards of the initial hand, whereby each of the one or more players may display none, one, or more indicia bearing objects as an indication of that player's selection decision.

7. The method of claim 6 wherein the labeled card position indicia are numbers in sequential ascending order.

8. The method of claim 6 wherein the indicia bearing objects are numbered cards representative of the respective labeled card positions.

9. The method of claim 1 wherein each player's final hand contains five cards.

10. The method of claim 1 wherein the step of paying out comprises paying out on all or part of a shared progressive jackpot.

11. The method of claim 1 further comprising the steps of:

(a) before any cards are dealt, placing of an initial stud poker wager on the initial hand of poker cards, with the mechanism to place wagers on the at least one gaming device;

(b) before any cards are dealt, placing of a second stud poker wager on the draw hand of poker cards, with the mechanism to place wagers on the at least one gaming device;

(c) after the step of dealing the initial hand of poker cards, determining a stud poker hand ranking of the initial hand of poker cards;

(d) awarding the initial stud poker wager according to the amount wagered and a stud poker pay table;

(e) after the step of dealing the draw hand of poker cards, determining a stud poker hand ranking of the draw hand of poker cards; and (d) awarding the second stud poker wager according to the amount wagered and a stud poker pay table.

12. The method of claim 1 further comprising the steps of:

(a) before any cards are dealt, placing of a two-chance stud poker wager by each of the one or more players, with the mechanism to place wagers on the at least one gaming device;

(b) after the steps of dealing the initial hand of poker cards and the draw hand of poker cards, determining a poker hand ranking of the initial hand and the draw hand; and (c) awarding only a highest ranking hand of either the initial hand or the draw hand according to the amount wagered and a two-chance payout schedule.

* * * * *